US010359032B2

(12) United States Patent
Strickland et al.

(10) Patent No.: US 10,359,032 B2
(45) Date of Patent: Jul. 23, 2019

(54) COMPRESSORS FOR NATURAL GAS AND RELATED DEVICES, SYSTEMS, AND METHODS

(71) Applicant: Go Natural CNG, LLC, North Salt Lake, UT (US)

(72) Inventors: Jessie Daniel Strickland, West Bountiful, UT (US); Matthew M. Matsukawa, Kaysville, UT (US); Richard R. Oliver, Salt Lake City, UT (US)

(73) Assignee: Go Natural CNG, LLC, North Salt Lake, UT (US)

( * ) Notice: Subject to any disclaimer, the term of this patent is extended or adjusted under 35 U.S.C. 154(b) by 0 days.

(21) Appl. No.: 15/807,569

(22) Filed: Nov. 8, 2017

(65) Prior Publication Data

US 2018/0066640 A1 Mar. 8, 2018

Related U.S. Application Data

(63) Continuation of application No. 14/171,752, filed on Feb. 3, 2014, now Pat. No. 9,816,497.

(Continued)

(51) Int. Cl.
*F04B 25/04* (2006.01)
*F04B 25/02* (2006.01)

(Continued)

(52) U.S. Cl.
CPC ..... *F04B 25/04* (2013.01); *F04B 9/1095* (2013.01); *F04B 25/02* (2013.01); *F04B 27/005* (2013.01); *F04B 39/123* (2013.01)

(58) Field of Classification Search
CPC ..... F04B 25/02; F04B 25/04; F04B 27/005; F04B 39/123; F04B 41/06; F04B 9/1095; F04B 9/115; F04C 23/001
See application file for complete search history.

(56) References Cited

U.S. PATENT DOCUMENTS 4,334,833 A * 6/1982 Gozzi ..... F04B 9/115 417/243
4,976,591 A * 12/1990 Rivas ..... F04B 25/02 417/228

(Continued)

FOREIGN PATENT DOCUMENTS

EP 1 083 334 A2 3/2001
WO WO 2009/072160 6/2009

(Continued)

OTHER PUBLICATIONS

U.S. Appl. No. 14/171,752, Restriction Requirement dated Apr. 1, 2016.

(Continued)

*Primary Examiner* — Dominick L Plakkoottam
(74) *Attorney, Agent, or Firm* — Laurence & Phillips IP Law

(57) ABSTRACT

A natural gas compressor can include a pre-staging chamber that couples with a supply line to receive natural gas from the supply line. The compressor can additionally include a first-stage chamber that couples with the supply line to receive natural gas from the supply line. The first-stage chamber can additionally be coupled with the pre-staging chamber to receive from the pre-staging chamber natural gas that has been compressed by the pre-staging chamber. The compressor can also include a second-stage chamber configured to receive natural gas that has been compressed by the first-stage chamber.

22 Claims, 50 Drawing Sheets

Related U.S. Application Data

(60) Provisional application No. 61/760,163, filed on Feb. 3, 2013, provisional application No. 61/760,237, filed on Feb. 4, 2013, provisional application No. 61/801,703, filed on Mar. 15, 2013.

(51) Int. Cl.

| | |
|---|---|
| ***F04B 9/109*** | (2006.01) |
| ***F04B 27/00*** | (2006.01) |
| *F04B 39/12* | (2006.01) |

(56) References Cited

U.S. PATENT DOCUMENTS

| | | | | |
|---|---|---|---|---|
| 6,457,307 | B1 * | 10/2002 | Feldman | F03B 13/148 417/330 |
| 9,816,497 | B2 * | 11/2017 | Strickland | F04B 25/04 |
| 2010/0111713 | A1 * | 5/2010 | Chatfield | F04B 39/0055 417/53 |
| 2010/0158717 | A1 * | 6/2010 | Vogt | F04B 25/02 417/401 |

FOREIGN PATENT DOCUMENTS

| | | |
|---|---|---|
| WO | WO 2009/112479 | 9/2009 |
| WO | WO 2012/114229 | 8/2012 |

OTHER PUBLICATIONS

U.S. Appl. No. 14/171,752, Response to Restriction Requirement dated Aug. 1, 2016.
U.S. Appl. No. 14/171,752, Office Action dated Oct. 25, 2016.
U.S. Appl. No. 14/171,752, Response to Office Action dated Mar. 27, 2017.
U.S. Appl. No. 14/171,752, Interview Summary dated Apr. 3, 2016.
U.S. Appl. No. 14/171,752, Supplemental Amendment dated Apr. 9, 2016.
U.S. Appl. No. 14/171,752, Supplemental Amendment dated Apr. 15, 2016.
U.S. Appl. No. 14/171,752, Notice of Allowance dated Jul. 10, 2016.

* cited by examiner

COMPRESSORS FOR NATURAL GAS AND RELATED DEVICES, SYSTEMS, AND METHODS

RELATED APPLICATIONS

This application is a continuation of U.S. patent application Ser. No. 14/171,752 titled COMPRESSORS FOR NATURAL GAS AND RELATED DEVICES, SYSTEMS, AND METHODS, which was filed on Feb. 3, 2014. Priority is claimed to U.S. patent application Ser. No. 14/171,752, which claims the benefit under 35 U.S.C. § 119(e) of U.S. Provisional Patent Application No. 61/760,163, filed Feb. 3, 2013, titled HYDRAULIC COMPRESSORS FOR NATURAL GAS AND RELATED DEVICES, SYSTEMS, AND METHODS; U.S. Provisional Patent Application No. 61/760,237, filed Feb. 4, 2013, titled HYDRAULIC COMPRESSORS FOR NATURAL GAS AND RELATED DEVICES, SYSTEMS, AND METHODS; and U.S. Provisional Patent Application No. 61/801,703, filed Mar. 15, 2014, titled HYDRAULIC COMPRESSORS FOR NATURAL GAS AND RELATED DEVICES, SYSTEMS, AND METHODS, the entire contents of each of which are hereby incorporated by reference herein.

FIELD OF THE INVENTION

The present disclosure relates generally to compressors, and relates more particularly to compressors for natural gas.

BRIEF DESCRIPTION OF THE DRAWINGS

The written disclosure herein describes illustrative embodiments that are non-limiting and non-exhaustive. Reference is made to certain of such illustrative embodiments that are depicted in the figures, as listed below.

DETAILED DESCRIPTION

Compression of natural gas for uses such as fueling a vehicle can benefit from a variety of features that are absent from prior systems. For example, in some instances, it may be desirable for an owner of a natural gas vehicle to be able to refuel the vehicle at home in a safe and/or economical manner. A home refueling station or appliance could desirably have a small footprint, be easily serviceable, have desirable safety features that separate electrical and/or mechanical controls from the region in which natural gas is being compressed, facilitate disconnection from the compressor after a fueling event, and/or exhibit a variety of other features. Disclosed herein are various embodiments that address one or more of the foregoing issues and/or other issues. These and/or other advantages will be apparent from the disclosure that follows.

Figure 1A:
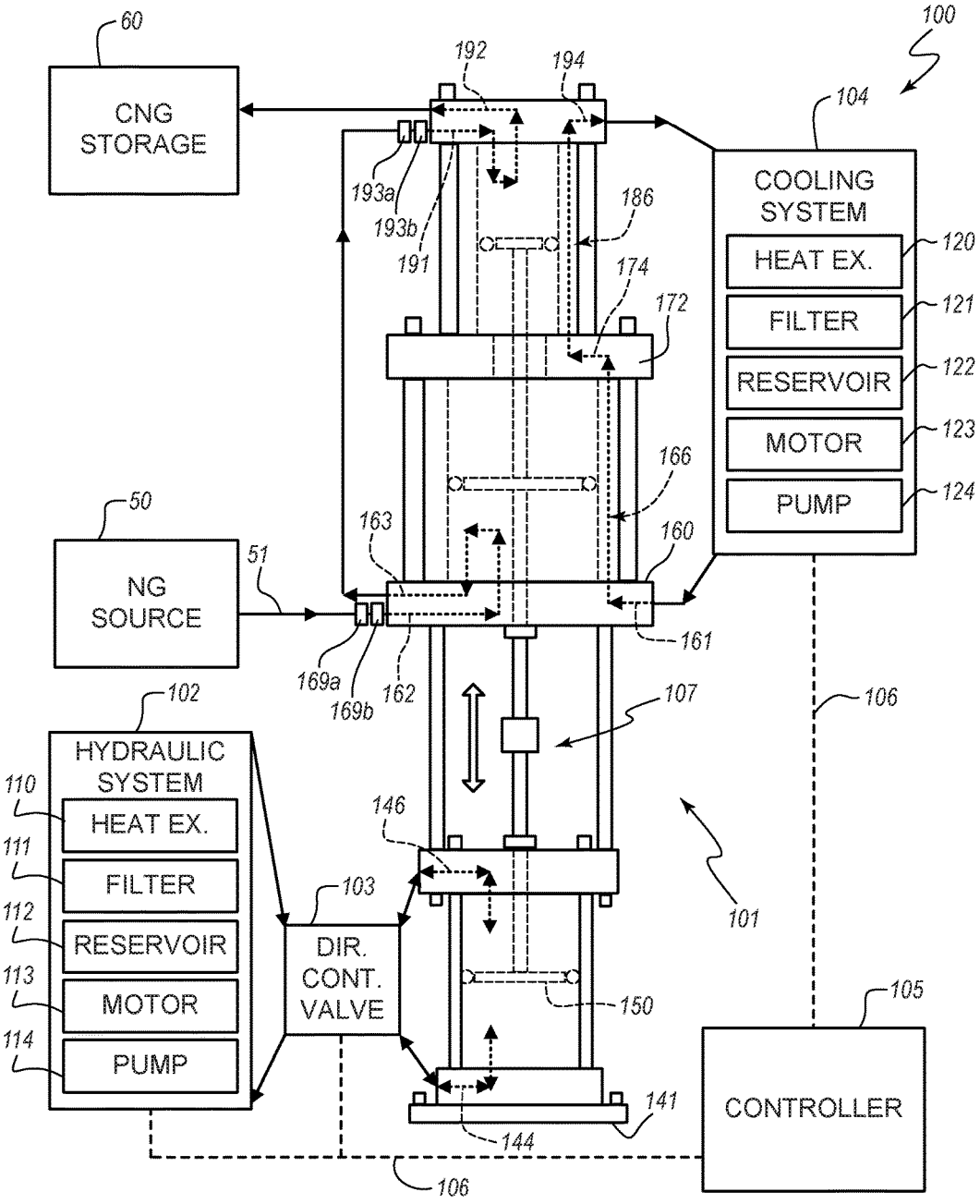
FIG. 1A is a schematic view of an embodiment of a natural gas compression system that includes a front elevation view of an embodiment of a compressor assembly.

FIG. 1A is a schematic view of an embodiment of a natural gas compression system 100. The system 100 includes a compressor assembly 101, a front elevation view of which is shown in FIG. 1A. A side elevation view of the compressor assembly 101 is provided in FIG. 1B. In the illustrated embodiment, the compressor assembly 101 has a high degree of symmetry and is substantially the same when viewed in elevation from any of its four sides, with the exception of inputs and outputs (e.g., connectors) to and from various portions of the compressor assembly 101. Other arrangements are also possible.

With continued reference to FIG. 1A, the system 100 further includes a hydraulic system 102, a directional control valve 103, a cooling system 104, and a controller 105. The controller 105 is shown connected with each of the hydraulic system 102, the directional control valve 103, and the cooling system 104 via communication lines 106. In other embodiments, more than one controller 105 may be used, which may control separate components individually. The controller 105 may include one or more buttons or actuators that are configured to effect one or more operations, such as navigating through menus, making selections, or otherwise providing commands. In some embodiments, the controller 105 can include a display that is configured to display information in a visually perceivable format. For example, the display can comprise a screen of any suitable variety, including those presently known and those yet to be devised. For example, the screen can comprise a liquid crystal display (LCD) panel. In some embodiments, a screen can be configured to receive information or otherwise interact with a system operator. For example, the screen can comprise a touch screen. In other embodiments, the controller 105 may comprise a discrete set of operations, which may be performed via actuation of dedicated buttons.

Various procedures discussed herein can be accomplished via controller 105. In some embodiments, the controller 105 can comprise a general-purpose or special-purpose computer, or some other electronic device, and at least a portion of the procedures may be embodied in machine-executable instructions therein. In other embodiments, at least a portion of the procedures (e.g., various steps or stages thereof) may be performed by hardware components that include specific logic for performing the steps or by a combination of hardware, software, and/or firmware.

The compressor assembly 101 is configured to receive natural gas from a source 50 and compress the gas to a desired pressure. The source 50 can be any suitable variety, such as, for example, a natural gas main line at a business or residence. That is, in some embodiments, the system 100 can be configured for use at a home or office. The uncompressed natural gas can be delivered to the compressor assembly 101 via a supply line 51 of any suitable variety. The compressor assembly 101 can deliver the compressed gas to a storage unit 60, such as a fuel canister or other suitable receptacle.

The hydraulic system 102 can be of any suitable variety. In the illustrated embodiment, the hydraulic system includes a heat exchanger 110, a filter 111, a reservoir 112, a motor 113, and one or more pumps 114, which can be arranged relative to each other in any suitable order and/or manner. In the illustrated embodiment, the hydraulic system 102 is configured to fluidly communicate with the directional control valve 103 via output and input conduits, through which hydraulic fluid flows in a dedicated direction. The direction is depicted in the illustrated embodiment via arrows—that is, in the illustrated embodiment, fluid in the upper branch always flows toward the directional control valve 103 and fluid in the lower branch always flows away from the directional control valve 103. The hydraulic fluid may be a fluid of any suitable variety. As further discussed below, in some embodiments, the hydraulic fluid may not only have properties that are desirable for a hydraulic medium, but may also have desirable thermal transfer properties. That is, in some embodiments other than that illustrated in FIG. 1, the hydraulic fluid may be used not only for actuating the compressor assembly 101, but also for cooling portions of the system 100, including portions of the compressor assembly 101. In certain of such embodiments, the hydraulic fluid may comprise water glycol, although other fluids are also possible.

Although hydraulic fluid flows to and from the hydraulic system 102 in a dedicated direction, the directional control valve 103 is used to periodically or otherwise reverse the direction of fluid flow relative to a piston 150 so as to selectively drive the piston 150 in opposing directions (e.g., up and down in the illustrated embodiment). Thus, fluid provided below and above the piston 150 via flow paths 144, 146, respectively, permit hydraulic fluid to flow in either direction. The directional control valve 103 can comprise a solenoid or any other suitable mechanism for controlling fluid flow to achieve the desired driving pattern for the piston 150. Accordingly, the hydraulic system 102 is used to drive the piston 150 which, in turn, drives a hydraulic ram 107 and two other pistons attached thereto in a reciprocating fashion (e.g., up and down).

The cooling system 104 can be of any suitable variety. In the illustrated embodiment, the cooling system 104 includes a heat exchanger 120, a filter 121, a reservoir 122, a motor 123, and a pump 124, which can be arranged relative to each other in any suitable order and/or manner. In the illustrated embodiment, the cooling system 104 is configured to fluidly communicate with portions of the compressor assembly 101 that are susceptible to the heating that results from the compression of gas, as discussed further below.

With reference to FIGS. 1A and, primarily, 1B, the compressor assembly 101 can include a base plate 141, which may in some instances be bolted or otherwise attached to a floor. In the illustrated embodiment, the attachment is achieved via fasteners 142, which can include bolts, nuts, and/or any other suitable fastener. A lower hydraulic head 143 can be attached to the base plate 141. In the illustrated embodiment, this attachment is achieved via spacers 148. In further embodiments, an upper hydraulic head 145 and fasteners 142 positioned above the upper hydraulic head 145 may assist in the attachment. In particular, in the illustrated embodiment, the spacers 148 can include narrowed fastening portions (e.g., threaded ends) that are able to extend through openings in the lower hydraulic head 143 into the corresponding fastening portions (e.g., internal threading) in the base plate 141. The portions of the spacers 148 that are visible in FIG. 1B can have a greater diameter than the openings through the base plate 141. In some instances, sufficient tightening may be achieved by advancing the fastening portions of the spacers 148 through the lower hydraulic head 143 and attaching them to the base plate 141. In other instances, tightening may be achieved by securing the upper hydraulic head 145 to the upper ends of the spacers 148 via the fasteners 142.

As shown in FIG. 1A, the lower hydraulic head 143 can define the fluid flow path 144 through which hydraulic fluid flows into and out of a lower hydraulic chamber 154. The lower hydraulic chamber 154 is defined at a lower end by an upper end of the lower hydraulic head 143 and is further defined at an upper end by a lower end of the piston 150. A tank or sleeve 147 defines the periphery of the lower hydraulic chamber 154. In the illustrated embodiment, the sleeve 147 is cylindrical. A hydraulic seal 151 may be positioned between the piston 150 and the inner wall of the sleeve 147.

The piston 150, the sleeve 147, and the upper hydraulic head 145 define an upper hydraulic chamber 153. Attached to the piston 150, and extending through both the upper hydraulic chamber 153 and the upper hydraulic head 145, is a lower shaft 152 of the hydraulic ram 107. When moving upwardly, the shaft 152 may pass through a bearing 159*a* to a position that is external to the upper hydraulic head 145. The bearing 159*a* may assist in maintaining the piston 148 centered within the sleeve 147. The hydraulic seal 151 may also serve to center the piston 148 relative to the sleeve 147. The shaft 152 may also pass through a seal 159*b* (e.g., rod glands) to the position that is external to the upper hydraulic head 145. The seal 159*b* may be at an interior of the sleeve 147, may be incorporated into the upper hydraulic head 145, or may be at an exterior of both the sleeve 147 and the upper hydraulic head 145 (as shown). In the illustrated embodiment, the upper end of the shaft 152 is exposed. However, in other embodiments, the upper end of the shaft 152 may be encased in any suitable housing or compartment.

A portion of the compressor assembly 101 that includes and is between the hydraulic heads 143, 145 may be referred to as a hydraulic driver portion 130 of the compressor assembly 101. A portion of the compressor assembly 101 that is between the upper hydraulic head 145 and a first-stage head 160 may be referred to as a force transfer portion 132 of the compressor assembly 101. As further discussed below, the force transfer portion 132 separates the hydraulic and gas compression portions 130, 137 of the compressor from each other, which can improve safety, reduce fouling of the gas, and/or facilitate disassembly and/or repair of the compressor assembly 101.

The hydraulic ram 107 can include both the lower shaft 152 and an upper shaft 156. The shafts 152, 156 can be selectively attached to each other in any suitable manner. In the illustrated embodiment, the shafts 152, 156 are attached via a removable connector sleeve 158, which is discussed further below. When the connector sleeve 158 is in place, the shafts 152, 156 operate as a unitary hydraulic ram 107. The upper shaft 156 may pass through a bearing 159*a* and/or a seal 159*b* associated with the first-stage head 160. The seal 159*b* may be located at an exterior or interior of the head 160, or the seal 159*b* may be incorporated into the head 160. In the illustrated embodiment, the seal 159*b* is positioned below the head 160.

Figure 1B:
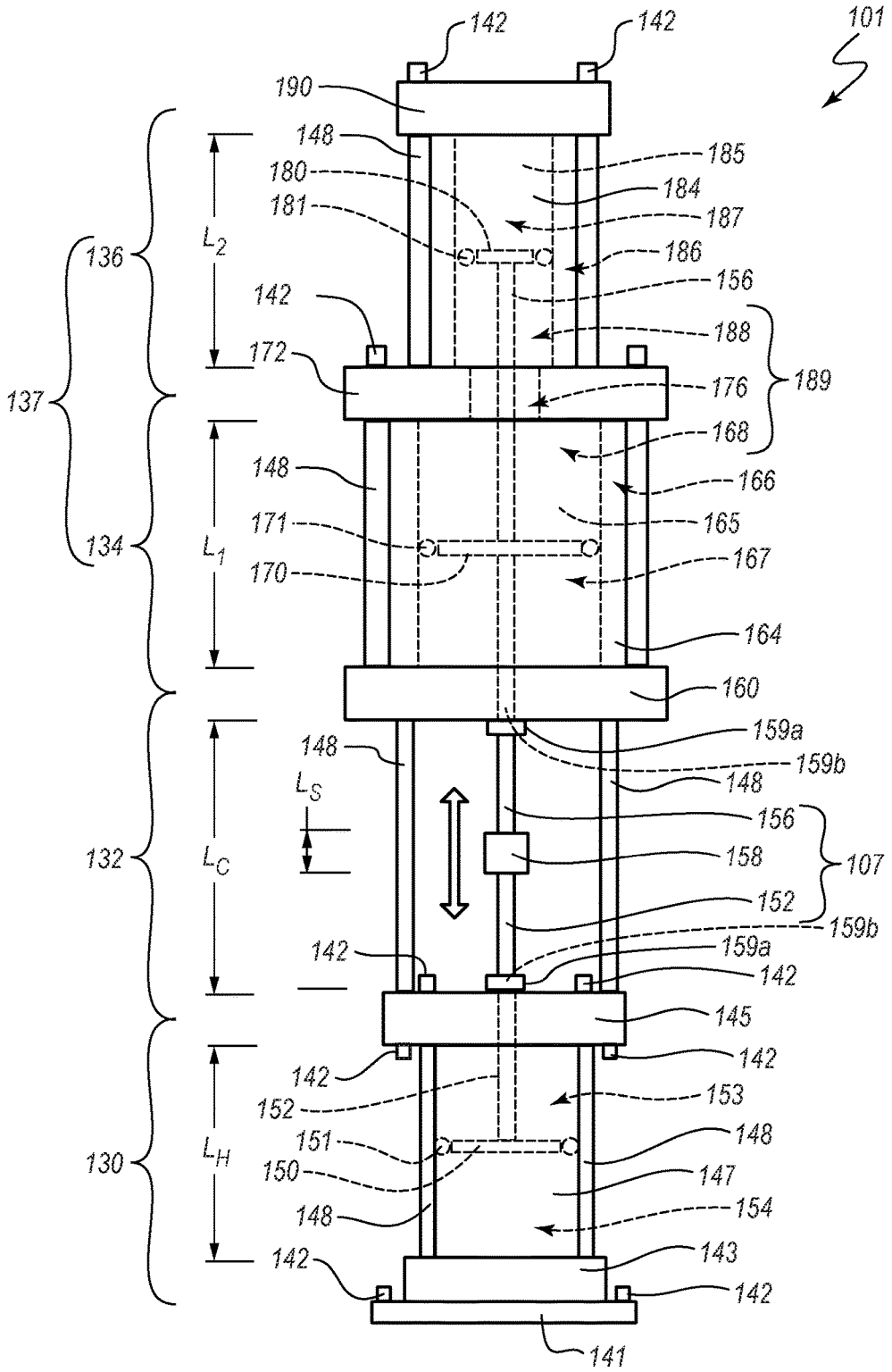
FIG. 1B is a side elevation view of the compressor assembly of FIG. 1A.

Positioned between the first-stage head 160 and an intermediate head 172 are two sleeves 164, 165. In FIG. 1B, the outer edges of the outer sleeve 164 are hidden from view by spacers 148. The outer edges of the inner sleeve 165 are shown in broken lines to indicate that they are hidden from view by the outer sleeve 164. An outer surface of the inner sleeve 165 and an inner surface of the outer sleeve 164 cooperate to define a cooling channel 166 through which cooling fluid can be passed. In particular, as shown in FIG. 1A, the first-stage head 160 defines a fluid path 161 through which cooling fluid can be passed into the cooling channel 166. Further, the intermediate head 172 defines a fluid path 174 through which the cooling fluid can pass as it exits the cooling channel 166.

Positioned within the inner sleeve 165 is a piston 170 that separates a first-stage chamber 167 from a lower intermediate chamber 168. A seal 171 is attached to the piston 170. The seal 171 can be in a fluid-tight engagement with each of the piston 170 and the inner sleeve 165 so as to substantially prevent natural gas from flowing from the first-stage chamber 167 to the lower intermediate chamber 168 when the assembly 101 is operating in manners such as discussed further below. The seal 171 can be formed of any suitable material. In some embodiments, the seal 171 can provide a fluid-tight seal against a metallic surface (e.g., the inner surface of the sleeve 165), such as steel or stainless steel, but can be resistant to wear so as to be capable of undergoing large numbers of compression cycles before requiring replacement (e.g., the seal 171 can be capable of large cycling numbers or having a large cycling life expectancy). In other embodiments, the sleeve 165 may be non-metallic and/or the inner surface of the sleeve 165 may be treated or coated with a non-metallic material, and the seal 171 can be configured to provide a fluid-tight seal against the material of which the inner surface of the sleeve 165 is formed. In some embodiments, the seal 171 comprises polytetrafluoroethylene (PTFE), carbon, and/or molybdenum. For example, in some embodiments, the seal 171 comprises PTFE (e.g., Teflon®, available from DuPont) and molybdenum-impregnated graphite. In some embodiments, the graphite provides the seal 171 with structure so as to resist elastic material (seal) flow and project laterally into tight contact with the sleeve 165, even under high pressure due to gas being compressed within the first-stage chamber 167, whereas the PTFE and/or molybdenum permit lubricious movement of the seal 171 relative to the sleeve 165. Other or further materials are also possible. The cross-section of the seal can be shaped substantially as a U, with the closed end of the U facing upward and the open end facing downward, in the illustrated arrangement. This can allow the normal pressure from the gas that is compressed in the first-stage chamber 167 to force a sealing surface of the seal against the wall of the cylinder and the piston. This can prevent leaking due to high pressure.

Figure 2:
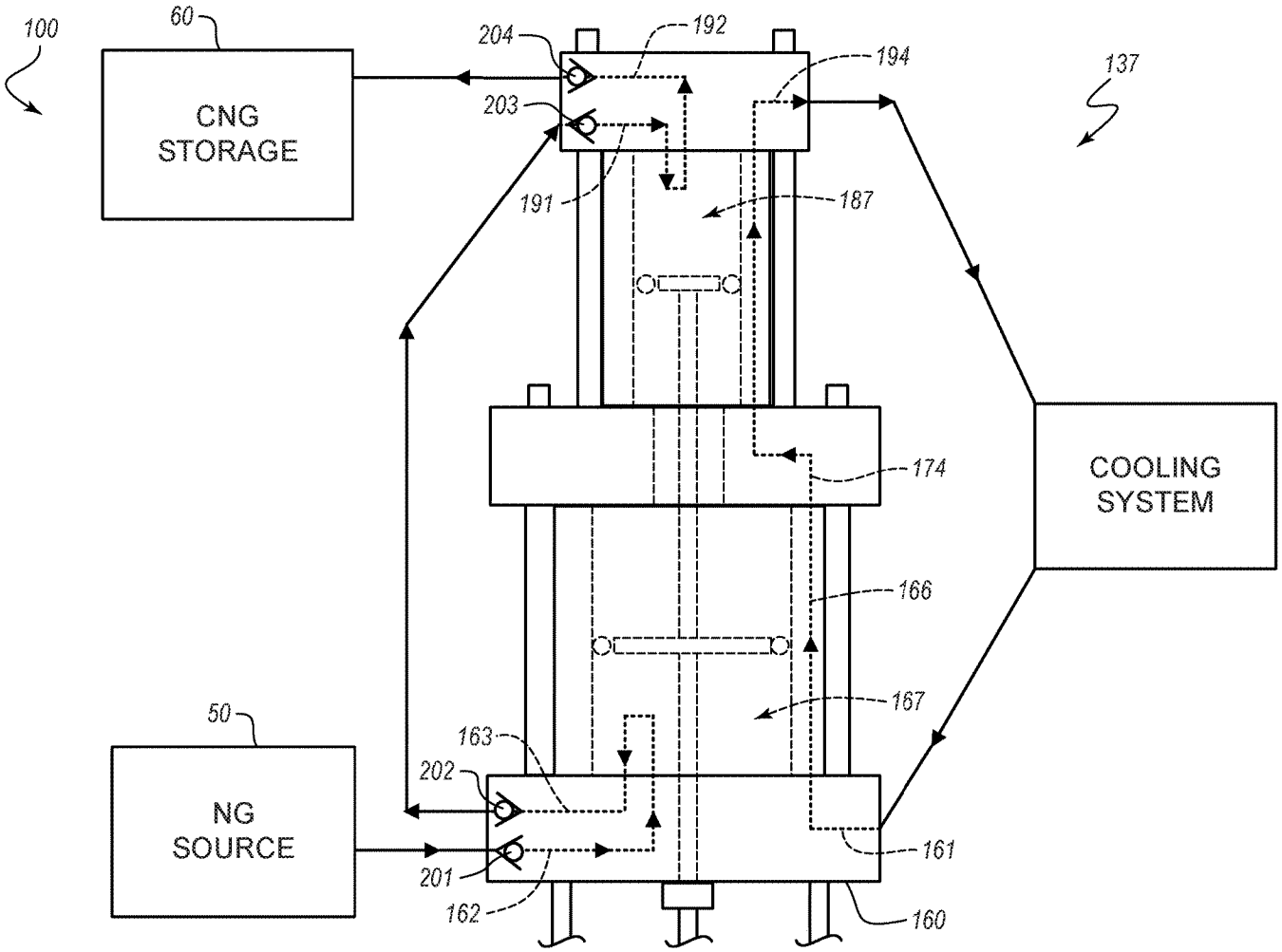
FIG. 2 is another schematic view of the natural gas compression system of FIG. 1A that includes a front elevation view of only a gas compression assembly portion of the compressor assembly.

With reference to FIG. 1A, the first-stage head 160 can further define channels or fluid paths 162, 163 that are configured to conduct gas there through. As shown in FIG. 2, in some embodiments, one-way valves 201, 202 (e.g., check valves, reed valves) can be positioned within the fluid paths 162, 163, respectively. In the illustrated arrangement, the one-way valve 201 and the fluid path 162 permit gas to flow into the first-stage chamber 167, and the one-way valve 202 and the fluid path 163 permit gas to flow out of the first-stage chamber 167.

With reference again to FIG. 1A, the system 100 can include one or more pressure sensors 169*a*, 193*a* and temperature sensors 169*b*, 193*b*. Although the connections are not expressly depicted in FIG. 1A, the sensors 169*a*, 193*a*, 163*b*, 193*b* can be coupled with the controller 105, which can use data or readings received from the sensors to adjust, alter, or regulate operation of the system 100. In the illustrated embodiment, the sensors 169*a*, 169*b* are used to determine physical properties of the source gas as it enters the first stage, and the sensors 193*a*, 193*b* are used to determine physical properties of the source gas after it has exited the first stage and as it enters the second stage. Any suitable sensors may be used, such as pressure transducers or thermocouples. Additional sensors may be used to similarly determine properties of the gas after it has exited the second stage.

The first-stage head 160 and at least a portion of the intermediate head 172, and the portions of the assembly 101 located between them, can be referred to as the first-stage portion 134 of the assembly 101. Other portions of the intermediate head 172 and a second-stage head 190, which will be discussed hereafter, can be referred to as the second-stage portion 134 of the assembly 101. Together, the first- and second-stage portions 134, 136 of the assembly 101 can be referred to as a gas compression assembly 137.

With reference to FIG. 1B, positioned between the second-stage head 190 and the intermediate head 172 are two sleeves 184, 185. In FIG. 1B, the outer edges of the outer sleeve 184 are hidden from view by spacers 148. The outer edges of the inner sleeve 185 are shown in broken lines to indicate that they are hidden from view by the outer sleeve 184. An outer surface of the inner sleeve 185 and an inner surface of the outer sleeve 184 cooperate to define a cooling channel 186 through which cooling fluid can be passed. In particular, as shown in FIG. 1A, the intermediate head 172 defines the fluid path 174 through which cooling fluid can be passed into the cooling channel 186. Further, the second-stage head 190 defines a fluid path 194 through which the cooling fluid can pass as it exits the cooling channel 186. From the fluid path 194, the cooling fluid can be passed from the assembly 101 back to the cooling system 104.

In the illustrated embodiment, the cooling fluid is introduced into the assembly 101 at a low position and is forced upwardly through the assembly so as to exit at an upper end of the assembly 101. Such an arrangement can aid in the distribution of the cooling fluid. For example, this arrangement can allow for gravity to work against the fluid movement provided by the pump 124. This can reduce or prevent the formation of fast-paced currents or streams that would otherwise course through the fluid channels 166, 186 without first fully encircling the inner sleeves 165, 185, thereby permitting the formation of hot spots or regions. Stated otherwise, by having the entry ports into the fluid channels 166, 186 at the bottom end of these channels, the cooling fluid can pool at the lower end of the channels 166, 186 and then be forced upward against gravity by the action of the pump 124. This can permit the cooling fluid to fully encircle or encompass the inner cylindrical sleeves 165, 185, of the illustrated embodiment, which can result in more uniform cooling of the compression assembly 137. Further, heated fluids rise in such an arrangement, and thus the hotter fluids may naturally be more readily removed from the fluid channels 166, 186. Similarly, such an arrangement can prevent air pockets from developing within the flow path, which could also result in hot spots. For example, filling the channels 166, 186 from the bottom may result in a relatively laminar fluid flow.

With reference to FIG. 1B, positioned within the inner sleeve 185 is a piston 180 that separates a second-stage chamber 187 from an upper intermediate chamber 188. A seal 181 is attached to the piston 180. The seal 181 can be in a fluid-tight engagement with the outer sleeve 184 and with the piston 180 so as to substantially prevent natural gas from flowing from the second-stage chamber 187 to the lower intermediate chamber 188 when the assembly 101 is operating in manners such as discussed further below. The seal 181 can be formed of any suitable material, such as those discussed above.

With reference to FIG. 1A, the second-stage head 190 can further define channels or fluid paths 191, 192 that are configured to conduct gas therethrough. As shown in FIG. 2, in some embodiments, one-way valves 203, 204 (e.g., check valves) can be positioned within the fluid paths 191, 192, respectively. In the illustrated arrangement, the one-way valve 203 and the fluid path 191 permit gas to flow into the second-stage chamber 187, and the one-way valve 204 and the fluid path 192 permit gas to flow out of the second-stage chamber 187. The compressed gas can be delivered from the fluid path 192 to the compressed natural gas storage unit 60.

As shown in FIG. 1B, the intermediate head 172 can further define an intermediate channel 176 that is open, which can provide fluid communication between the chambers 168, 188. Together, the chambers 168, 188 and the channel 176 can define an intermediate chamber 189, which may also be referred to as a pre-staging chamber. In some embodiments, such as where gas is introduced therein, the intermediate chamber 189 may also be referred to as a pre-stage chamber. In the illustrated embodiment, gas is not directly introduced into the intermediate chamber 189 from the source 50. It is possible in some instances, however, that if gas leaks through either of the seals 171, 181, it can enter the intermediate chamber 189.

In some embodiments, mounting the assembly 101 vertically can preserve the seals 171, 181, or stated otherwise, can provide the seals 171, 181 with greater wear times than may be achieved in other orientations, such as horizontal mounting arrangements. For example, in some embodiments, placing excess weight on only one side of a seal can stress that portion of the seal and lead to quicker and uneven wear. Such uneven loading of the seals 171, 181 can be avoided in vertical arrangements such as that depicted in the drawings. Further, in the illustrated embodiment, the bearing 159*a* that is associated with the first-stage head 160 can aid in centering the shaft 156 relative to the inner sleeve 165. This can aid in centering the pistons 170, 180 relative to the inner sleeves 165, 185. The seals 171, 181 can also aid in centering the pistons 170, 180 relative to the inner sleeves 165, 185, and may be free from excessive pressure or forces in any direction perpendicular a longitudinal axis of the driving shaft or hydraulic ram 107. Stated otherwise, the seals 171, 181 can be balanced relative to a central axis of the compressor assembly 101. Such balance can extend the life of the seals 171, 181.

Further, in some embodiments, a vertical arrangement of the compressor assembly 101 can allow for the omission of a bearing element associated with the intermediate head 172, or stated otherwise, at a position between the pistons 170, 180. Whereas, if the compressor assembly 101 were mounted horizontally, in some instances, it could be desirable to include an additional bearing 159*a* at a position between the pistons 170, 180 (e.g., within the intermediate head 172). Such an intermediate bearing could reduce the load on the seal 181 that would otherwise result from the long moment arm between the bearing 159*a* of the first-stage head 160 and the piston 180, which could permit gravity to unequally load the seals 171, 181 against the inner sleeve 165. Omission of such an intermediate bearing in certain embodiments of vertically mounted compressor assemblies 101 can facilitate manufacture and maintenance of the assemblies 101 and reduce costs.

In some embodiments, vertical mounting can reduce a footprint of the compressor assembly 101. For example, the vertically oriented assembly 101 can occupy much less floor space than if the same assembly 101 were situated horizontally on a floor. Such an arrangement may be useful, for example, in home or office installations.

With reference to FIG. 1B, in some embodiments, the compressor assembly 101 has a uniform stroke length for each of its subcomponents. In particular, in the illustrated embodiment, the hydraulic driver portion 130 can have a stroke length of $L_H$. Due to the fixed arrangement of each of the pistons 170, 180 to the hydraulic ram 107, each of the first- and second-stage portions 134, 136 of the assembly 101 likewise have a stroke length of $L_H$. Stated otherwise, in the illustrated embodiment, $L_1=L_2=L_H$. The stroke length of the force transfer portion 132 is also $L_H$. However, due to the presence of the connector sleeve 158, in some embodiments, it is desirable for the distance between the bearings 159*a* to be greater than the stroke length $L_H$ by at least a height of the sleeve 158, which is depicted as $L_C$. Stated otherwise, the stroke length $L_C$ of the force transfer portion 132 of the assembly 101 is at least as great as the stroke length $L_H$ plus the length of the sleeve $L_S$. The length $L_C$ can be even greater, if desired. Regardless of the length of the stroke length $L_C$, however, an arrangement such as that in FIG. 1A can advantageously allow for as great a separation between the hydraulic system 102, the cooling system 104, the controller 105, and/or the communication lines 106 as desired. For example, with reference to FIG. 1A, in some instances, it may be desirable to space the motors 113, 123, pumps 114, 124, and/or the controller 105 at least 15 feet or more from the compressor assembly 101. Such an arrangement may reduce the risk of igniting stray gases. Further separation may be achieved merely by selecting longer hydraulic and/or cooling hoses.

Operating the compressor assembly 101 via hydraulics also permits greater variability in the rate at which the assembly 101 can be run, as discussed below with respect to other embodiments. For example, hydraulic pumps may not be constrained to the same speeds or other constraints of crankshaft motors. And the motor driving the hydraulics can be spaced much further away from the gas-containing compression assembly 137.

Figure 3B:
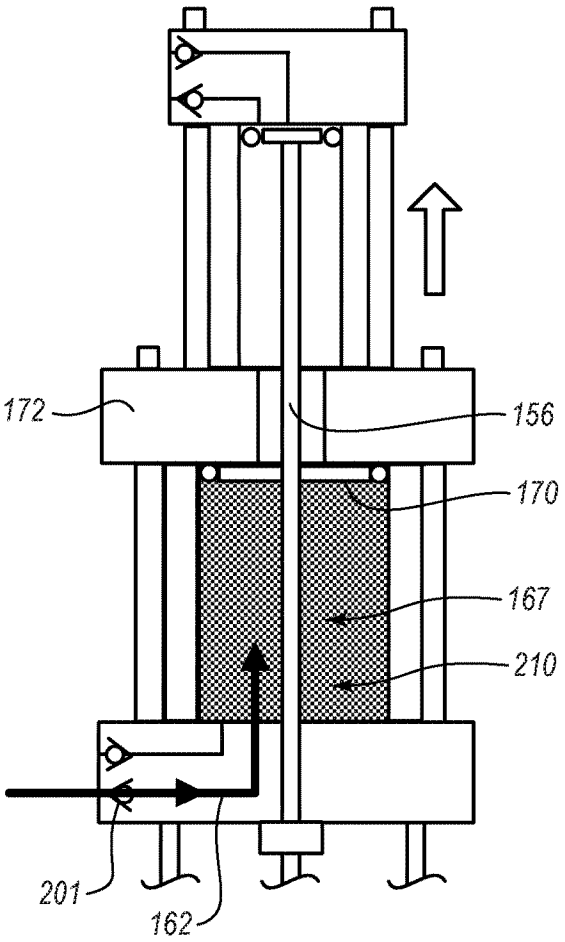
FIGS. 3A-3D are cross-sectional views of various sequential moments during operation of the gas compression assembly of FIG. 2.
Figure 3A:
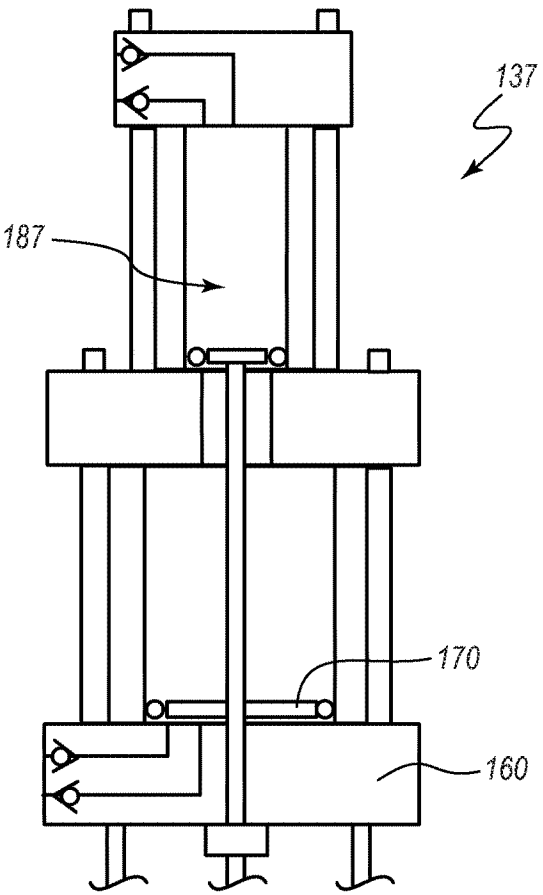

FIGS. 3A-3D depict various steps or operational orientations of the gas compression assembly 137. FIG. 3A depicts the assembly 137 in an original orientation prior to ever having been used, as only ambient air captured therein during assembly is present in either of the first- or second-stage chambers 167, 187. In normal operation, however, the assembly 137 will generally cycle through the orientations and fill patterns of FIGS. 3B-3D.

In FIG. 3B, the drive shaft 156 urges the piston 156 upwardly toward the intermediate head 172, thereby expanding the volume of the first-stage chamber 167. As a result, a first charge 210 of natural gas from the source 50 passes through the valve 201 and the flow path 162 into the first-stage chamber 167. Such gas flow is depicted by bold-face arrows. Moreover, throughout the drawings, gas flow through various flow paths is depicted by bold-face arrows. Further, the direction of movement of the drive shaft is depicted by arrows shown in outline form.

Figure 3D:
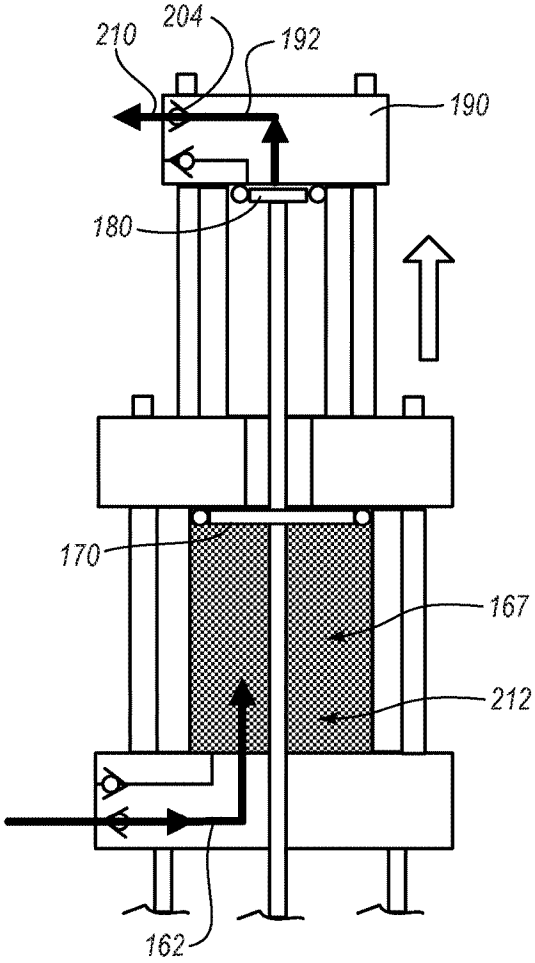
Figure 3C:
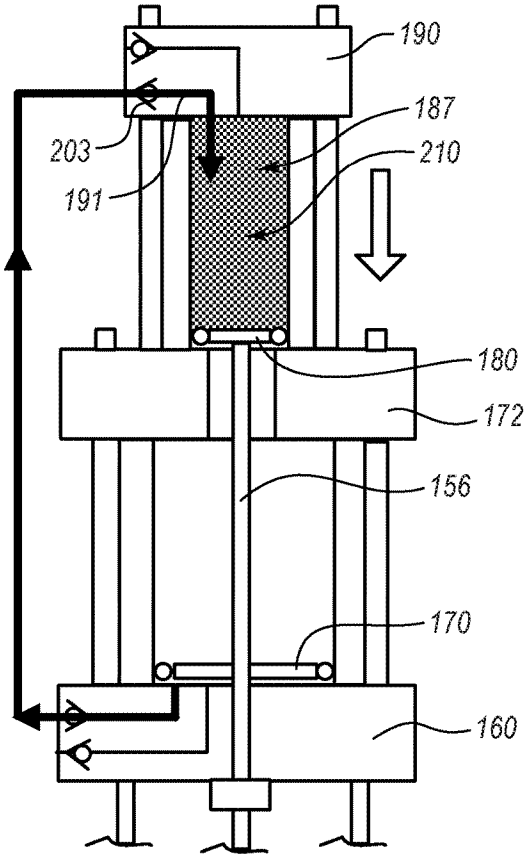

In FIG. 3C, the drive shaft 156 urges the pistons 170, 180 downward, thereby forcing the first charge 210 from the first-stage chamber 167, through the valve 203 and the fluid path 191, and into the second-stage chamber 187.

In FIG. 3D, the drive shaft 156 urges the pistons 170, 180 upward again, thereby expelling the first charge 210 of now-compressed natural gas through the fluid path 192 and the valve 204 into the storage tank 60. This action also introduces a second charge 212 of natural gas into the first-stage chamber 167.

Figure 4:
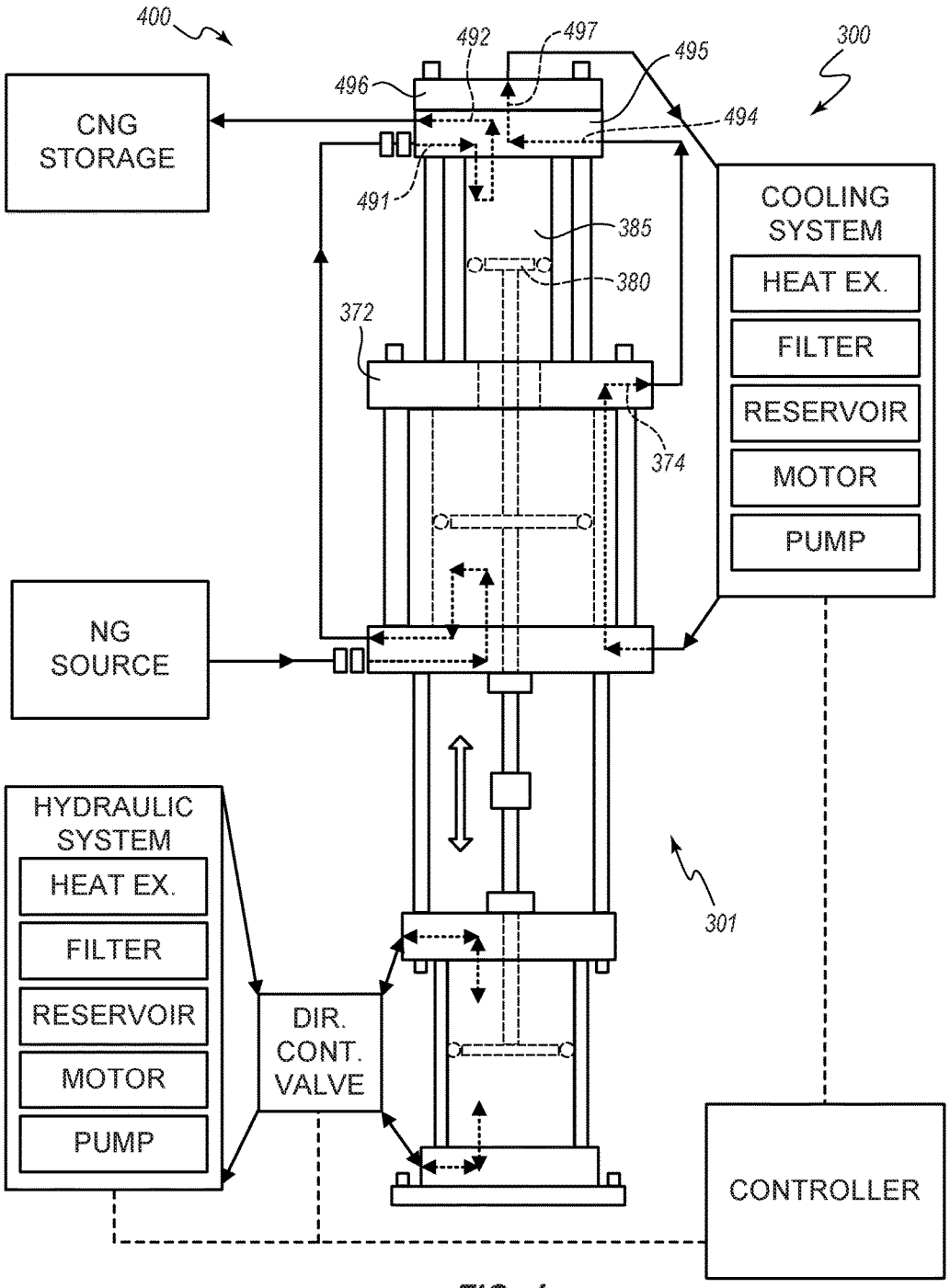
FIG. 4 is a schematic view of another embodiment of a natural gas compression system that includes a front elevation view of another embodiment of a compressor assembly.
Figure 5A:
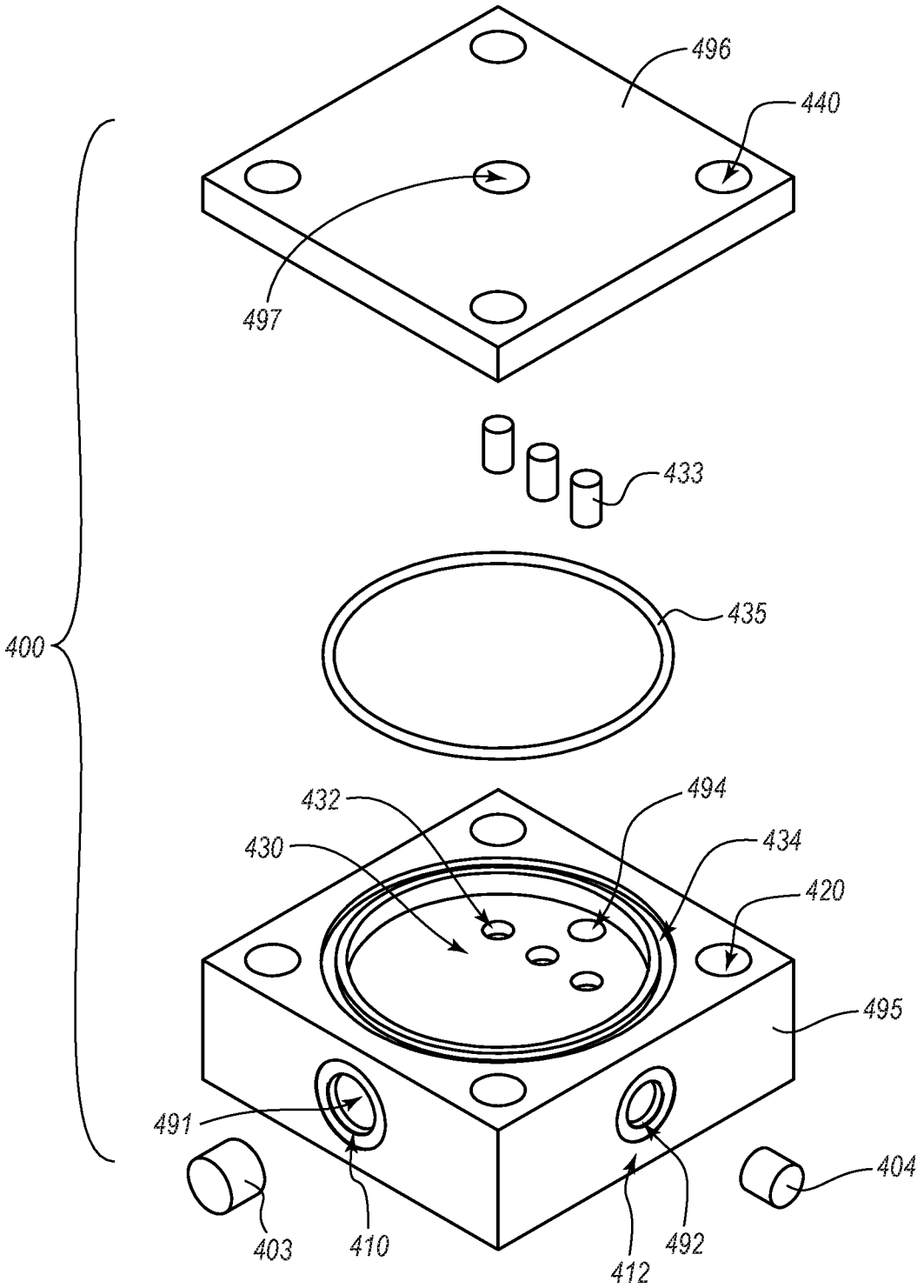
FIG. 5A is an upper exploded perspective view of an embodiment of a cooling head assembly.
Figure 5B:
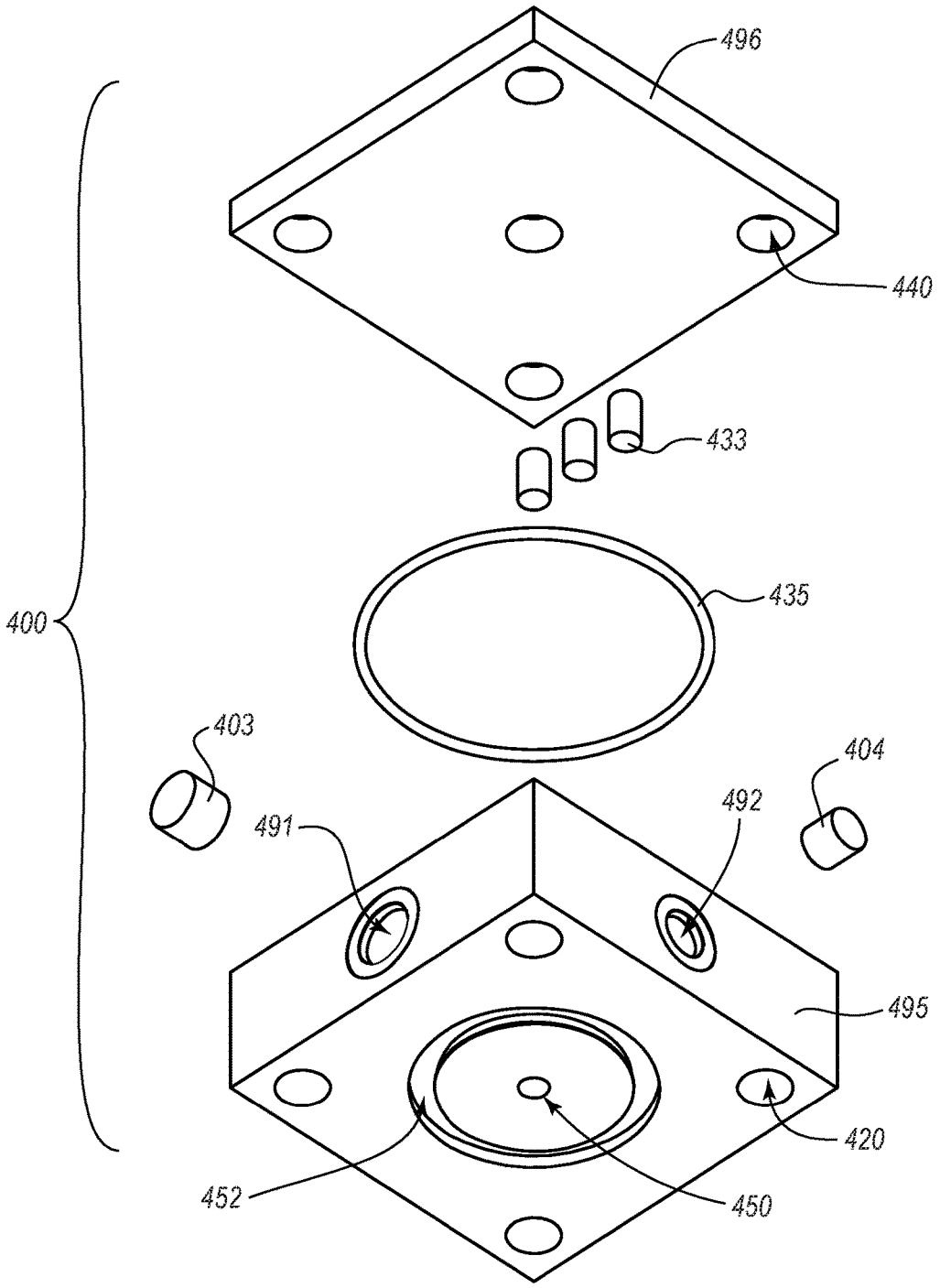
FIG. 5B is a lower exploded perspective view of the cooling head assembly of FIG. 5A.

FIG. 4 is a schematic view of another embodiment of a natural gas compression system 300 that can resemble the system 100 described above in certain respects, and a front elevation view of a compressor assembly 301 similar to the compressor assembly 101 is shown. Accordingly, like features are designated with like reference numerals, with the leading digits incremented to "3." Relevant disclosure set forth above regarding similarly identified features may not be repeated hereafter. Moreover, specific features of the system 300 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the system 300. Any suitable combination of the features and variations of the same described with respect to the system 100 can be employed with the system 300, and vice versa. This pattern of disclosure applies equally to further embodiments depicted in subsequent figures and described hereafter, wherein the leading digits may be further incremented.

Unlike the assembly 101 discussed above, the assembly 301 does not include two sleeves at its second-stage end. Rather, the assembly 301 includes a single sleeve 385, which is analogous to the sleeve 185 discussed above. Cooling of the second stage is provided by heat dissipation at the surface of the sleeve 385 and also by a cooling head assembly 400 positioned at the top of the assembly 301. An intermediate head 372 directs fluid flow through a fluid path 374 to an exterior of the head 372, where the fluid flow is subsequently introduced into a fluid path 494 of the cooling head assembly 400.

Figure 6A:
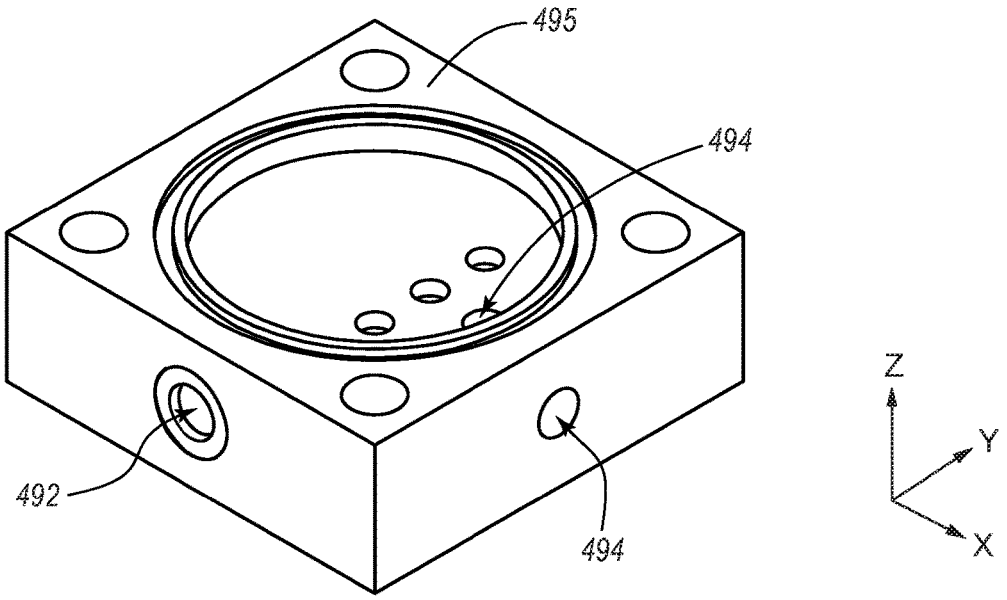
FIG. 6A is an upper perspective view of a base portion of the cooling head assembly of FIG. 5A shown rotated 90 degrees relative to the view shown in FIG. 5A.
Figure 6B:
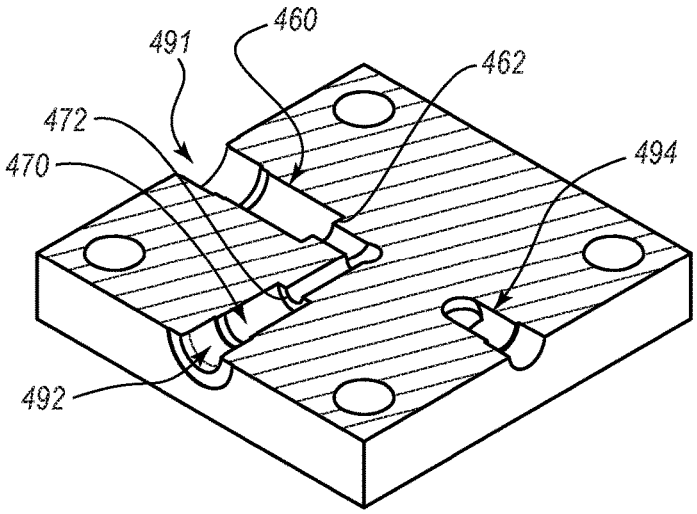
FIG. 6B is an XY-plane cross-sectional view through a center of the base portion in the orientation depicted in FIG. 6A.
Figure 6C:
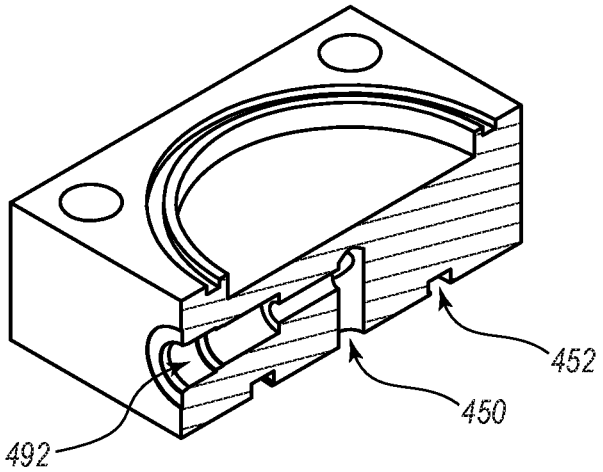
FIG. 6C is a YZ-plane cross-sectional view through a center of the base portion in the orientation depicted in FIG. 6A.
Figure 6D:
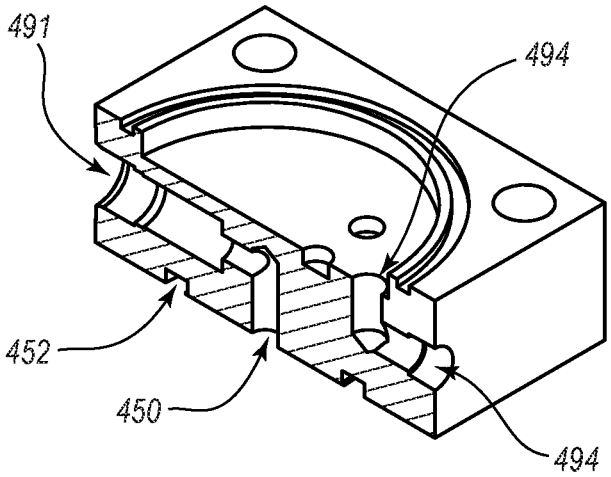
FIG. 6D is an XZ-plane cross-sectional view through a center of the base portion in the orientation depicted in FIG. 6A.

With reference to FIGS. 4 through 6D, the cooling head assembly 400 includes a second-stage base head 495 and a second-stage cap 496. The base head 495 defines the fluid path 494, which enters through a side of the head 495 and exits to a cavity 430 defined by the head 495. In the illustrated embodiment, the cavity 430 includes three recesses 432 that are configured to receive the base ends of three pins 433, or disruptors, although more or fewer pins are possible. Other diffusion elements are also contemplated. When the cooling head assembly 400 is assembled, the pins 433 are held in place by the recesses 432 and the cap 496. In the illustrated embodiment, the underside of the cap 496 is smooth and rests against the top surface of the pins 433. The pins 433 thus encourage fluid exiting from the fluid path 494 to circulate or otherwise flow in a nonlinear, indirect, or circuitous pattern through the cavity 430 before exiting from the cavity 430, thus providing an environment that is conducive to thermal transfer. From there, the fluid passes through an exit port 497 defined by the cap 496. The illustrated embodiment includes an O-ring 435 or any other suitable seal that is compressed between the cap 496 and a groove 434 that encircles the cavity 430. The base of the cavity 430 can define a large surface area suitable for thermal transfer. As shown in FIGS. 6C and 6D, gaseous flow paths 491, 492 can be directly below the bottom surface of the cavity. In some embodiments, it may be desirable for the thickness of this region to be as small as possible, while maintaining sufficient strength to withstand gas pressure, in order to increase thermal transfer.

The flow paths 491, 492 are analogous to the flow paths 191, 192 described above. In the illustrated embodiment, the base head 495 defines a port 450 that is fluidly connected with each of the flow paths 491, 492, and further defines an entrance port 410 at a proximal end of the flow path 491 and an exit port 412 at a distal end of the flow path 492. The direction of travel of the piston 380 dictates whether gas is caused to move along the entrance flow path 491 and then through the common port 450, or through the common port 450 and then along the exit flow path 492. Check valves 403, 404 (analogous to the check valves 203, 204) can be positioned within the flow paths 491, 492, respectively. Specifically, the base head 495 can define seats 460, 470 for receiving the check valves 403, 404, respectively. The seats 460, 470 can each define a shelf 462, 472 against which a base of the check valve 403, 404 can rest, in some embodiments. In other embodiments, a removable, hardened seat may be placed between a base end of the check valve 403, 404 and the shelves 462, 472 of the seats 460, 470, as discussed further below. The check valves 403, 404 can be held in place by any suitable fitting (not shown).

The illustrated base head 495 includes an annular recess 452 for receiving the sleeve 385. In other embodiments, an outer sleeve (such as the outer sleeve 184) may be used. In certain of such embodiments, an additional annular recess 452 may encompass the annular recess 452. The base head 495 and the cap 496 can define fastener openings 420, 440, respectively, through which fasteners can be advanced to secure the base head 495 and the cap 496 to each other and/or to secure the cooling head assembly 400 to the compressor assembly 301.

Figure 7:
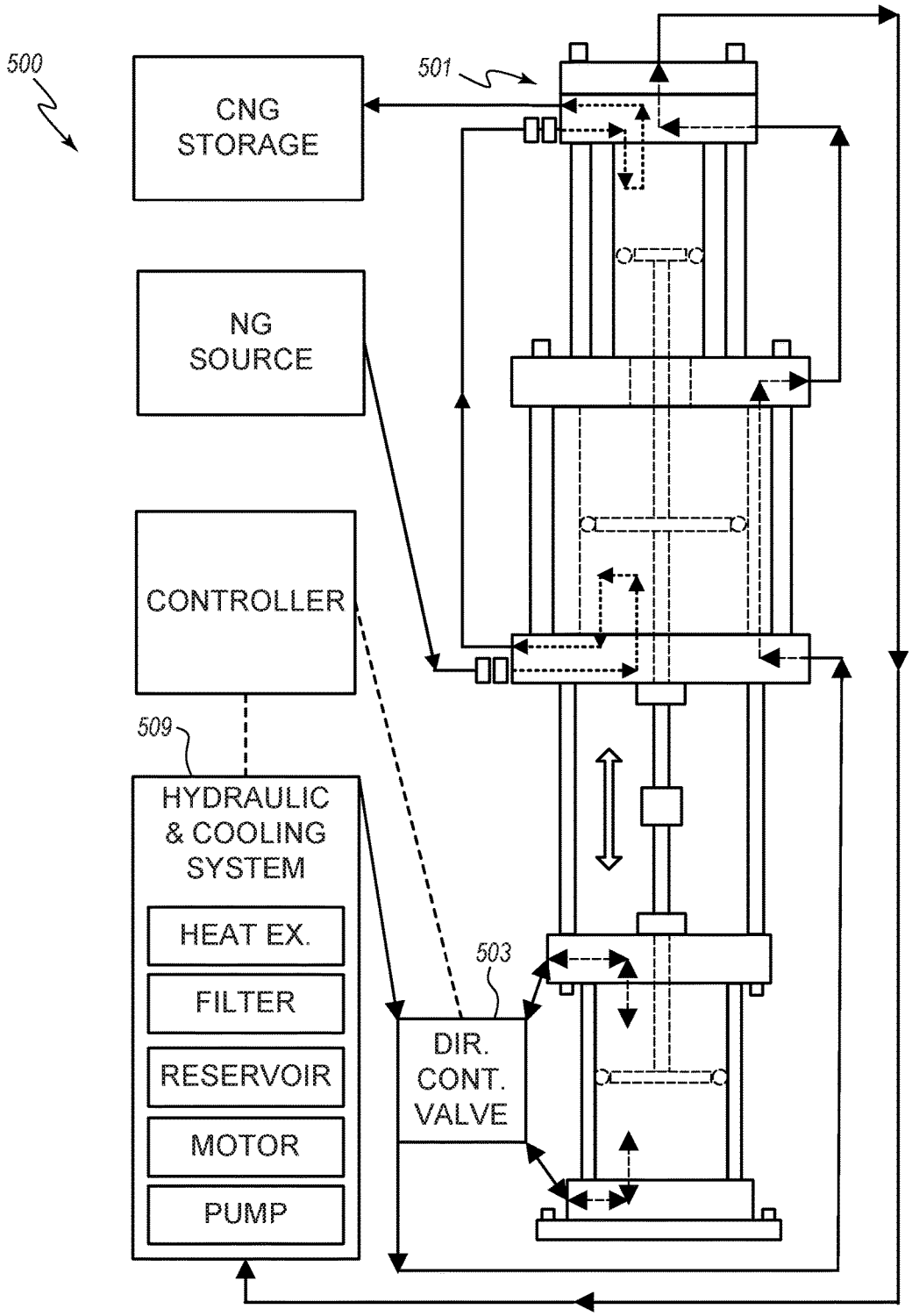
FIG. 7 is a schematic view of another embodiment of a natural gas compression system that includes a front elevation view of the embodiment of a compressor assembly depicted in FIG. 4 (the compression system is also compatible with the embodiment of a compressor assembly depicted in FIG. 1A).

FIG. 7 is a schematic view of another embodiment of a natural gas compression system 500 that includes a front elevation view of the embodiment of a compressor assembly 501, such as the compressor assembly 301 depicted in FIG. 4. Although the compression system 500 is shown in operation with such a compressor assembly, it can be implemented with the compressor assembly 101 depicted in FIG. 1A in other embodiments. The natural gas compression system 500 has a combined hydraulic and cooling system 509, which replaces the separate systems 102, 104 discussed above. Use of a liquid having good thermal transfer and lubricity, such as water glycol, for both hydraulic and cooling functions thus eliminates redundant features, such as heat exchangers, reservoirs, motors, filters, and pumps. This can reduce the purchase and/or running costs of the system 500, facilitate its operation and upkeep, and/or reduce its overall size/footprint.

As shown in FIG. 7, the combined hydraulic and cooling system 509 operates substantially the same as the hydraulic system 102. However, rather than having the return from the direction control valve 103 go directly back to the system 509, the returning fluid is instead cycled through the cooling circuit. Ultimately, after the fluid has cycled through the cooling circuit of the compressor system 501, it is returned to the hydraulic and cooling system 509.

Figure 8:
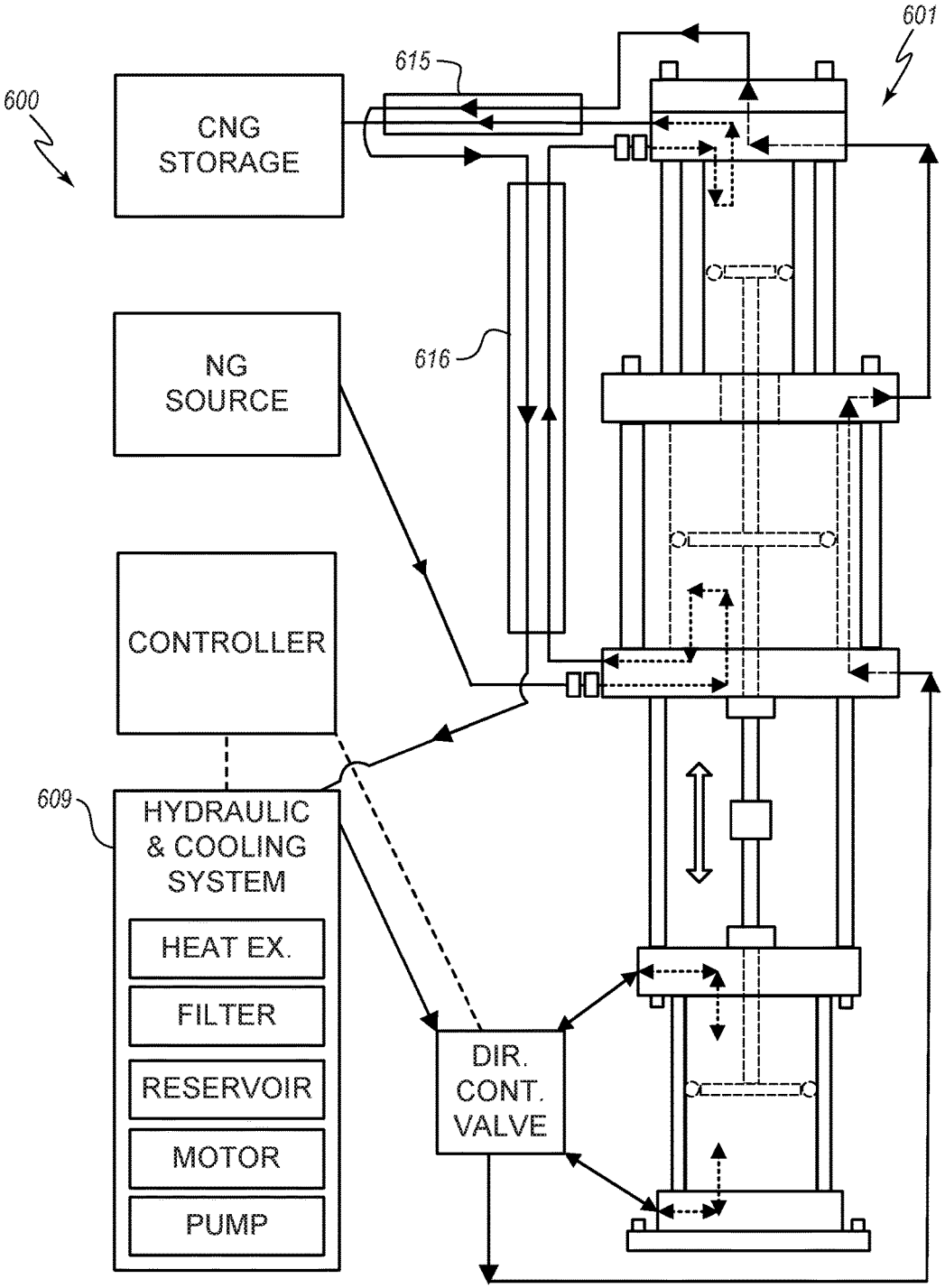
FIG. 8 is a schematic view of another embodiment of a natural gas compression system that includes a front elevation view of the embodiment of a compressor assembly depicted in FIG. 4 (the compression system is also compatible with the embodiment of a compressor assembly depicted in FIG. 1A).

FIG. 8 is a schematic view of another embodiment of a natural gas compression system 600 that includes a front elevation view of the embodiment of a compressor assembly 601, such as the compressor assembly 301 depicted in FIG. 4. Although the compression system 600 is shown in operation with such a compressor assembly, it can be implemented with the compressor assembly 101 depicted in FIG. 1A in other embodiments. The natural gas compression system 600 has a combined hydraulic and cooling system 609, although the additional features discussed with respect to FIG. 8 could be practiced with compression systems having separate hydraulic and cooling systems.

As shown in FIG. 8, the system 600 includes cooling circuit extenders. Specifically, the system 600 includes heat exchanger sleeves 615, 616 that encompass flow paths of compressed natural gas. In particular, the sleeve 615 encompasses a flow path of compressed gas that exits from a second stage and passes toward a storage unit, and the sleeve 616 encompasses a flow path of compressed gas that exits from the first stage and passes toward the second stage. Other flow directions are possible. In some embodiments, the sleeves 615, 616 include elongated tubes that encompass tubing through which the gas travels. The liquid coolant can flow directly over the hose or tubing that is transferring the gas. In other embodiments, the sleeves 615, 616 may be replaced with a single sleeve. For example, in some arrangements, the gas carrying tubes may pass through a single sleeve 615 or 616, either in series or in parallel. In other embodiments, the sleeves 615, 616 may be replaced with one or more liquid-filled chambers in which the liquid flows more slowly, or not at all.

FIGS. 9A-9D are schematic views of another embodiment of a natural gas compression system 700. The system 700 includes a gas compression assembly portion of another embodiment of a compressor assembly 701, such as that depicted in FIG. 4. The system 700 is configured to bleed high pressure gas from a fill hose 61 back into the gas compressor assembly 701 after a filling operation. The system 700 includes a three-way, two-position valve 717 and a two-way on/off valve 718. The valve 718 may be a normally closed solenoid valve.

Figure 9A:
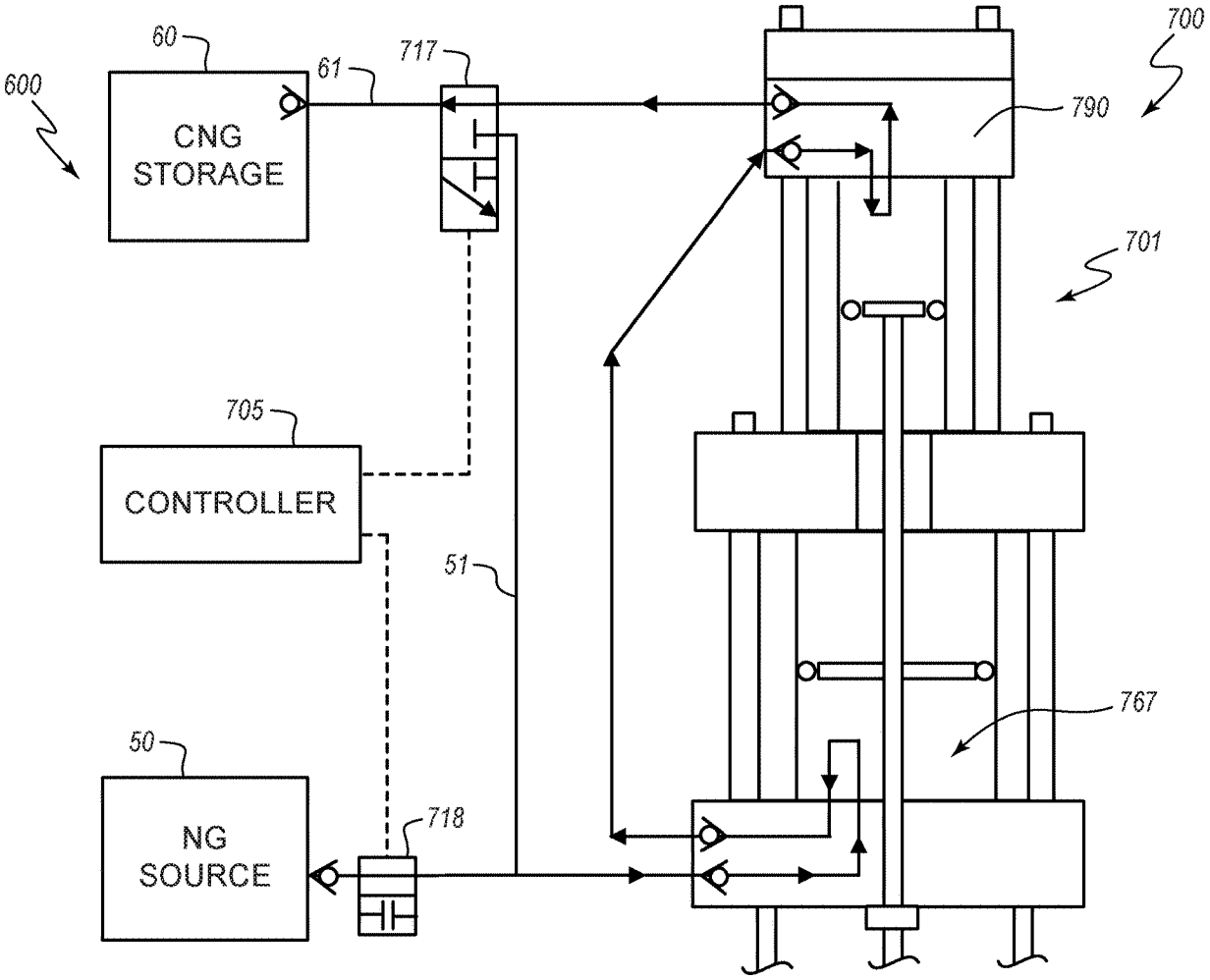
FIG. 9A is a schematic view of another embodiment of a natural gas compression system that includes a cross-sectional view of the gas compression assembly portion of the compressor assembly of FIG. 4, wherein the system is configured to bleed high pressure gas from a fill hose back into the gas compression assembly after a filling operation.

FIG. 9A represents normal operation of the system 700 for compressing gas. The valve 717 provides fluid communication between a second-stage head 790 and the storage tank 60 and prevents fluid communication between the storage tank 60 and the gas supply line 51. The valve 718 is open so as to permit gas to flow freely into the compressor 701. Thus, the compressor 701 can operate in a fashion such as described above with respect to other embodiments when the valves 717, 718 are in the orientations shown in FIG. 9A.

Figure 9B:
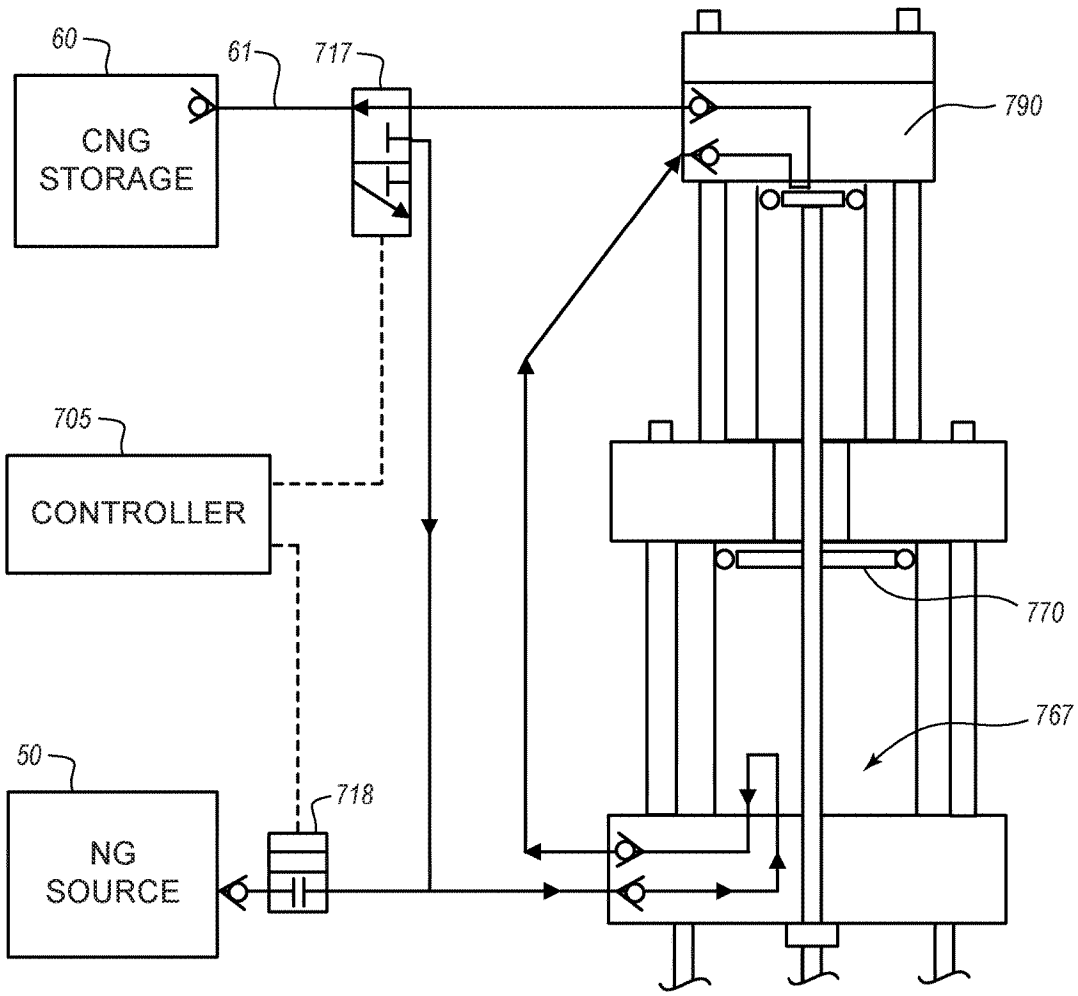
FIG. 9B is another view of the natural gas compression system of FIG. 9A at a later time than that depicted in FIG. 9A.

FIG. 9B represents an end of compressing operations in which it is desired to disconnect the fueling hose 61 of the fueling unit 60, but the high pressure in the compressor line prevents this from happening. Accordingly, FIG. 9B represents a point at which valve 718 is closed to allow depressurization of the high pressure gas line. In FIG. 9B, the valve 717 continues to provide fluid communication between the second-stage head 790 and the storage tank 60 and continues to prevent fluid communication between the storage tank 60 and the gas source 50. The valve 718 is closed. After closing the valve 718, the controller 705 can cause the compressor 701 to cycle through one, two, or three or more strokes to evacuate the first-stage chamber 767. The controller 705 can cause a piston 770 to end in an up position, as shown, to permit the first-stage chamber 767 to provide for a large volume into which the high pressure gas can bleed back.

Figure 9C:
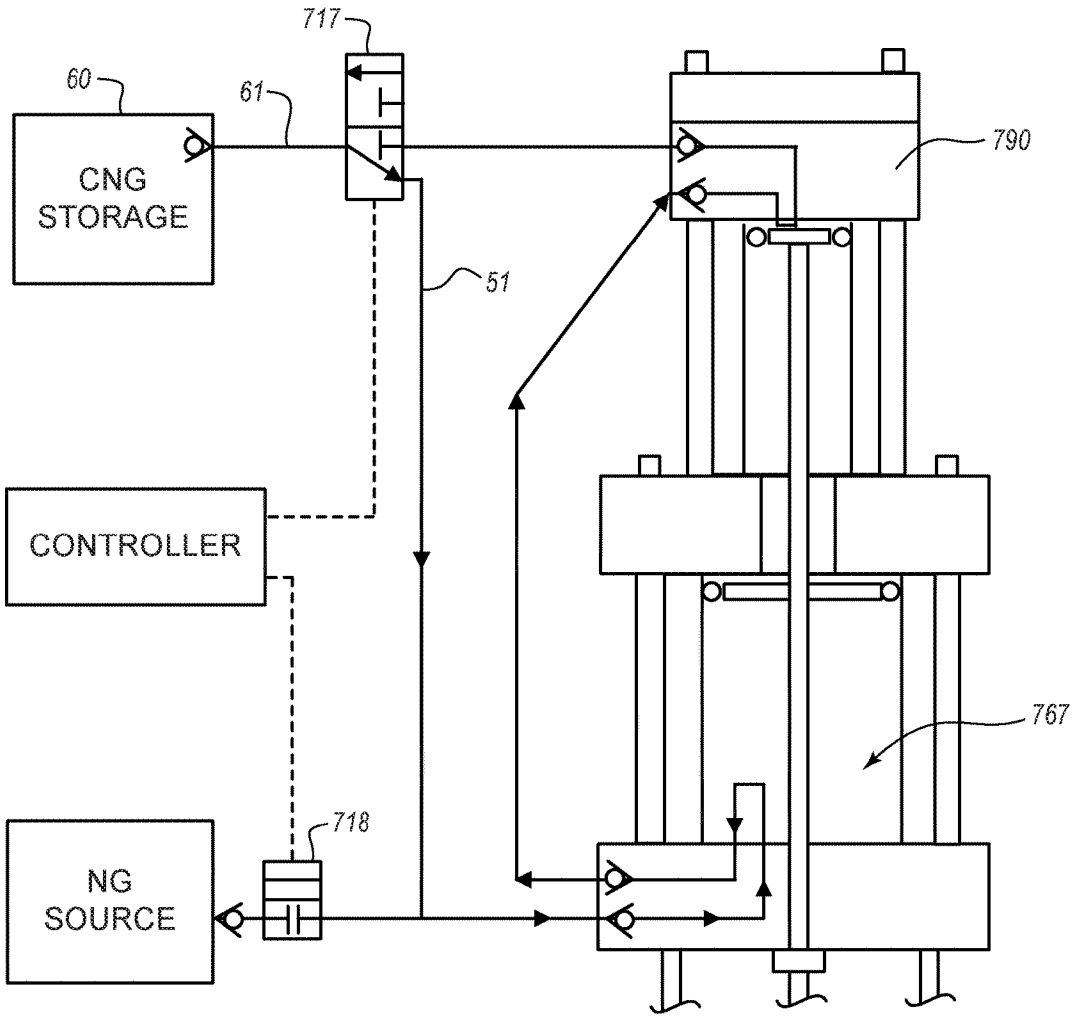
FIG. 9C is another view of the natural gas compression system of FIG. 9A at a later time than that depicted in FIG. 9B.

The depressurization state is shown in FIG. 9C. Here, the valve 717 prevents fluid communication between the second-stage head 790 and the storage tank 60 and now permits fluid communication between the storage tank 60 and the gas source line 51. The valve 718 remains closed. The high pressure gas can expand into the first-stage chamber 767, thereby reducing the pressure in the gas storage line to a point that the hose 61 or other connector can safely be disconnected.

Figure 9D:
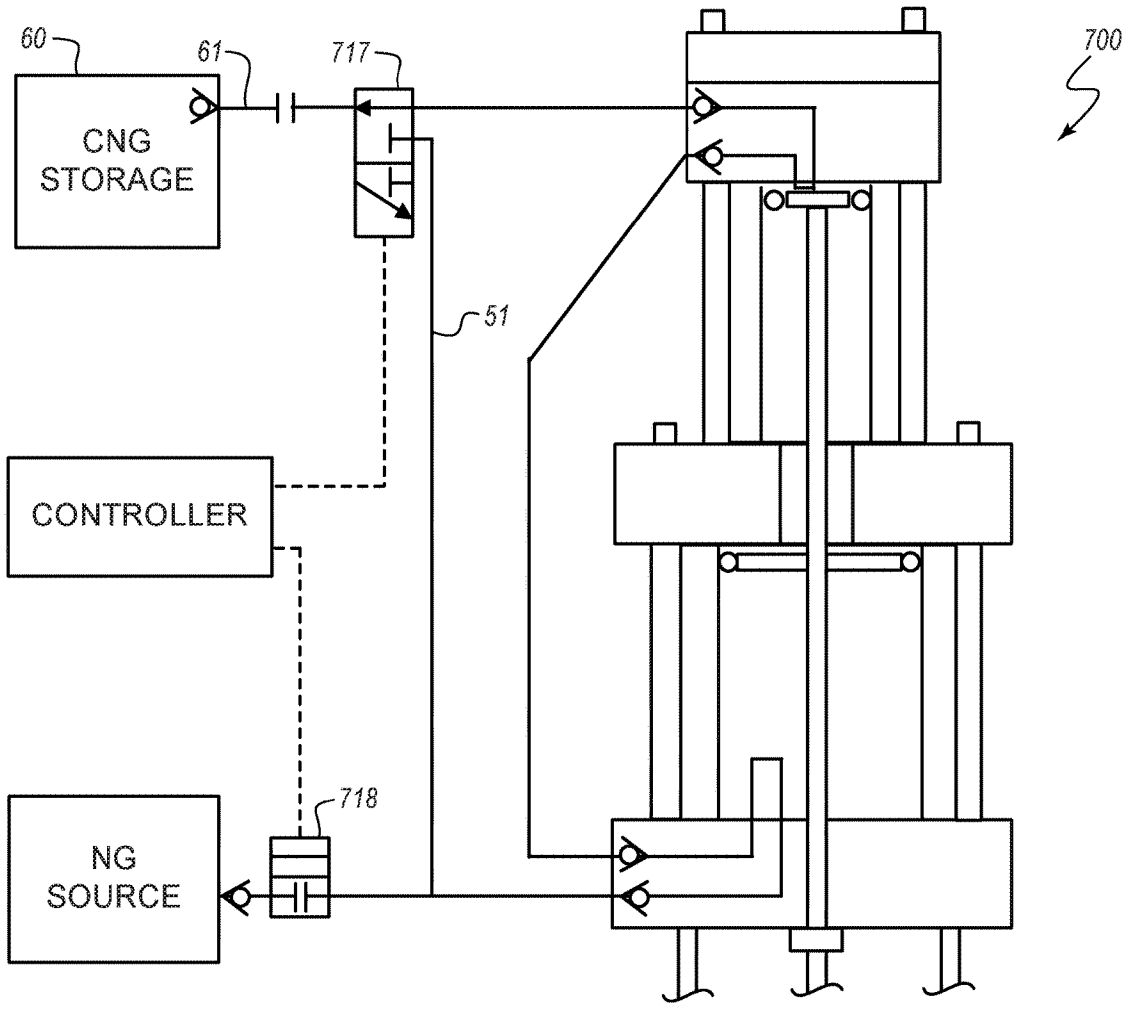
FIG. 9D is another view of the natural gas compression system of FIG. 9A at a later time than that depicted in FIG. 9C.

FIG. 9D shows that the valve 717 can again be moved to a position where fluid communication with the supply line 51 is cut off. The valve 718 can remain in a closed state. The hose 61 can be safely disconnected, and the system 700 can remain sealed until its next use.

FIGS. 10A-10D are schematic views of another embodiment of a natural gas compression system 800 similar to the system 700. Rather than employing a single three-way, two-position valve, the system 800 uses two two-way on/off valves 817*a*, 817*b*. The valves 817*a*, 817*b* can be controlled by a controller 805 to function similarly to the valve 717 discussed above. The valve 818 also functions similarly to the valve 718. Accordingly, FIGS. 10A-10D show the various positions of the valves 817*a*, 817*b*, 818 during the same operational states shown in the corresponding FIGS. 9A-9D.

Figure 10A:
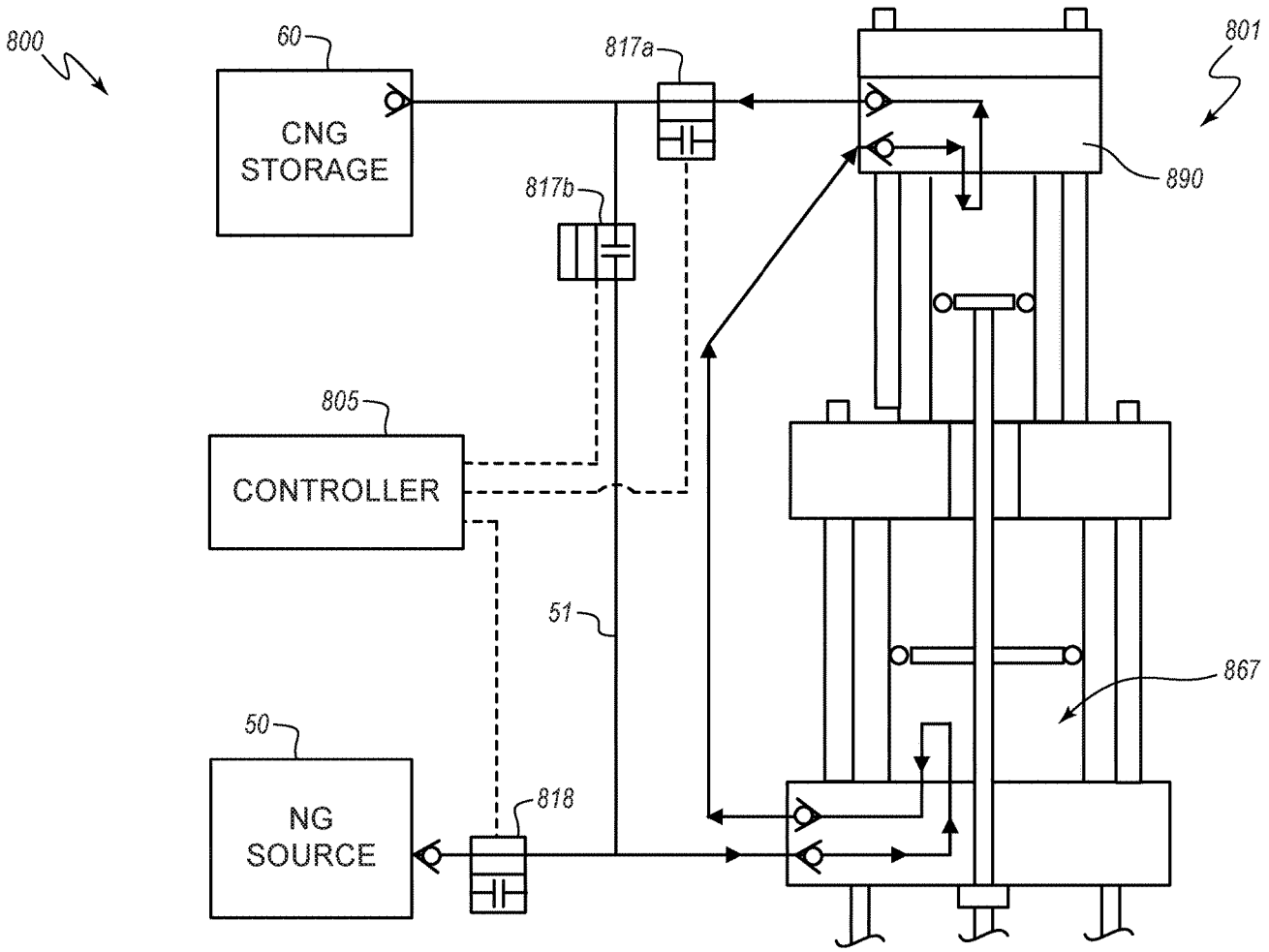
FIG. 10A is a schematic view of another embodiment of a natural gas compression system that includes a cross-sectional view of the gas compression assembly portion of the compressor assembly of FIG. 4, wherein the system is configured to bleed high pressure gas from a fill hose back into the gas compression assembly after a filling operation in a manner different from that of the system of FIG. 9A.

FIG. 10A represents normal operation of the system 800 for compressing gas. The valve 817*a* is open to provide fluid communication between a second-stage head 890 and the storage tank 60 and the valve 817*b* is closed to prevent fluid communication between the storage tank 60 and the gas supply line 51. The valve 818 is open so as to permit gas to flow freely into the compressor 801. Thus, the compressor 801 can operate in a fashion such as those described above with respect to, for example, FIGS. 3A-3D, when the valves 817*a*, 817*b*, 818 are in the illustrated orientations.

Figure 10B:
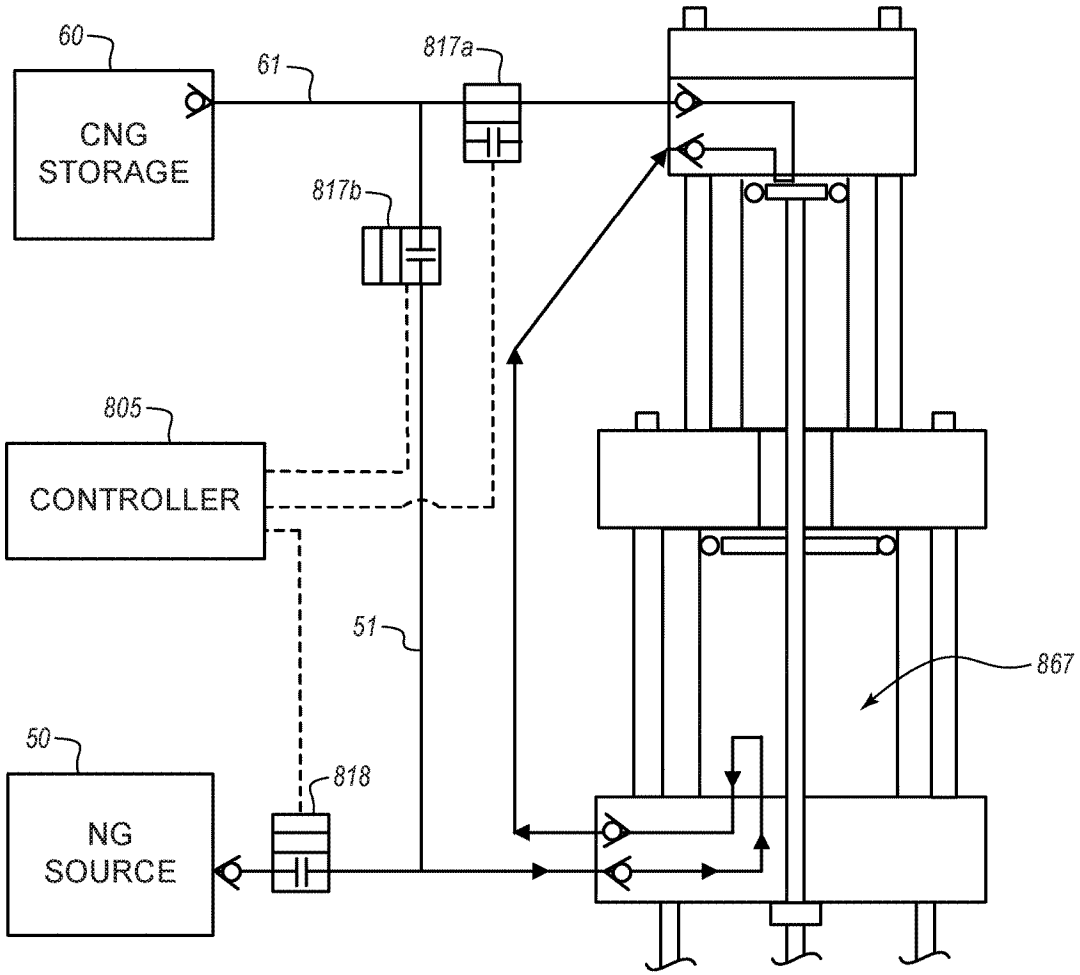
FIG. 10B is another view of the natural gas compression system of FIG. 10A at a later time than that depicted in FIG. 10A.

FIG. 10B represents an end of compressing operations in which it is desired to disconnect the fueling hose 61 of the fueling unit 60, but the high pressure in the compressor line prevents this from happening. Accordingly, FIG. 10B represents a point at which valve 818 is closed to allow depressurization of the high pressure gas line. In FIG. 10B, the valve 817*a* continues to provide fluid communication between the second-stage head 890 and the storage tank 60 and the valve 817*b* continues to prevent fluid communication between the storage tank 60 and the gas source 50. The valve 818 is closed. After closing the valve 818, the controller 805 can cause the compressor 801 to cycle through one, two, or three or more strokes to evacuate the first-stage chamber 867. The controller 805 can, in some instances, cause the piston to end in an up position, as shown, to provide for a large volume into which the high pressure gas can bleed back.

Figure 10C:
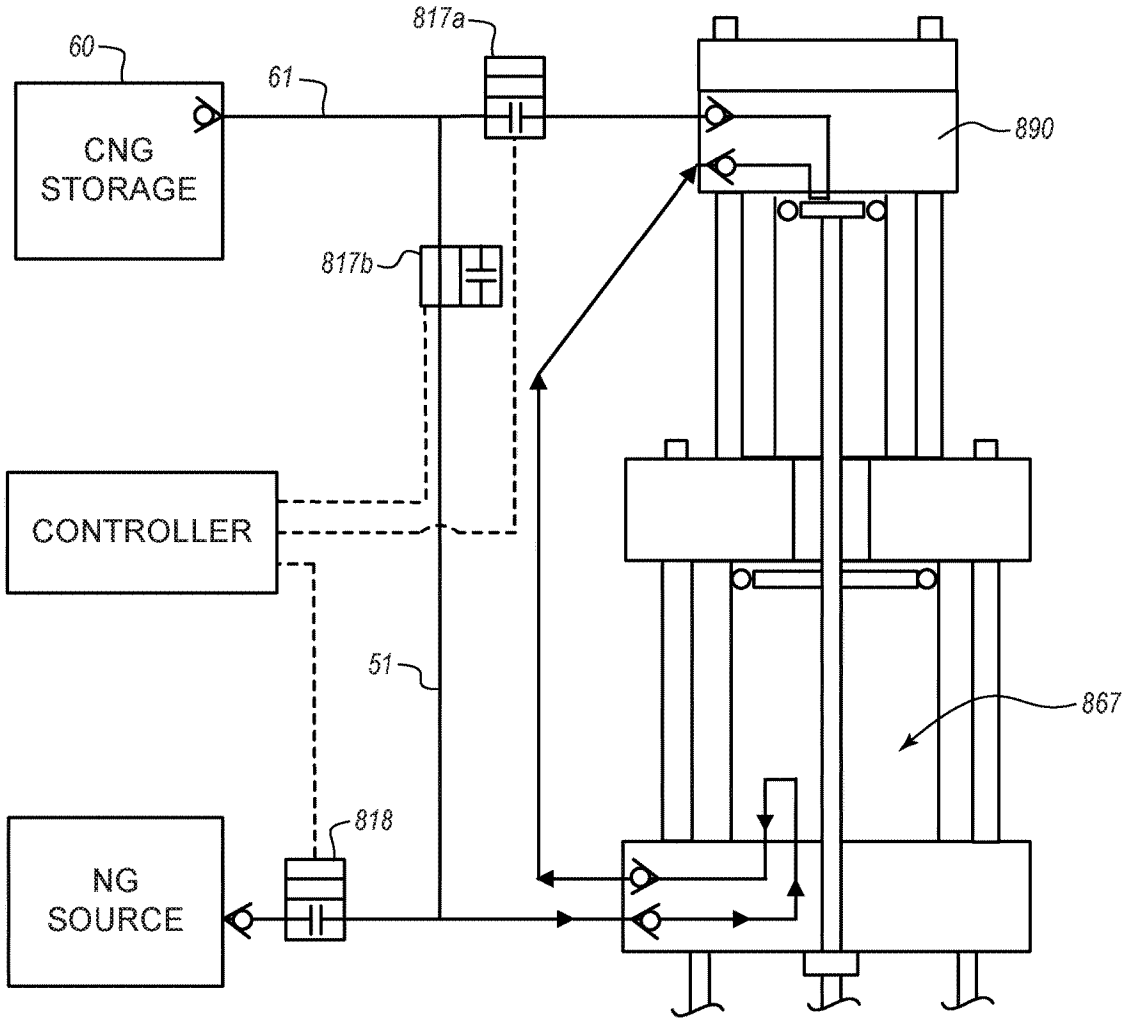
FIG. 10C is another view of the natural gas compression system of FIG. 10A at a later time than that depicted in FIG. 10B.

The depressurization state is shown in FIG. 10C. Here, the valve 817*a* prevents fluid communication between the second-stage head 890 and the storage tank 60 and the valve 817*b* now permits fluid communication between the storage tank 60 and the gas source line 51. The valve 818 remains closed. The high pressure gas can expand into the chamber 867, thereby reducing the pressure in the gas storage line to a point that the hose 61 or other connector can safely be disconnected.

Figure 10D:
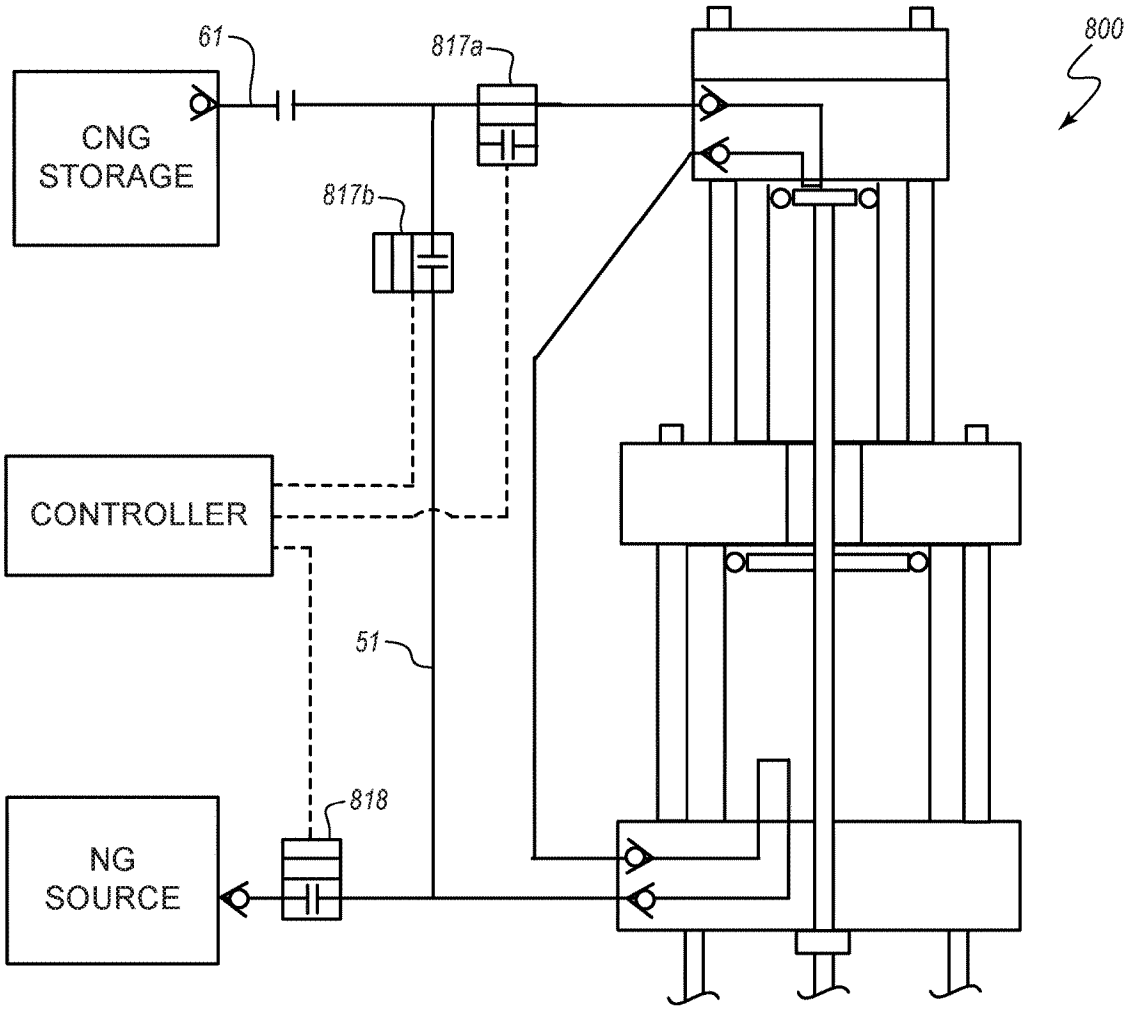
FIG. 10D is another view of the natural gas compression system of FIG. 10A at a later time than that depicted in FIG. 10C.

FIG. 10D shows that the valve 817*b* can again be moved to a position where fluid communication with the supply line 51 is cut off. The valve 818 can remain in a closed state. The hose 61 can be safely disconnected, and the system 800 can remain sealed until its next use. The valve 817*a* may optionally be moved to the open state shown in FIG. 10, or it may remain in the closed state until the compressor is used a subsequent time.

Figure 11A:
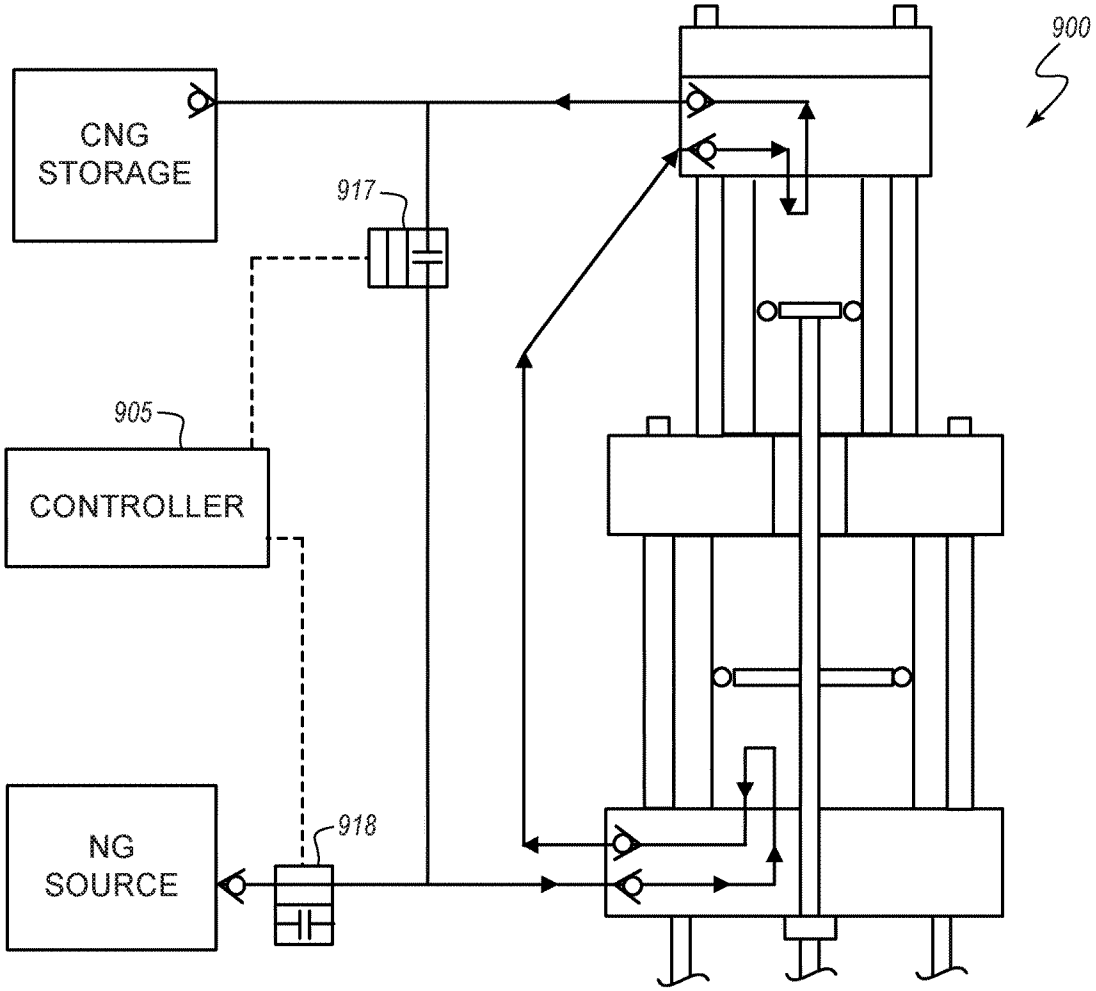
FIG. 11A is a schematic view of another embodiment of a natural gas compression system that includes a cross-sectional view of the gas compression assembly portion of the compressor assembly of FIG. 4, wherein the system is configured to bleed high pressure gas from a fill hose back into the gas compression assembly after a filling operation in a manner different from that of the systems of FIGS. 9A and 10A.
Figure 11B:
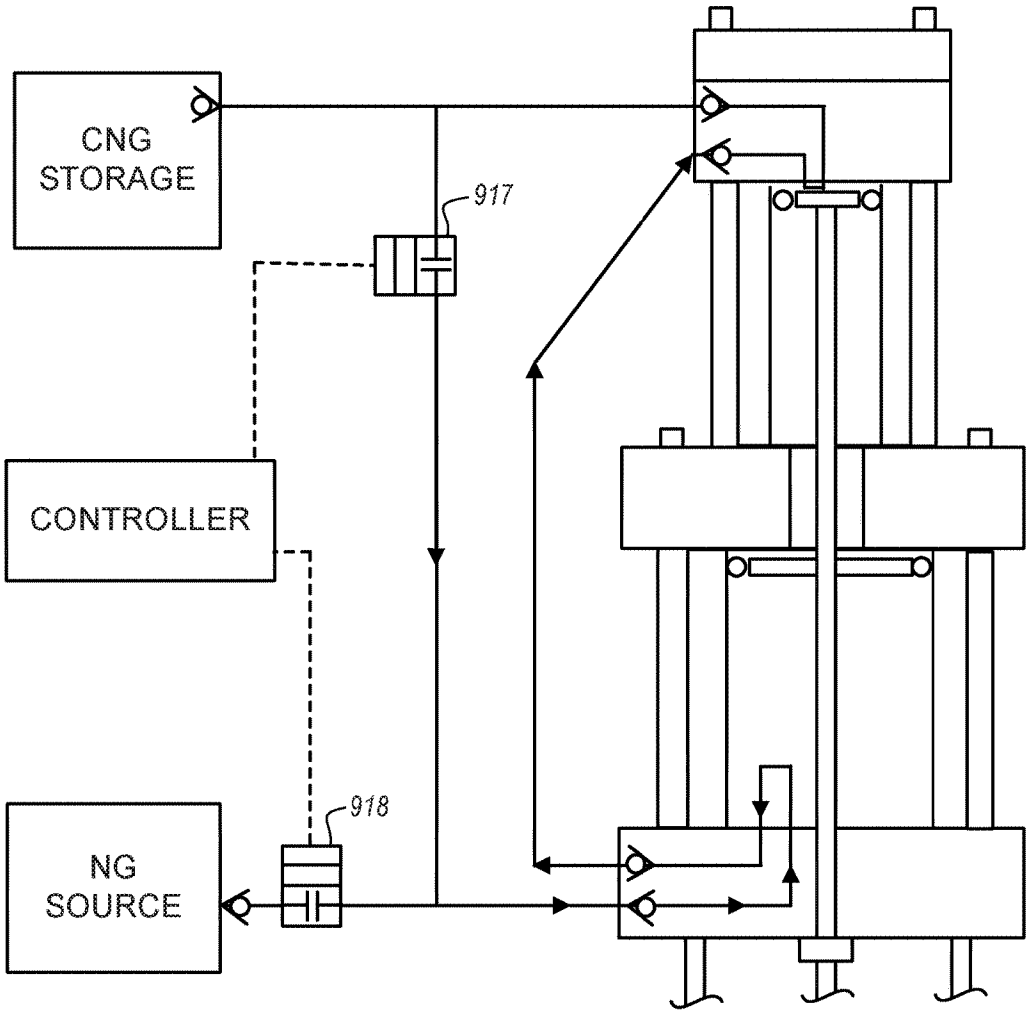
FIG. 11B is another view of the natural gas compression system of FIG. 11A at a later time than that depicted in FIG. 11A.
Figure 11C:
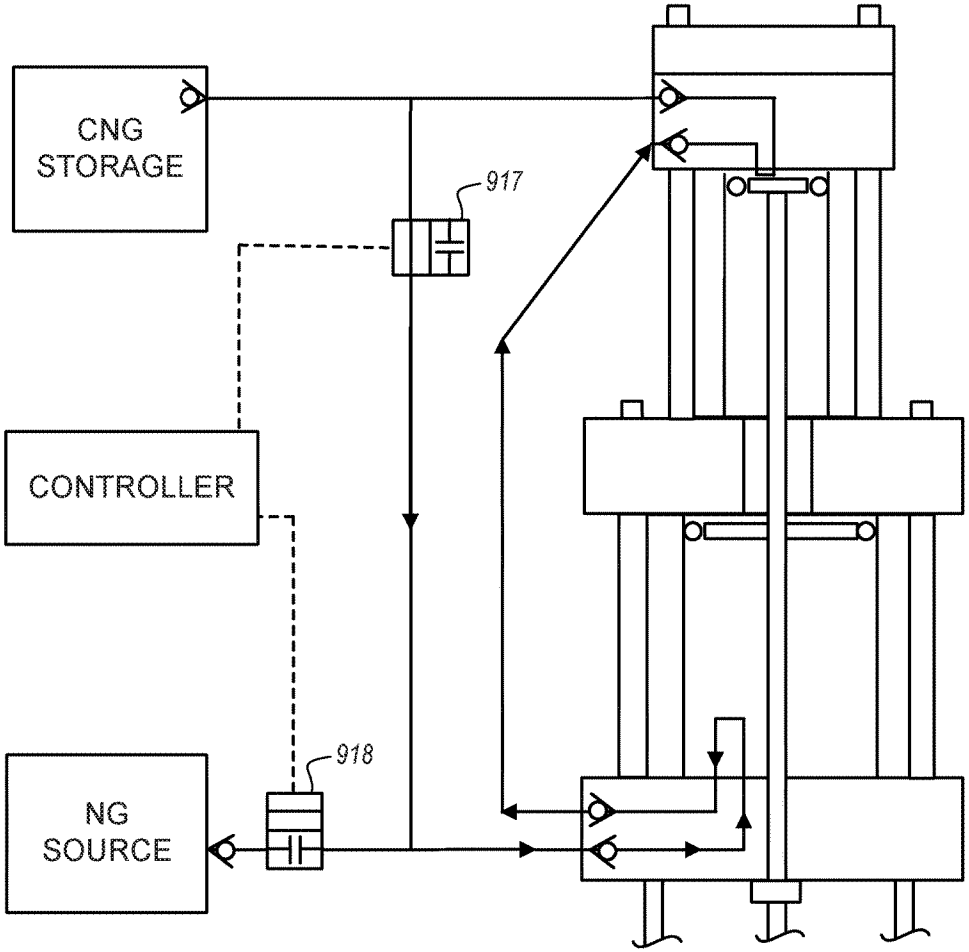
FIG. 11C is another view of the natural gas compression system of FIG. 11A at a later time than that depicted in FIG. 11B.
Figure 11D:
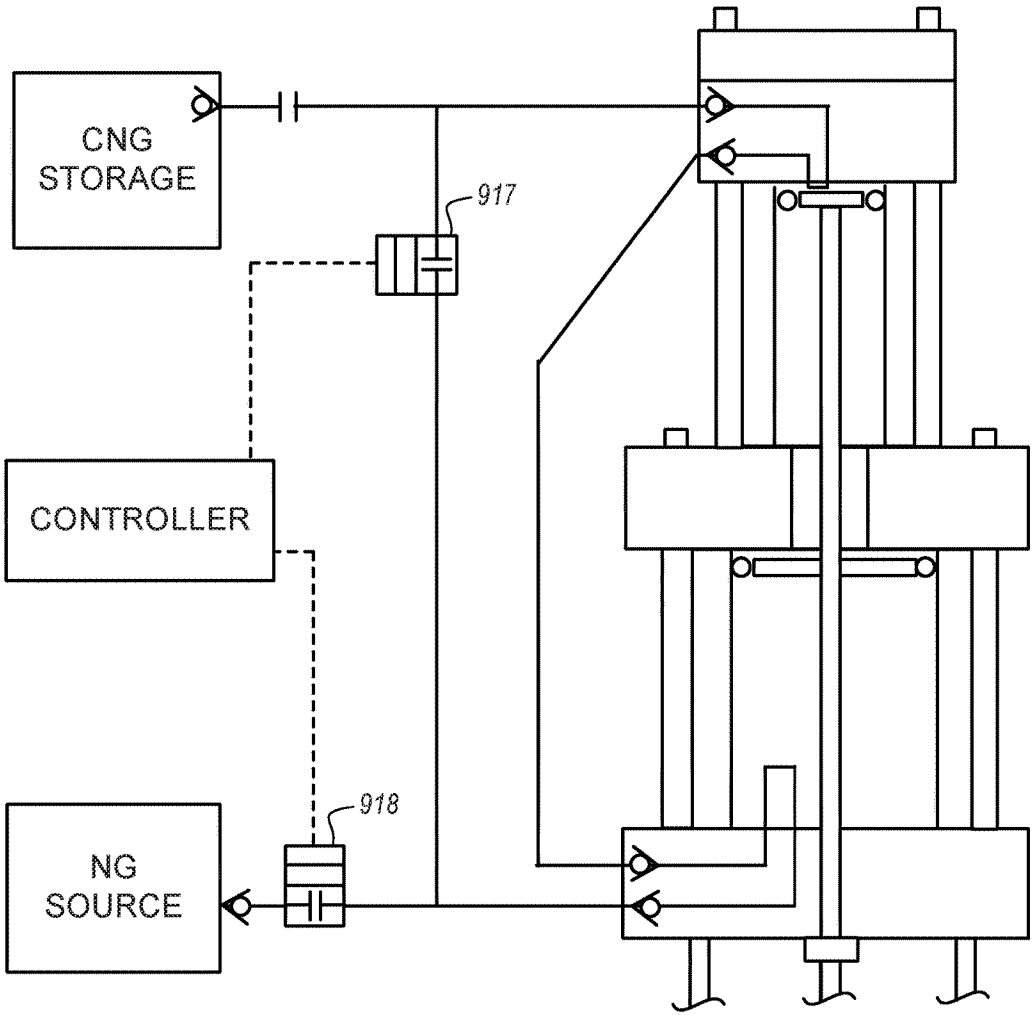
FIG. 11D is another view of the natural gas compression system of FIG. 11A at a later time than that depicted in FIG. 11C.

FIGS. 11A-11D are schematic views of another embodiment of a natural gas compression system 900 similar to the systems 700, 800. Rather than employing a single three-way, two-position valve, as in the system 700, or two two-way on/off valves, as in the system 800, the system 900 uses a single two-way on/off valve 917, in conjunction with a valve 918 that is similar to the valves 718, 818. The valves 917, 918 can be controlled by a controller 905 to function similarly to the valves 717, 718 and 817*a*, 817*b*, 818 discussed above. Accordingly, FIGS. 11A-11D show the various positions of the valves 917, 918 during the same operational states shown in the corresponding FIGS. 9A-9D and FIGS. 10A-10D. The valving sequence can be as follows: FIG. 11A, normal operation of compressor, valve 917 closed, valve 918 open; FIG. 11B, end of compression operations, valve 917 closed, valve 918 closed; FIG. 11C, depressurization configuration, valve 917 open, valve 918 closed; FIG. 11D, closing off of system until subsequent use, valve 917 closed, valve 918 closed.

Figure 12:
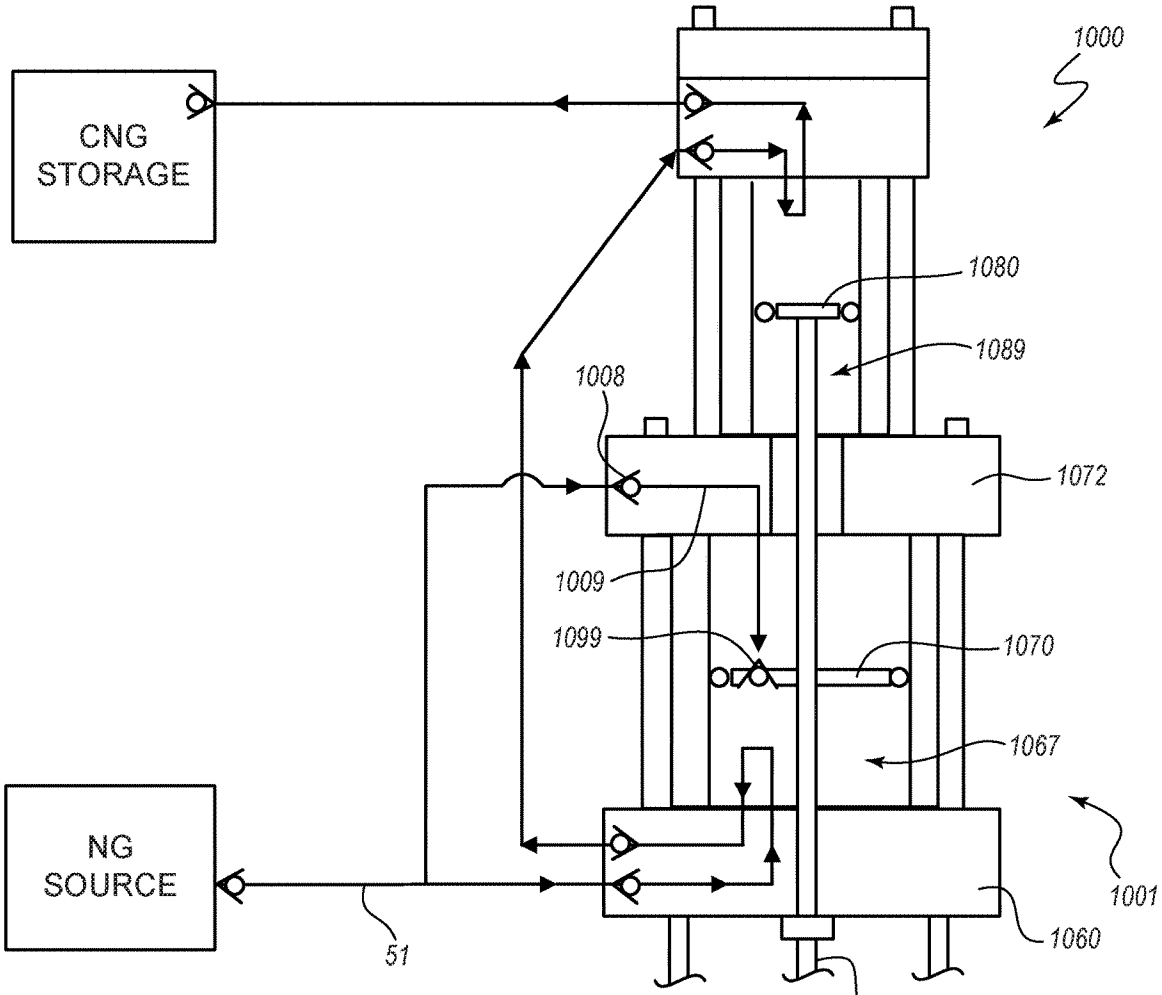
FIG. 12 is a schematic view of another embodiment of a natural gas compression system that includes a cross-sectional view of the gas compression assembly portion of another embodiment of a compressor assembly.

FIG. 12 is a schematic view of another embodiment of a natural gas compression system 1000 that includes a cross-sectional view of the gas compression assembly portion of another embodiment of a compressor 1001. The compressor 1001 can be configured to pre-stage gas from the source line to a somewhat compressed state. The compressor 1001 utilizes the intermediate chamber 1089 between the pistons 1070, 1080. Gas is compressed within the intermediate chamber 1089 as the shaft 1056 is moved upward. The compressed gas is permitted to pass through a one-way valve 1099 into the first-stage chamber 1067, where it is mixed with additional gas that enters the chamber 1067 directly from the supply line 51. In some embodiments, the one-way valve 1099 comprises a reed valve. The gas supply line 51 can be fluidly coupled with each of the intermediate head 1072 and the first-stage head 1060. The intermediate head 1072 can include a check valve 1008 and a fluid path 1009 through which the supply line gas enters into the chamber 1089.

The size and shape of the intermediate chamber 1089 can vary as the pistons 1070, 1080 reciprocate within their respective sleeves. As the pistons 1070, 1080 are forced upwardly, the pre-staging chamber 1089 becomes smaller, and thus the gas within it is compressed. As further discussed hereafter, in order to equalize this increased pressure, gas that has been compressed within the chamber 1089 can escape into the first-stage chamber 1067 through the one-way valve 1099. Moreover, the chamber 1089 can draw in gas from the supply line 51 when the pistons 1070, 1080 are forced downwardly as the size of the chamber 1089 expands. The chamber 1089 thus can be used for pre staging or pre-compressing a quantity of gas before it enters the first-stage chamber 1067. Such an arrangement can ensure that gas from the supply line 51 is introduced into the compressor 1001 substantially continuously, or during both the upward and downward strokes. This can increase efficiencies of the system 1000. For example, the system 100 can have a heightened time efficiency, as the system can compress a given quantity of gas quicker and/or with fewer strokes.

Figure 13B:
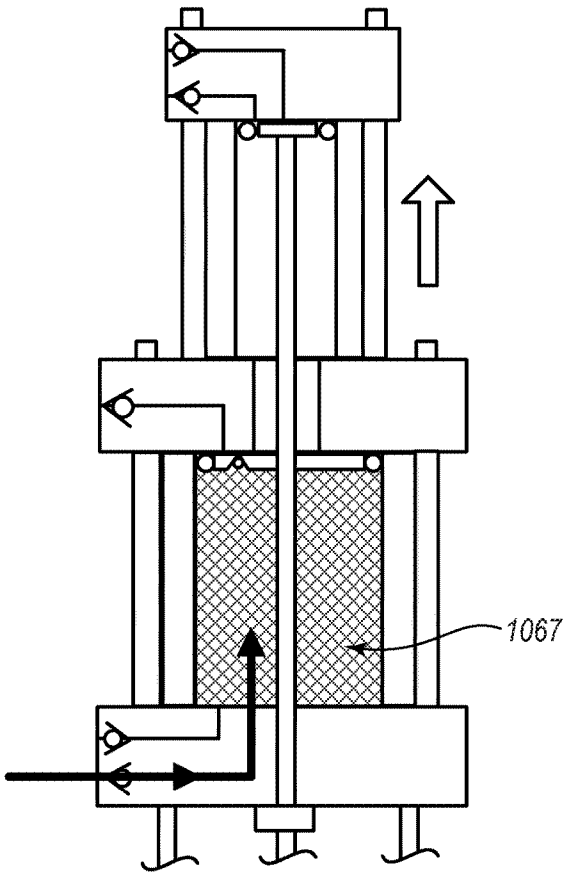
FIGS. 13A-13E are views of various sequential moments during operation of the gas compression assembly of FIG. 12.
Figure 13A:
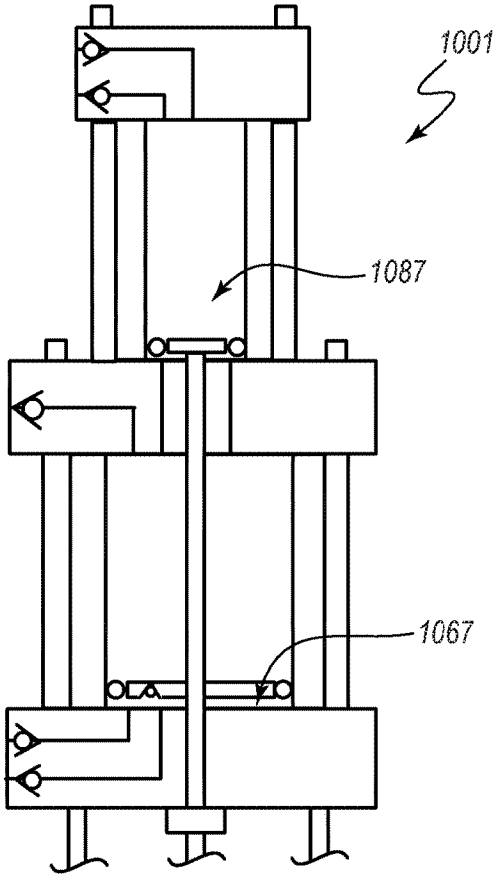

FIGS. 13A-13E depict different operational orientations of the compressor 1001. FIG. 13A shows the compressor 1001 in a first-ever use, which generally will be an uncommon state. Typically, the compressor 1001 will cycle through the orientations shown in FIGS. 13D and 13E. Different charges of gas are depicted with different shading. As can be seen, a charge of gas within the chamber 1089 typically does not completely empty into the chamber 1067. As shown in these drawings, the compressor 1001 is able to draw in gas from the supply line in both upward and downward strokes.

In FIG. 13A, both the first-stage chamber 1067 and the second-stage chamber 1087 are devoid of natural gas, although they may be charged with gas of some variety, such as air that may have been present when the compressor 1001 was first assembled.

In FIG. 13B, the lower piston is forced upwardly to expand a size of the first-stage chamber 1067. This expansion draws natural gas in from the supply line 51 to fill the first-stage chamber 1067.

Figure 13D:
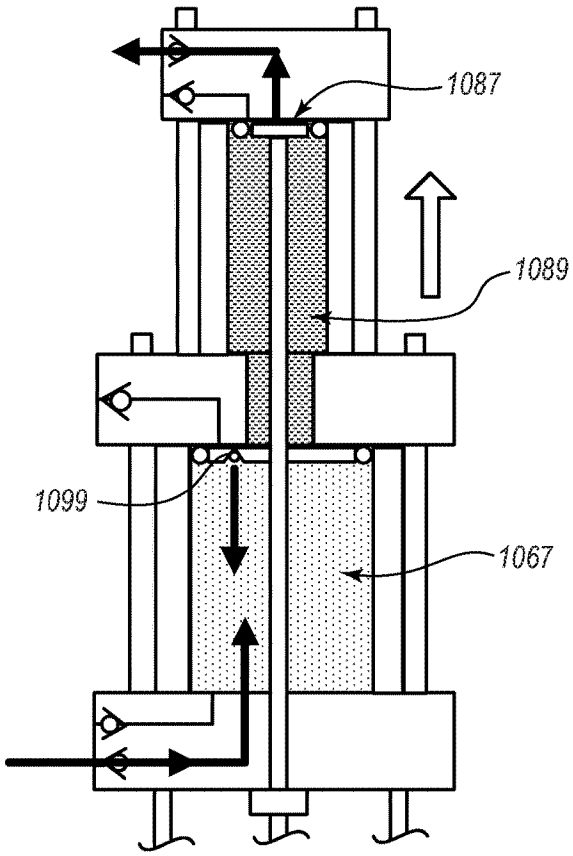
Figure 13C:
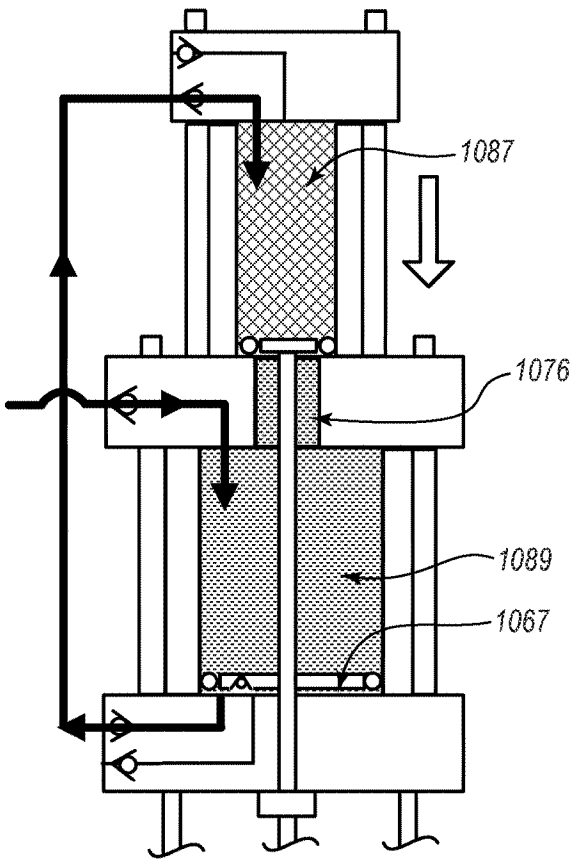

In FIG. 13C, the lower piston is forced downwardly to decrease the size of the first-stage chamber 1067. This compresses the gas in the first-stage chamber and urges it through the gas conduits through the upper head and into the second-stage chamber 1087. The upper piston is forced downwardly concurrently with the lower piston, as both pistons are joined to the same drive shaft. Expansion of the second-stage chamber 1087 in this manner also aids in drawing the compressed gas (e.g., gas that has been compressed by a first amount) from the first-stage chamber 1067 into the second-stage chamber 1087.

As can be appreciated by comparing FIG. 13B with FIG. 13C, the intermediate chamber 1089 (also referred to as a pre-staging chamber) can also expand as the pistons are forced downwardly. In particular, whereas the volume of the pre-staging chamber is roughly equal to the volume of the upper sleeve plus the volume of a bore 1076 through the intermediate head (given that the chamber is delimited at its upper and lower ends by the upper and lower pistons) when the compressor is in the configuration shown in FIG. 13B, the volume of the pre-staging chamber is roughly equal to the volume of the lower sleeve plus the volume of the bore 1076 through the intermediate head when the compressor is in the configuration shown in FIG. 13C. This expansion can draw additional gas from the supply line 51 into the intermediate chamber 1089.

In FIG. 13D, the pistons are again forced upwardly, which compresses the charge of gas that was in the second-stage chamber 1087. This compressed gas can be expelled from the second-stage chamber 1087 to the storage unit. The expansion of the first-stage chamber 1067 draws another charge of gas from the supply line 51. Further, the expansion of the first-stage chamber 1067 and the compression of the intermediate chamber 1089 (as it returns to its smaller volume) can cause gas to exit the intermediate chamber 1089 through the one-way valve 1099 to transition into the first-stage chamber 1067. This charge of gas in the first-stage chamber 1067, as illustrated in FIG. 13D, may be at a higher pressure than the charge of gas shown in the "initial charging event" of FIG. 13B, due to the additional gas from the pre-staging chamber 1089, which is also pressurized when it enters the first-stage chamber 1067.

Figure 13E:
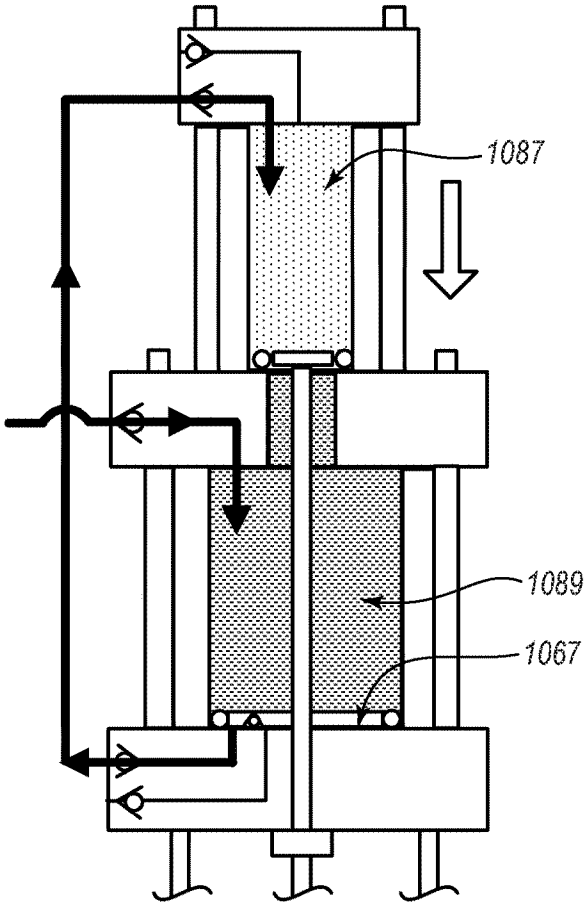

In FIG. 13E, compressed gas from the first-stage chamber 1067 is delivered to the second-stage chamber 1087 and additional gas is drawn into the pre-staging chamber 1089 from the supply line 51. After an "initial charge," the compressor can cycle between the configurations of FIGS. 13D and 13E.

Figure 14A:
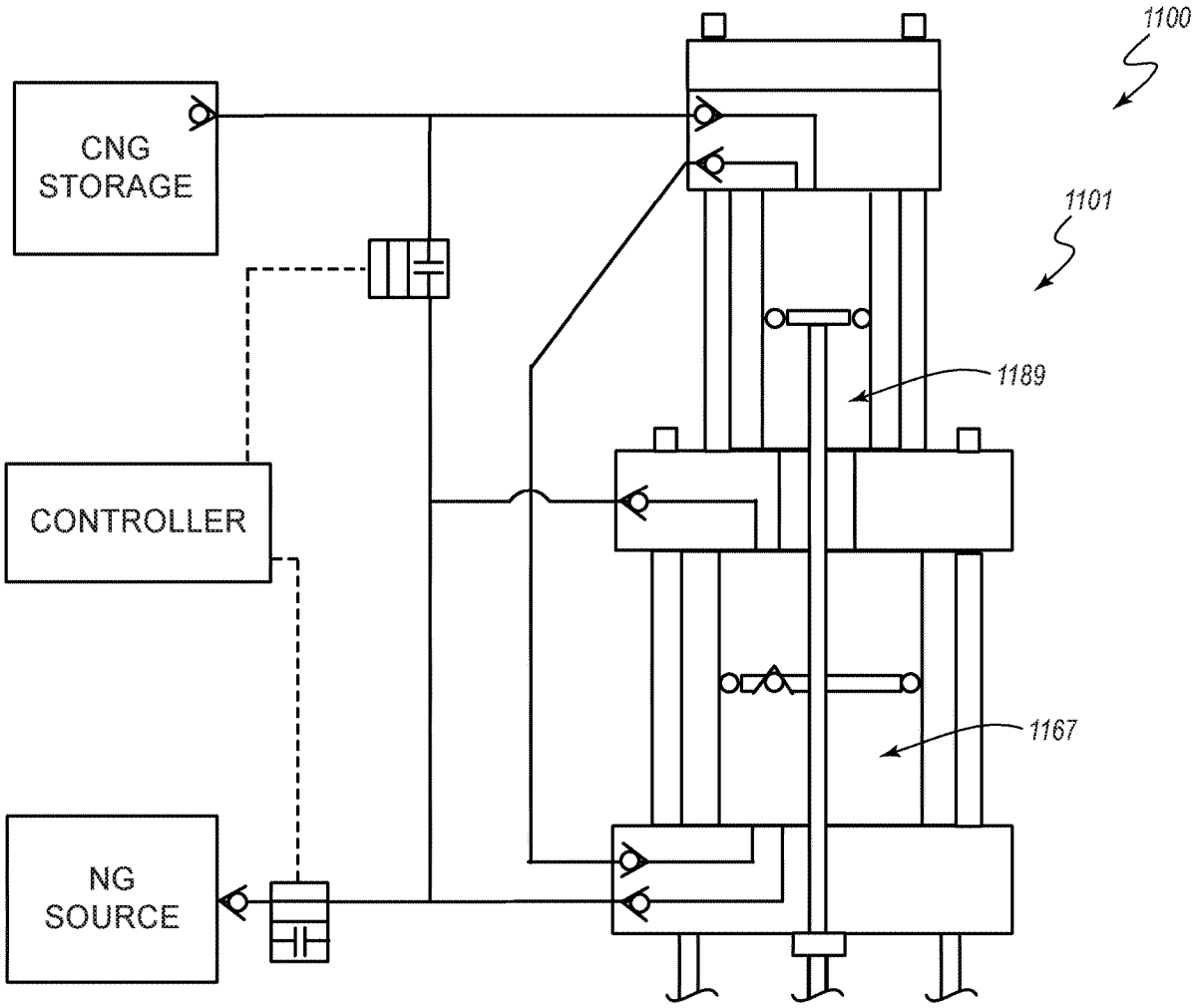
FIG. 14A is a schematic view of another embodiment of a natural gas compression system that includes a cross-sectional view of the gas compression assembly portion of the compressor assembly of FIG. 12, wherein the system is configured to bleed high pressure gas from a fill hose back into the gas compression assembly after a filling operation.
Figure 14B:
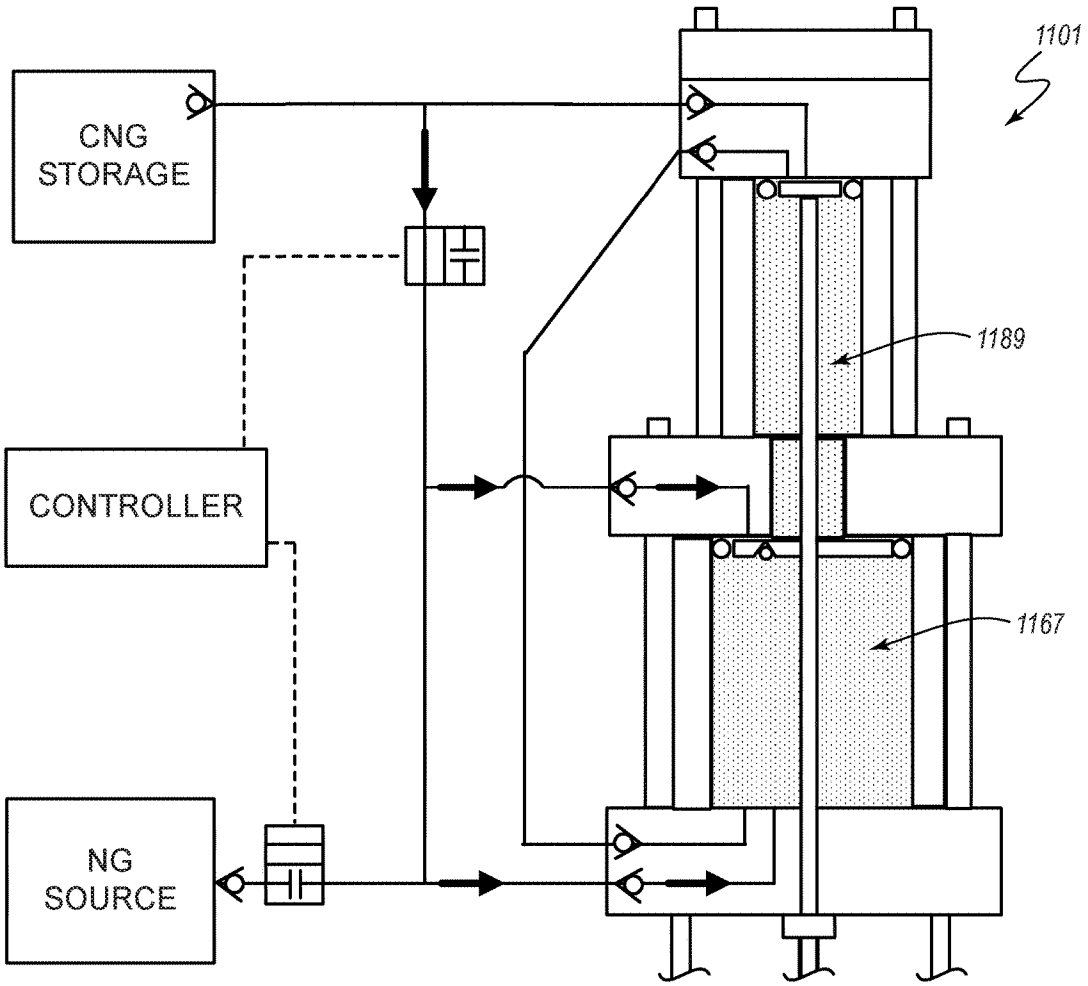
FIG. 14B is another view of the natural gas compression system of FIG. 14A at a later time than that depicted in FIG. 14A.

FIGS. 14A and 14B depict another embodiment of a gas compression system 1100, which combines the features of the systems 900 and 1000. FIG. 14A is similar to FIG. 11A, as it depicts a compressor 1101 during normal operations to compress gas received from the source. FIG. 14B is similar to FIG. 11C, as it depicts that high pressure gas can flow from the high pressure conduit back into the compressor 1101. Due to the greater space that is available, since both the first-stage chamber 1167 and the pre-staging chamber 1189 are available, a lower pressure may be achieved at this step. The depressurized (or reduced-pressure) gas that has been "bleed back" into the compressor 1101 is shown in both of the chambers 1167, 1189 in FIG. 14B. For embodiments that permit back flow of the high pressure gases into the compressor 1101, the system can reduce space and/or cost, given that a separate depressurizing chamber can be omitted from the system.

Figure 15:
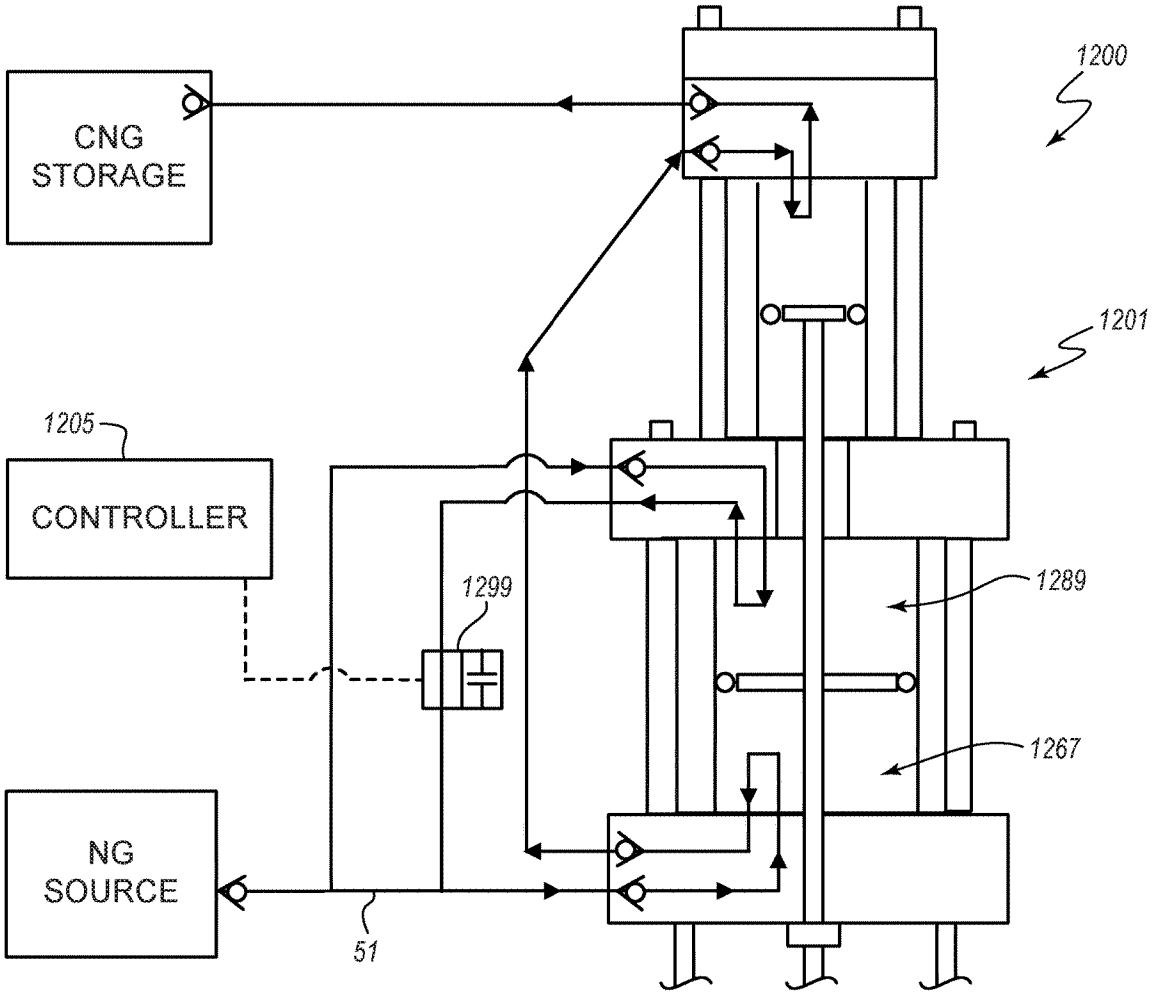
FIG. 15 is a schematic view of another embodiment of a natural gas compression system that includes a cross-sectional view of the gas compression assembly portion of an embodiment of a compressor assembly such as that depicted in FIG. 4.

FIG. 15 is a schematic view of another embodiment of a natural gas compression system 1200 that includes a gas compression assembly, or compressor 1201, that is configured to selectively transport gas from the pre-staging chamber 1289 to the first-stage chamber 1267 after the gas has been pressurized. This is accomplished by a controller 1205 that operates an on/off valve 1299 at an appropriate or desired time. Such operations can increase the efficiency of the system 1200.

Figure 16A:
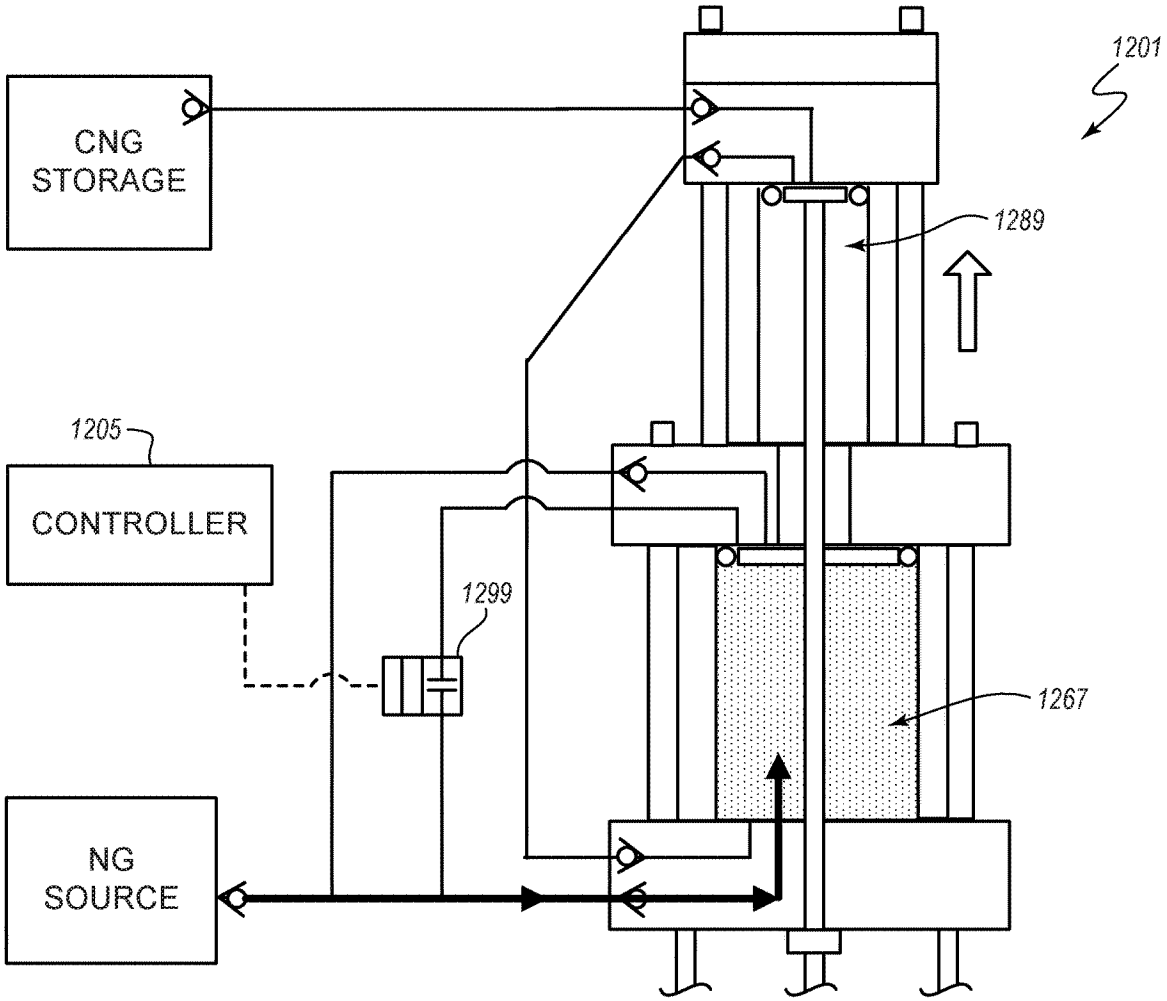
FIGS. 16A-16F are views of various sequential moments during operation of the gas compression assembly of FIG. 15.

FIGS. 16A-16F are views of various sequential moments during operation of the gas compression assembly 1201. FIG. 16A shows the compressor 1201 in a first-ever use, which generally will be an uncommon state. Typically, the compressor 1201 will cycle through the orientations shown in FIGS. 16C-16F. Different charges of gas are depicted with different shading. As can be seen, a charge of gas within the intermediate chamber 1289 typically does not completely empty into the first-stage chamber 1267. As shown in these drawings, the compressor 1201 is able to draw in gas from the supply line 51 in both upward and downward strokes.

In FIG. 16A, the lower piston is forced upwardly to expand a size of the first-stage chamber 1267. This expansion draws natural gas in from the supply line 51 to fill the first-stage chamber 1267. The two-way on/off valve 1299 is closed at this point, preventing fluid communication between the first-stage chamber 1267 and the intermediate chamber 1289.

Figure 16B:
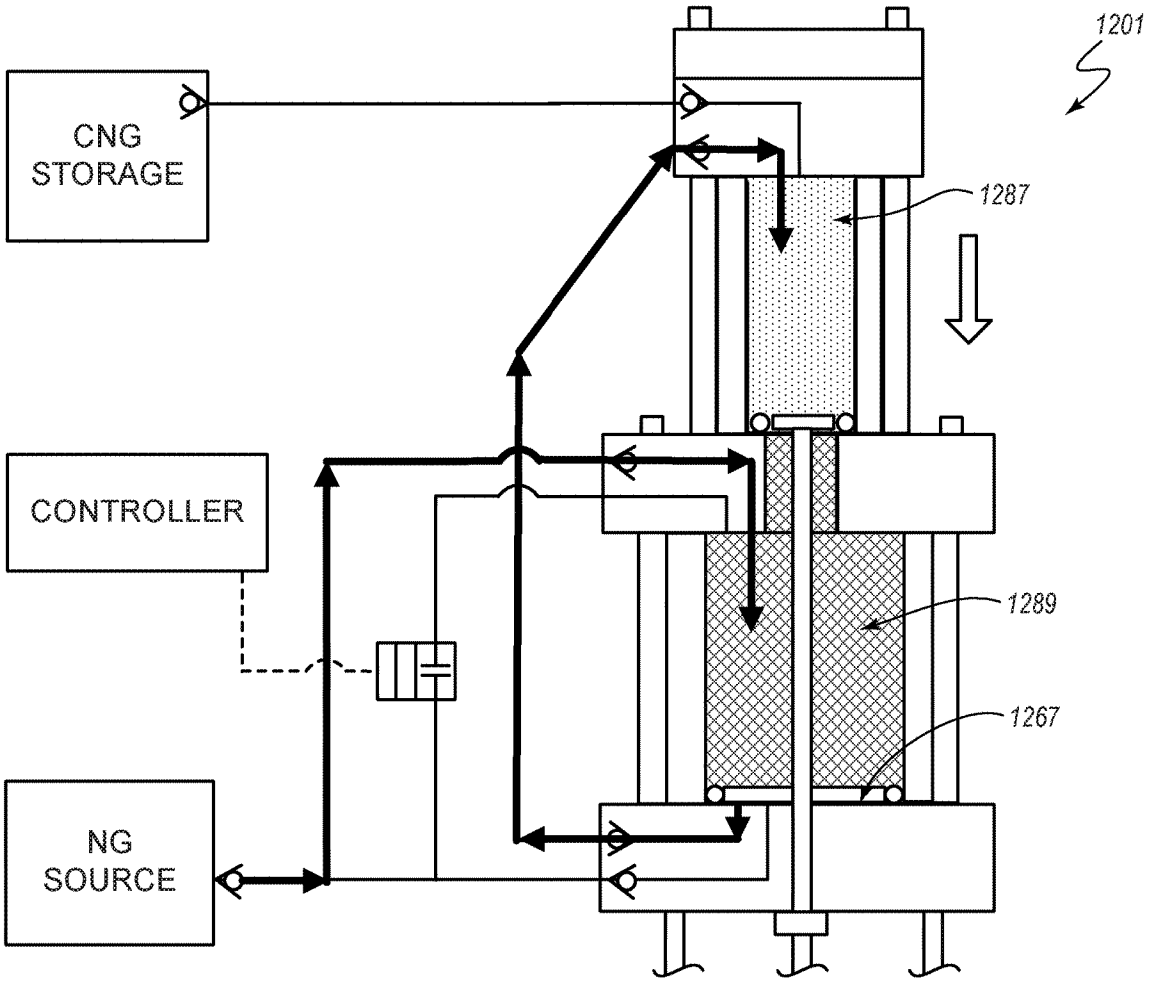

In FIG. 16B, the valve 1299 remains closed. The lower piston is forced downwardly to decrease the size of the first-stage chamber 1267. This compresses the gas in the first-stage chamber 1267 and urges it through the gas conduits through the upper head and into a second-stage chamber 1287. The upper piston is forced downwardly concurrently with the lower piston, as both pistons are joined to the same drive shaft. Expansion of the second-stage chamber 1287 in this manner also aids in drawing the compressed gas (e.g., gas that has been compressed by a first amount) from the first-stage chamber 1267 into the second-stage chamber 1287.

Moreover, the intermediate chamber 1289 (also referred to as a pre-staging chamber) also expands as the pistons are forced downwardly. In particular, whereas the volume of the pre-staging chamber is roughly equal to the volume of the upper sleeve plus the volume of a bore through the intermediate head (given that the chamber is delimited at its upper and lower ends by the upper and lower pistons) when the compressor 1201 is in the configuration shown in FIG. 16A, the volume of the pre-staging chamber is roughly equal to the volume of the lower sleeve plus the volume of the bore through the intermediate head when the compressor is in the configuration shown in FIG. 16B. This expansion can draw additional gas from the supply line 51 into the intermediate chamber.

In FIG. 16C, the pistons are again forced upwardly, which compresses the charge of gas that was in the second-stage chamber 1287. This compressed gas can be expelled from the second-stage chamber 1287 to the storage unit. The expansion of the first-stage chamber 1267 draws another charge of gas from the supply line 51. The upward movement of the pistons compresses the gas that is in the intermediate chamber 1289 as it is forced into a smaller volume.

Figure 16C:
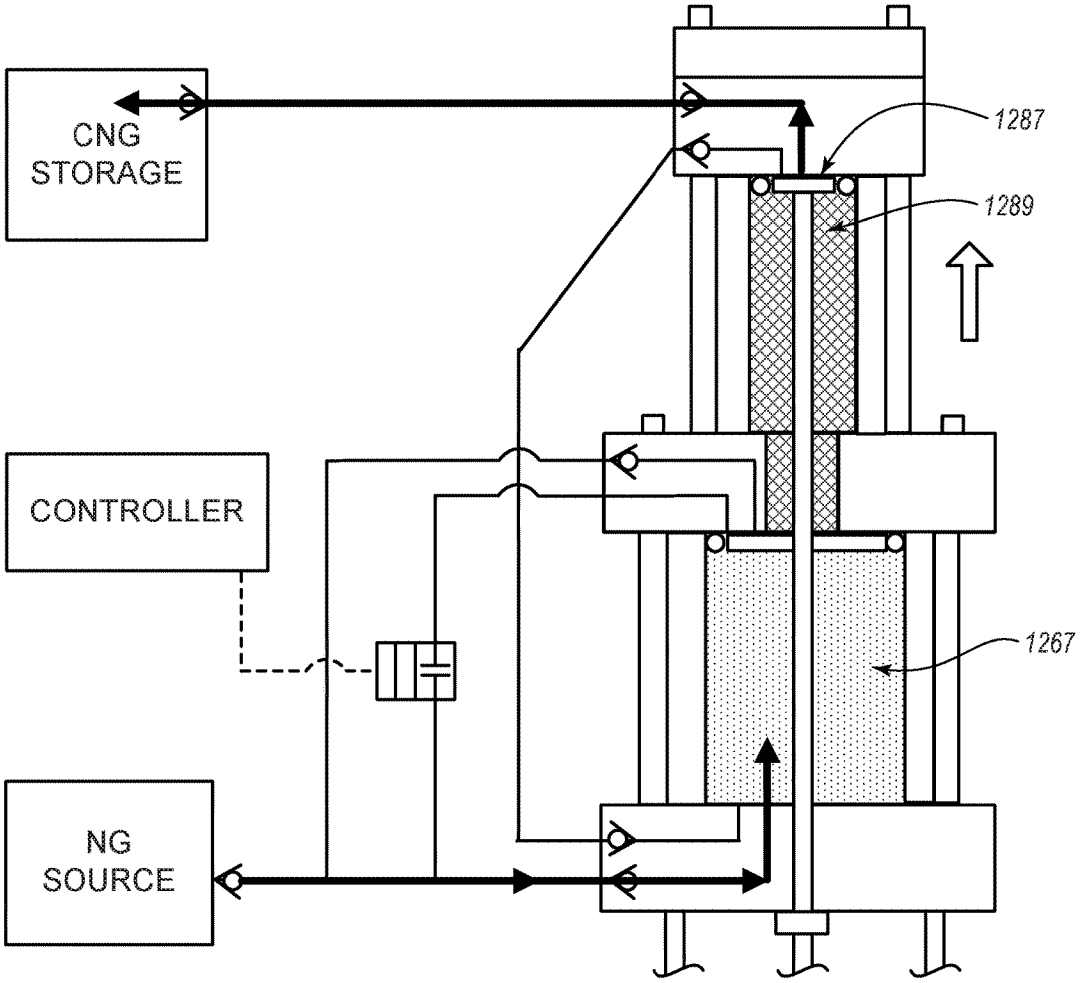
Figure 16D:
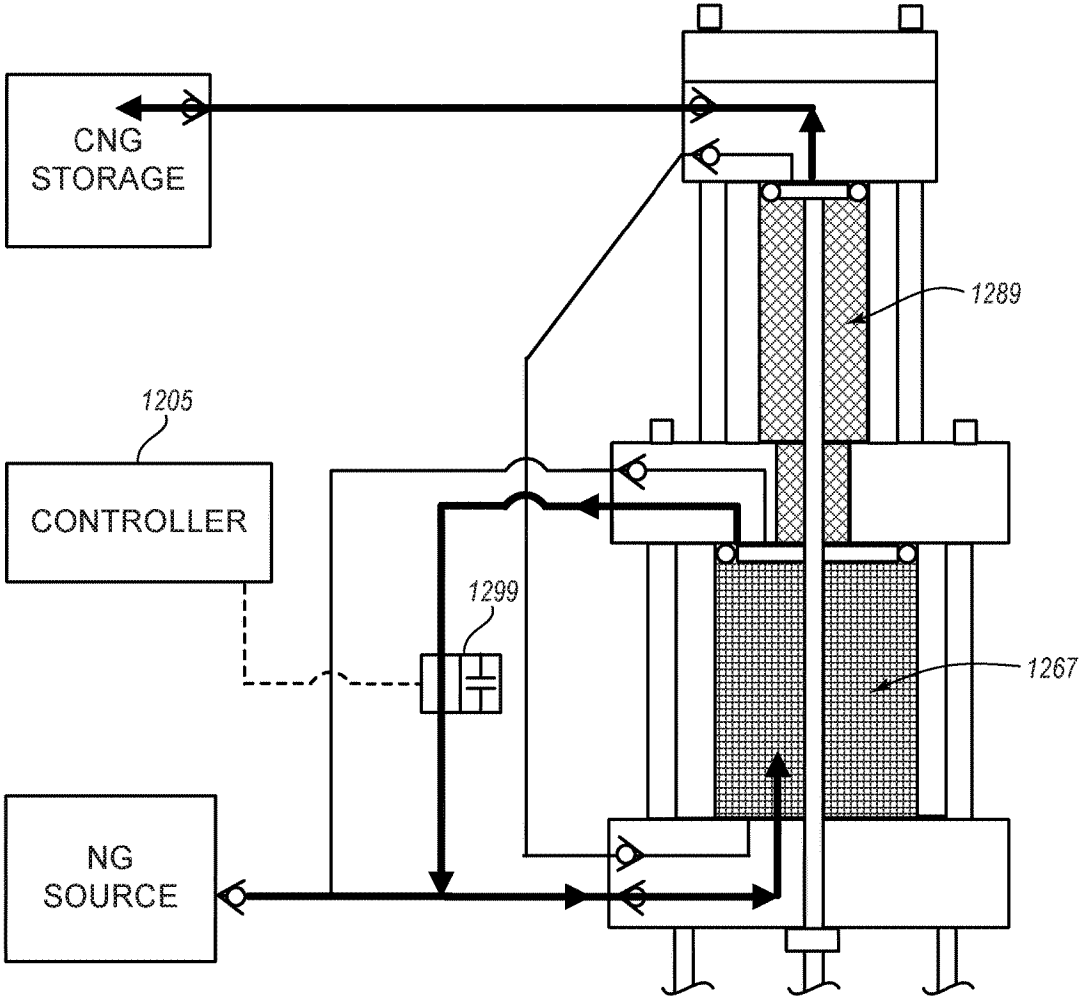

In FIG. 16D, just after the gas in the intermediate chamber 1289 has been compressed in the manner shown in FIG. 16C, or at any other suitable time as may be programmed or pre-selected, the valve 1299 is opened. This allows compressed gas from intermediate stage chamber 1289 to flow into the lower-pressure first-stage chamber 1267.

Figure 16E:
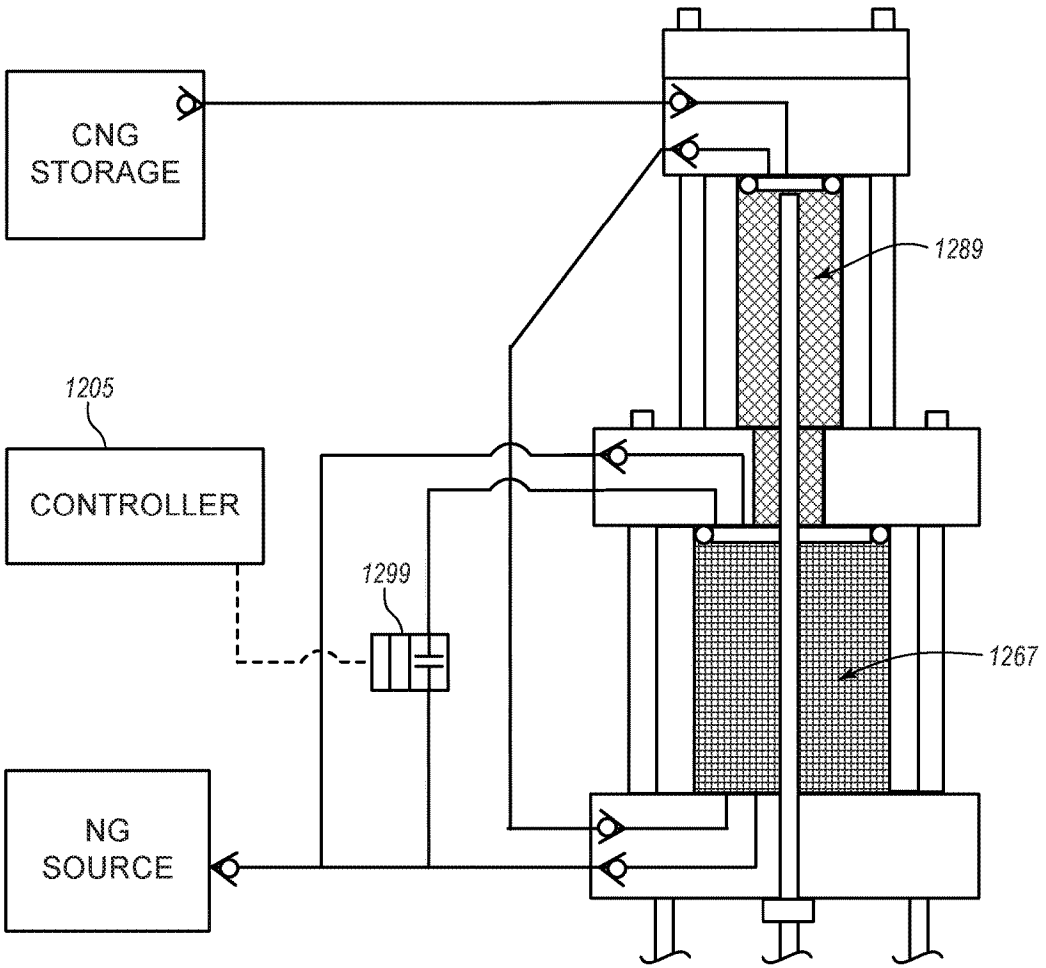

As shown in FIG. 16E, after a portion of the gas that was compressed by a first amount has transitioned into the first-stage chamber 1267, the valve 1299 can be transitioned back to the closed state by the controller 1205. In the sequence illustrated in FIGS. 16C-16D, the pistons do not move, or move only a small amount, during the time that the valve 1299 briefly opens and then closes again. In other arrangements, the pistons may move more than is shown in this sequence of drawings during the time that gas is permitted to transfer from the intermediate chamber 1289 to the first-stage chamber 1267. However, in some embodiments, it may be desirable to close the valve 1299 before the pistons have moved downwardly by an amount that would significantly reduce the pressure in the intermediate chamber 1289 (e.g., due to an increased size of the intermediate chamber).

Figure 16F:
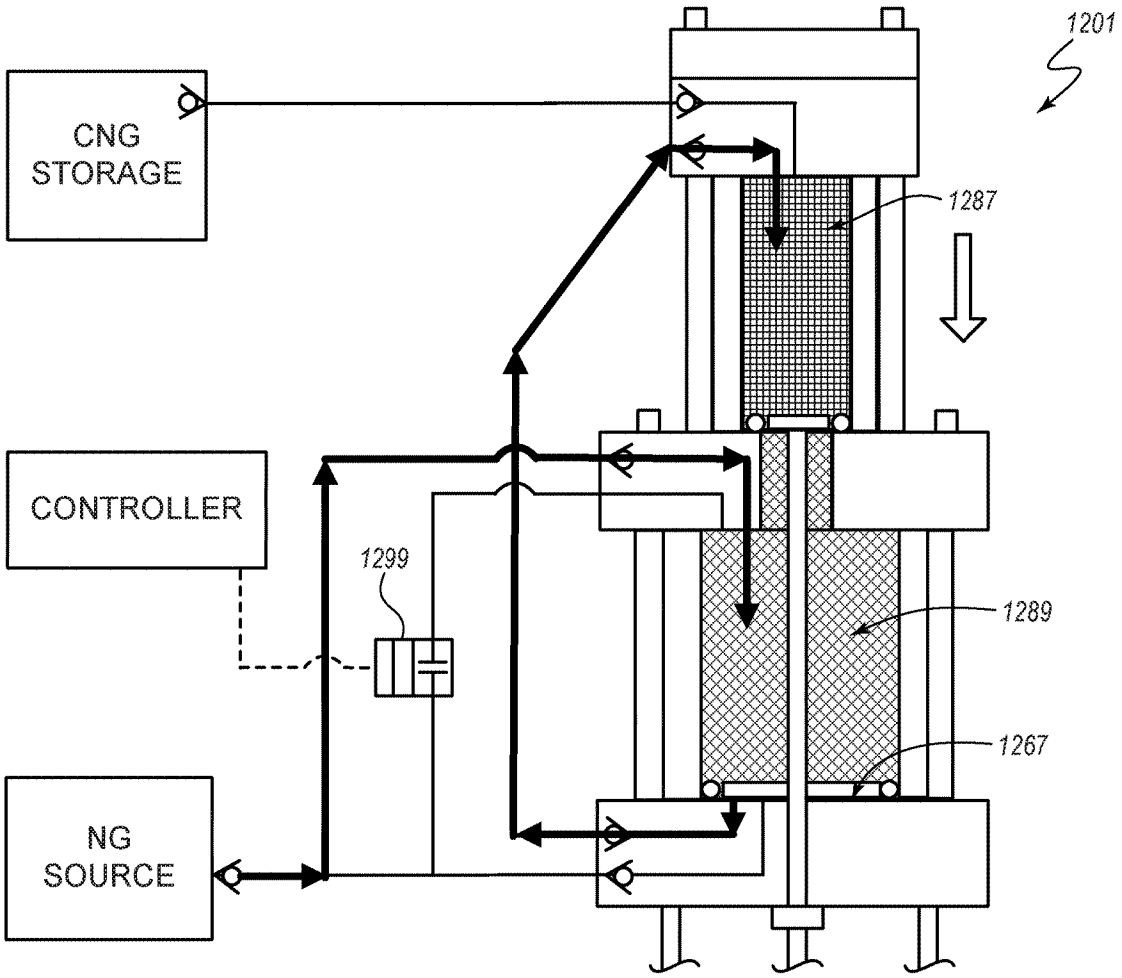

As shown in FIG. 16F, the pistons can be forced downwardly to compress the gas in the lower first-stage chamber 1267 and empty the first-stage chamber 1267, to fill the second-stage chamber 1287, and to introduce additional gas into the intermediate pre-staging chamber 1289. In certain embodiments, the valve 1299 can be switched open and closed once for every cycle of the compressor 1201.

Figure 17:
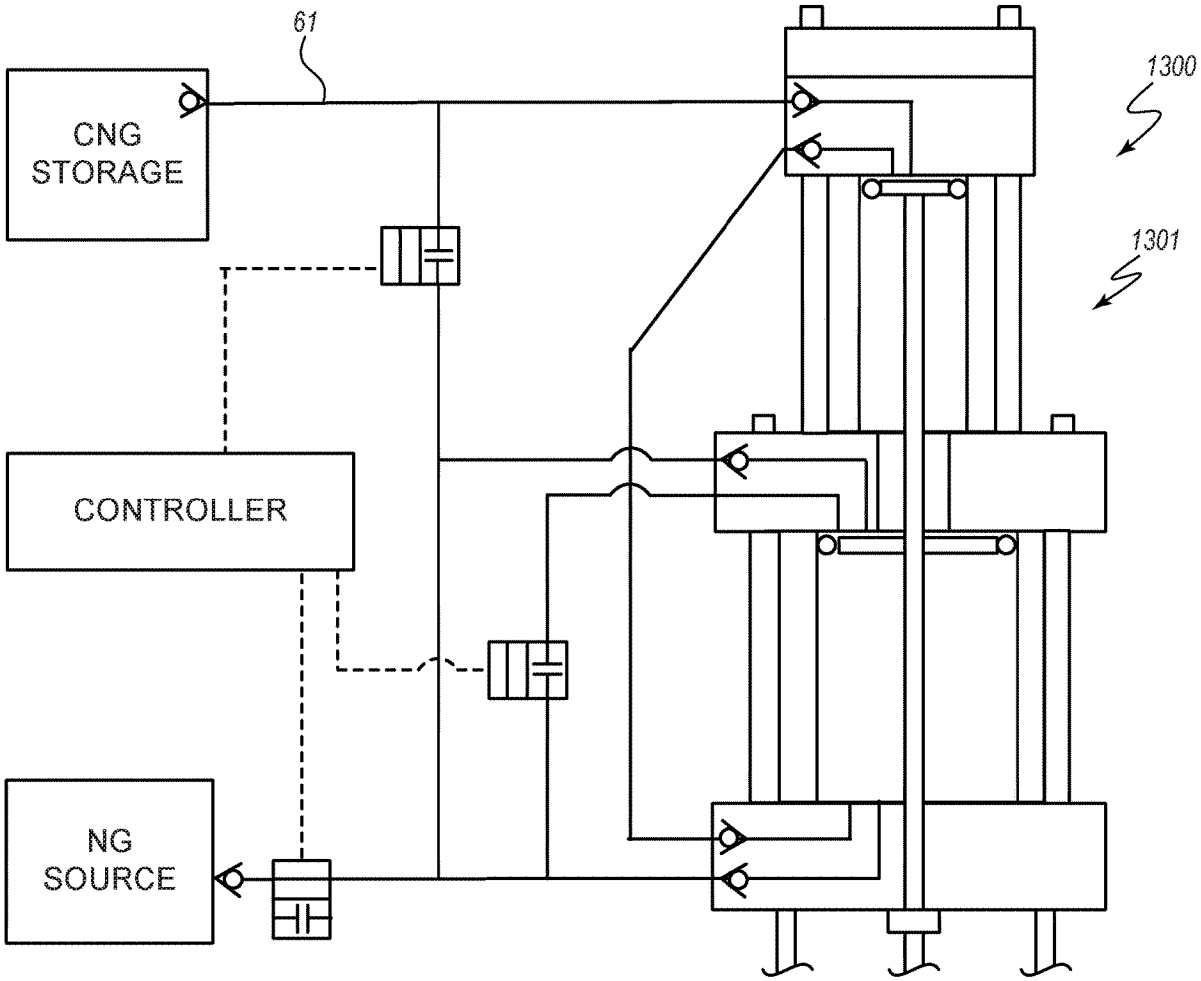
FIG. 17 is a schematic view of another embodiment of a natural gas compression system that includes a cross-sectional view of the gas compression assembly portion of the compressor assembly of FIG. 15, wherein the system is configured to bleed high pressure gas from a fill hose back into the gas compression assembly after a filling operation, although such bleeding of high pressure gas is not permitted in the operational state illustrated in FIG. 17.

FIG. 17 is a schematic view of another embodiment of a natural gas compression system 1300. The system combines the features of the systems 1200 and 900 and is configured to bleed high pressure gas from a fill hose 61 back into a gas compression assembly 1301 after a filling operation.

Figure 18:
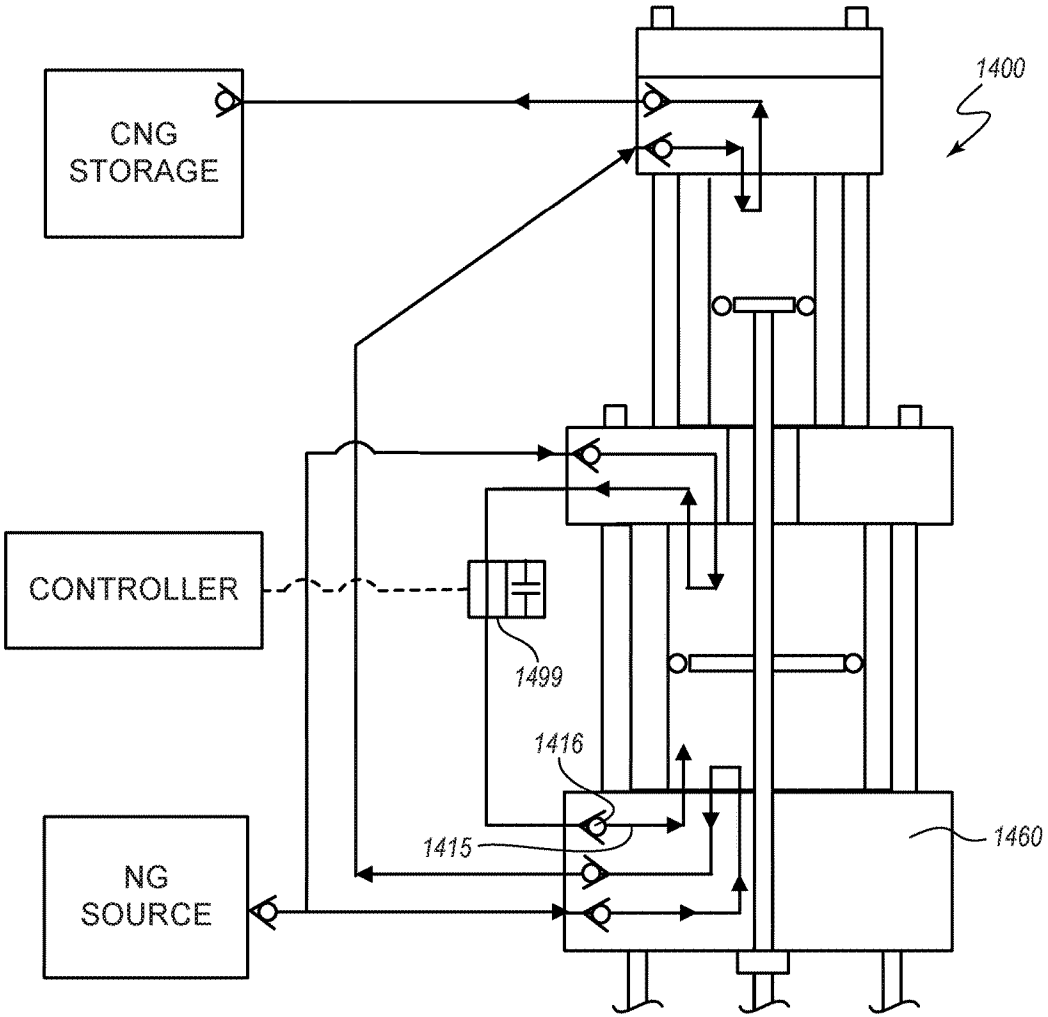
FIG. 18 is a schematic view of another embodiment of a natural gas compression system that includes a cross-sectional view of the gas compression assembly portion of an embodiment of a compressor assembly such as that depicted in FIG. 4, wherein the arrangement is similar to that of FIG. 15.

FIG. 18 is a schematic view of another embodiment of a natural gas compression system 1400 that is similar to the system in FIG. 15. Different fluid paths are present, and a first-stage head 1460 includes an additional fluid path 1415 with an additional check valve 1416, as compared with the system of FIG. 15. Otherwise, operation of a valve 1499 can be the same as operation of the valve 1299 described above.

Figure 19:
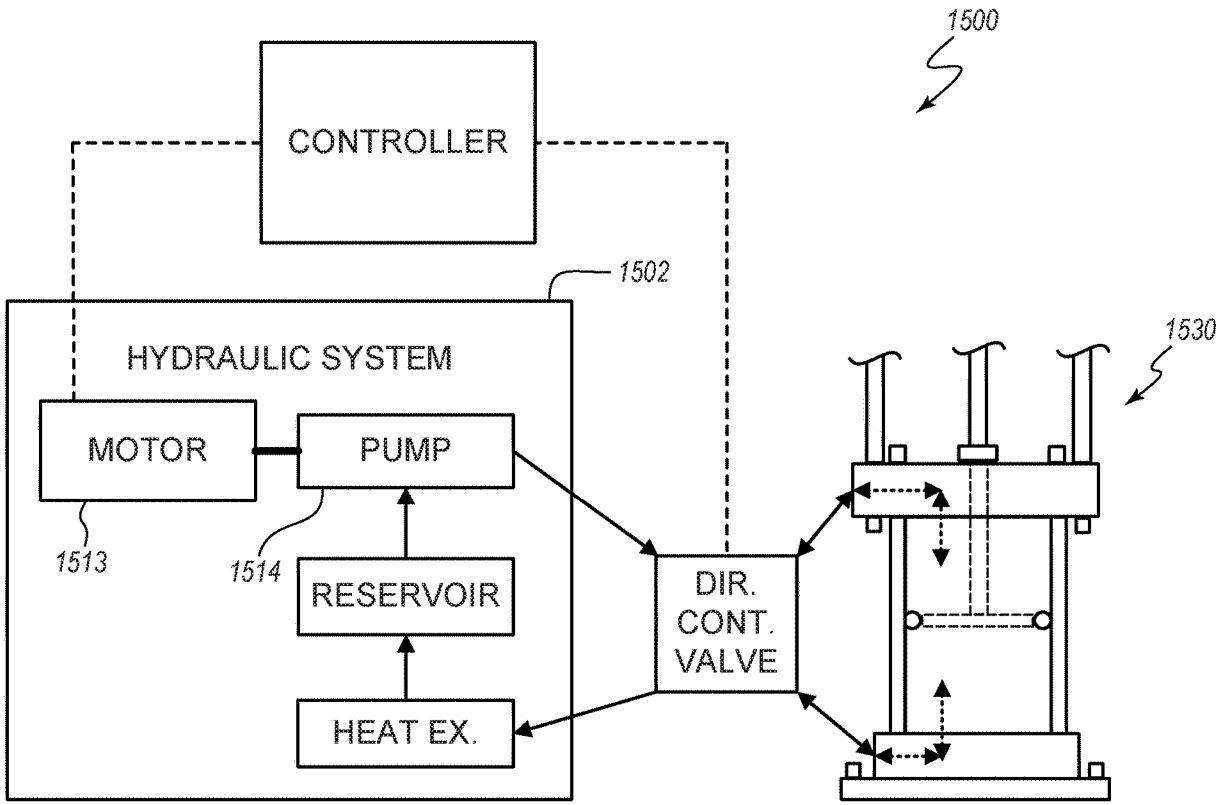
FIG. 19 is a schematic view of another embodiment of a natural gas compression system that includes a front elevation view of a hydraulic driver portion of the compressor assembly of FIG. 4, wherein the system includes a motor and a variable volume hydraulic pump.

FIG. 19 is a schematic view of another embodiment of a natural gas compression system 1500 that includes a front elevation view of a hydraulic driver portion 1530 of a compressor assembly such as that depicted in FIG. 4, wherein a hydraulic system 1502 includes a motor 1513 and a variable volume hydraulic pump 1514.

Figure 20:
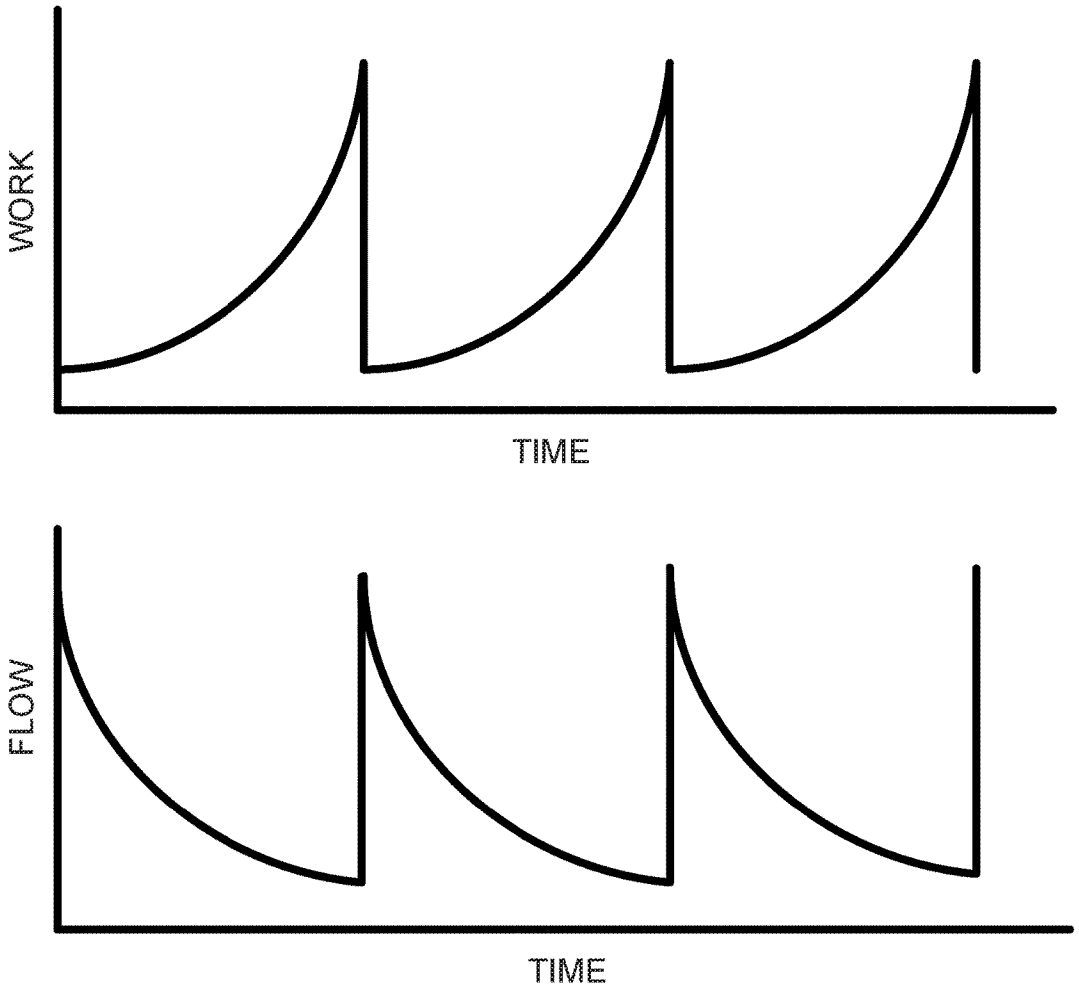
FIG. 20 is a comparison of two plots having a common time scale, wherein the upper plot depicts the work that would be performed in compressing a gas if a piston were moved at a constant speed, and the lower plot depicts a target flow rate to be provided by the hydraulic pump of FIG. 19 to yield relatively constant power requirements for the motor.

FIG. 20 is a comparison of two plots having a common time scale, wherein the upper plot depicts the work that would be performed in compressing a gas if a piston were moved at a constant speed, and the lower plot depicts a target flow rate to be provided by the hydraulic pump 1514 of FIG. 19 to yield relatively constant power requirements for the motor 1513. The plots demonstrate why it may be desirable to use a variable volume hydraulic pump 1514, in some instances, as the pump can approximate the target flow rates of the lower plot to provide relatively constant power to the compressor.

Figure 21:
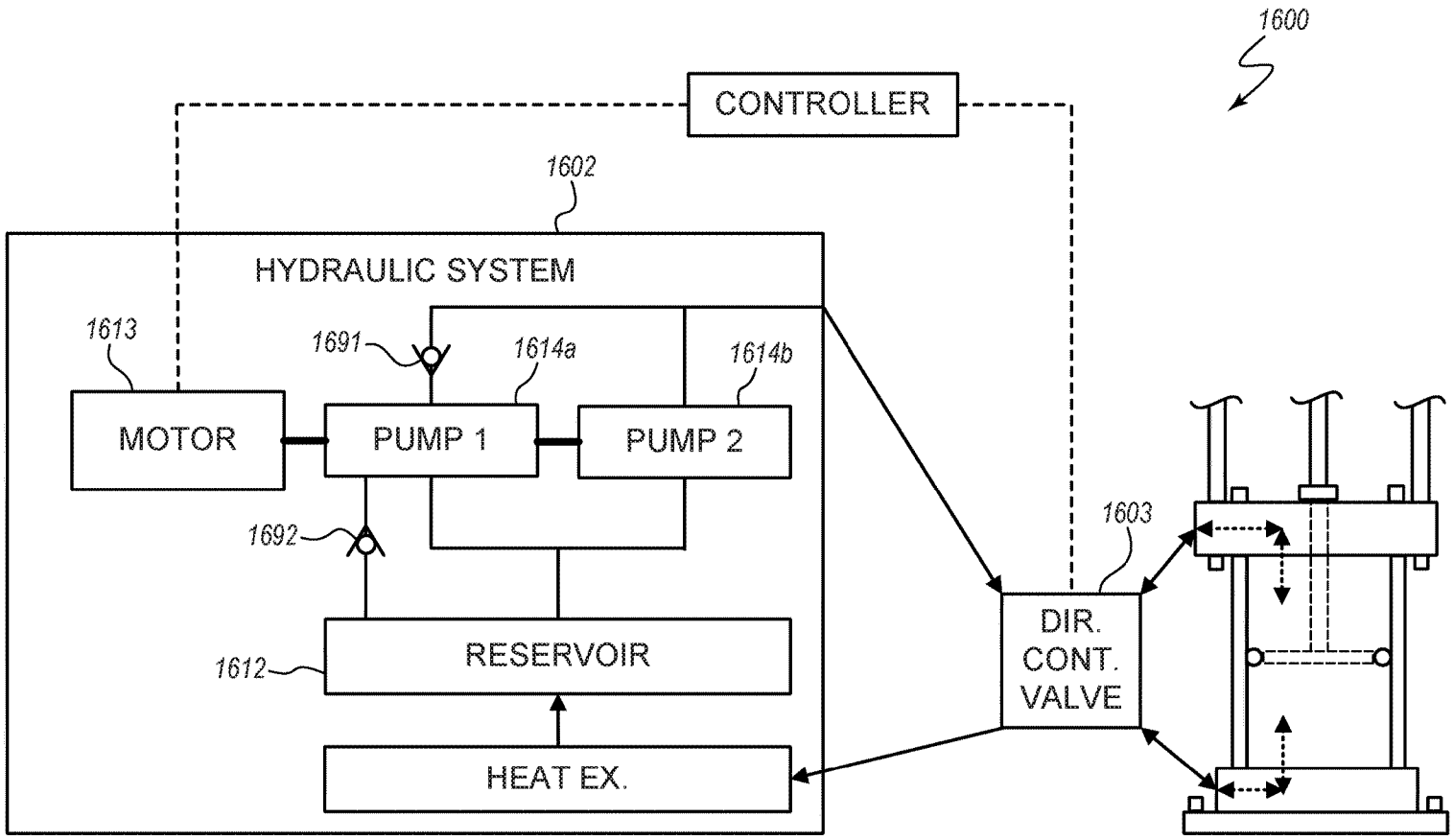
FIG. 21 is a schematic view of another embodiment of a natural gas compression system that includes a front elevation view of a hydraulic driver portion of the compressor assembly of FIG. 4, wherein the system includes a motor coupled to two different pumps to achieve a variable flow pattern.

FIG. 21 is a schematic view of another embodiment of a natural gas compression system 1600, wherein the system includes a hydraulic system 1602 that includes a motor 1613 coupled to two different pumps 1614*a*, 1614*b* to achieve a variable flow pattern. One of the pumps, namely the pump 1614*a*, may be configured to deliver a high flow, but a relatively low pressure. The other pump, namely the pump 1614*b*, may be configured to deliver a lower flow, but at a higher pressure. The outputs of the pumps 1614*a*, 1614*b* may aid in achieving a more constant power usage for the motor 1613.

With respect to the high flow pump 1614*a*, the hydraulic system may include a valve system to permit delivery of high flow to the hydraulic portion of the compressor under low pressure conditions, while permitting a pressure relief or "dump" option for the pump 1614*a* under high pressure conditions. For example, the pump 1614*a* may be coupled to a directional control valve 1603 via a first one-way valve 1691 (e.g., a check valve) and may be coupled to a fluid reservoir 1612 via a second one-way valve 1692. The second one-way valve 1692 may have a predetermined or preselected cracking pressure at which the pump 1614*a* can dump its high volume flow of fluid. Accordingly, under low pressure conditions in the directional control valve fluid line, the pump 1614*a* can provide sufficient pressure to open the valve 1691 and provide high fluid flow to the directional control valve 1603. However, when the pressure in the directional control valve fluid line exceeds the cracking pressure of the valve 1692, the valve 1692 opens and the valve 1691 closes.

Figure 22:
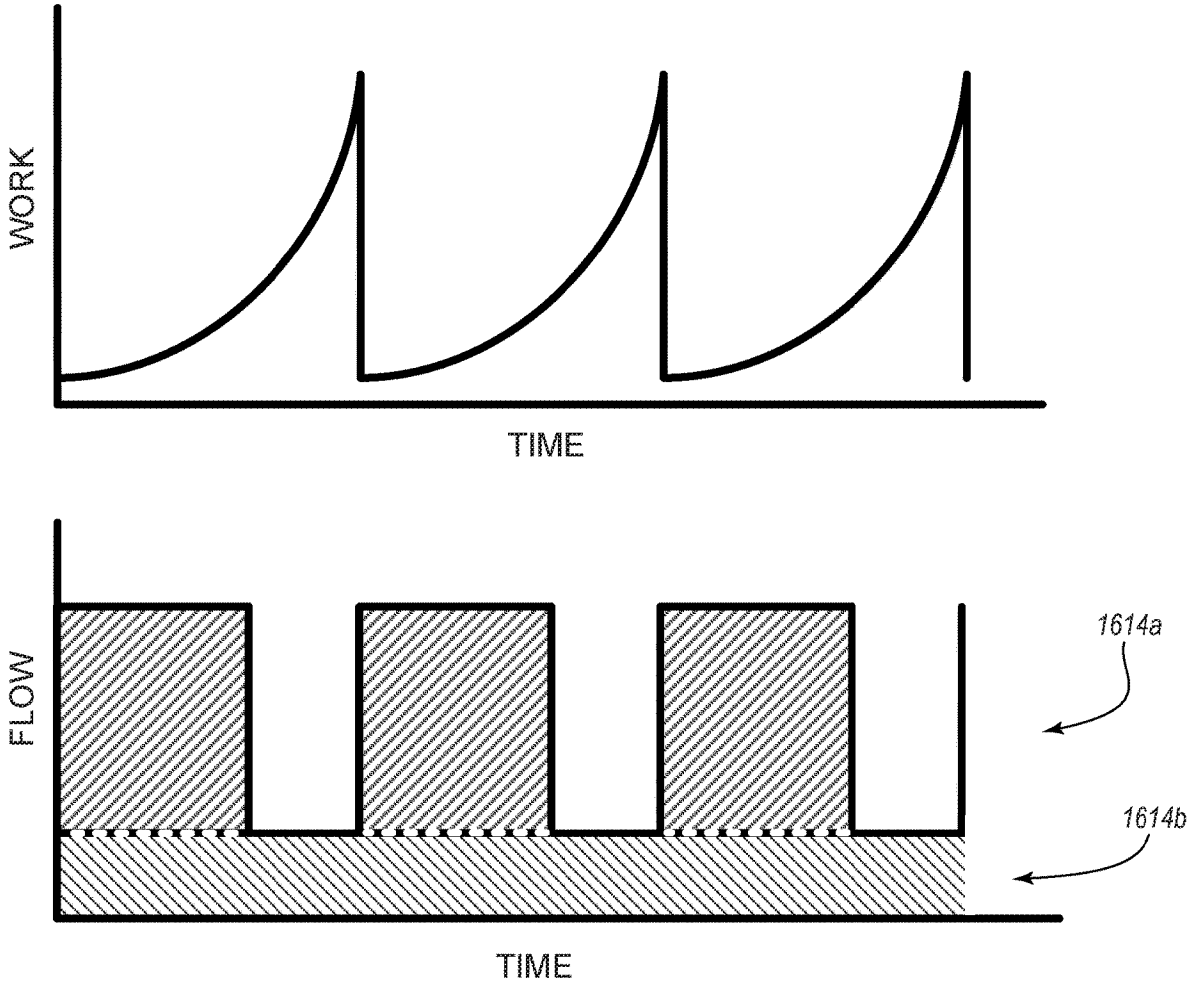
FIG. 22 is a comparison of two plots having a common time scale, wherein the upper plot depicts the work that would be performed in compressing a gas if a piston were moved at a constant speed, and the lower plot depicts the flow pattern provided by the two pumps of FIG. 21, which reduces power usage fluctuations for the motor, as compared with only one of the pumps.

FIG. 22 is a comparison of two plots having a common time scale, wherein the upper plot depicts the work that would be performed in compressing a gas if a piston were moved at a constant speed, and the lower plot depicts the flow pattern provided by the two pumps of FIG. 21, which reduces power usage fluctuations for the motor, as compared with only one of the pumps. In certain arrangements, more constant power requirements and/or faster cycling rates can be achieved by using more pumps. The intermittent high flow/low pressure delivery from pump one is shown at 1614*a*, whereas the steady low flow/high pressure delivery from pump two is shown at 1614*b*.

Similar systems may be constructed with more than two pumps (e.g., three or more pumps) that are coupled to a single motor. In some embodiments, a greater number of pumps can provide a more steady power usage for the motor.

Figure 23:
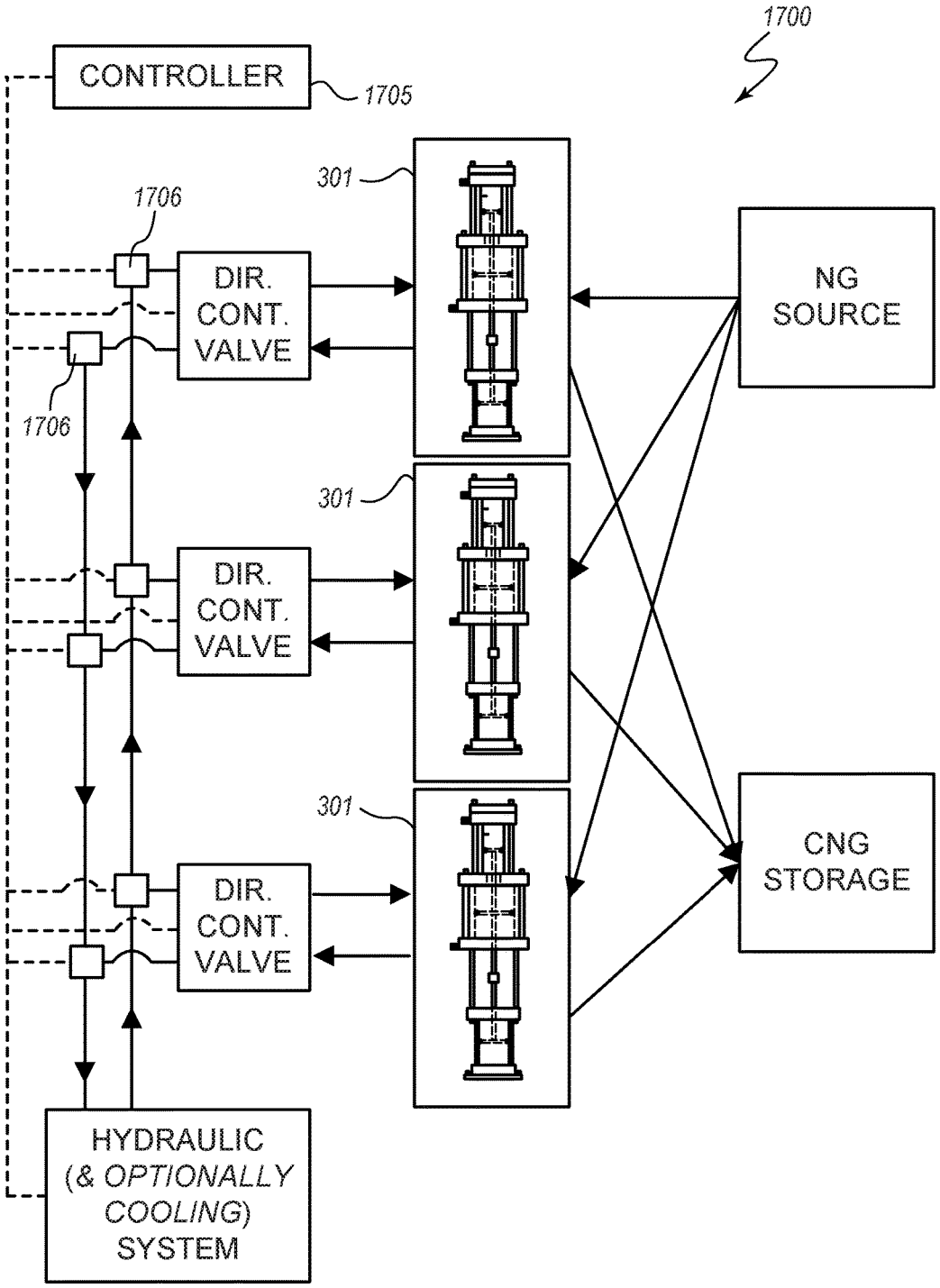
FIG. 23 is a schematic view of another embodiment of a natural gas compression system that includes multiple compressor assemblies, wherein a cycle of each hydraulic driver portion is offset relative to each of the remaining driver portions to yield a more constant power requirement for a motor that drives a pump at a constant flow rate than would be present if a single assembly were in use.

FIG. 23 is a schematic view of another embodiment of a natural gas compression system 1700 that includes multiple compressor assemblies (e.g., assemblies 301), wherein a cycle of each hydraulic driver portion is offset relative to each of the remaining driver portions to yield a more constant power requirement for a motor that drives a pump at a constant flow rate than would be present if a single assembly were in use. Certain embodiments of the system 1700 can provide a high output compressor system that uses the same pump and motor setup as would be used with only a single compressor assembly 301.

In certain embodiments, the system is scalable. For example, in some instances, an operator may begin with a single compressor assembly 301, and may subsequently add one or more compressor assemblies, as desired. In some arrangements, the amount by which one compressor 301 is offset relative to another can be varied, depending on the total number of compressors 301 that are being controlled. In some embodiments, the scalability may be user-friendly. For example, a controller may be pre-set to operate one, two, three, four, or more compressor assemblies 301, and/or a user can select or adjust the settings. Stated otherwise, a scalable system 1700 can allow a user to increase the capacity of its compression system 1700 without merely replacing it, which can be highly economical for the user. Stated otherwise, a user may be able to readily add one or more compressor assemblies to an existing system. In certain of such up-scaled systems, which include two or more assemblies, a single volume pump may be used, rather than a variable volume pump. Use of a single volume pump may, in some arrangements, avoid specialized and/or expensive valving.

A controller 1705 can control operation of the system 1700. In some embodiments, any suitable arrangement of valves 1706 can be used to selectively, sequentially, or otherwise direct fluid flow to the various compressors 301.

Figure 24:
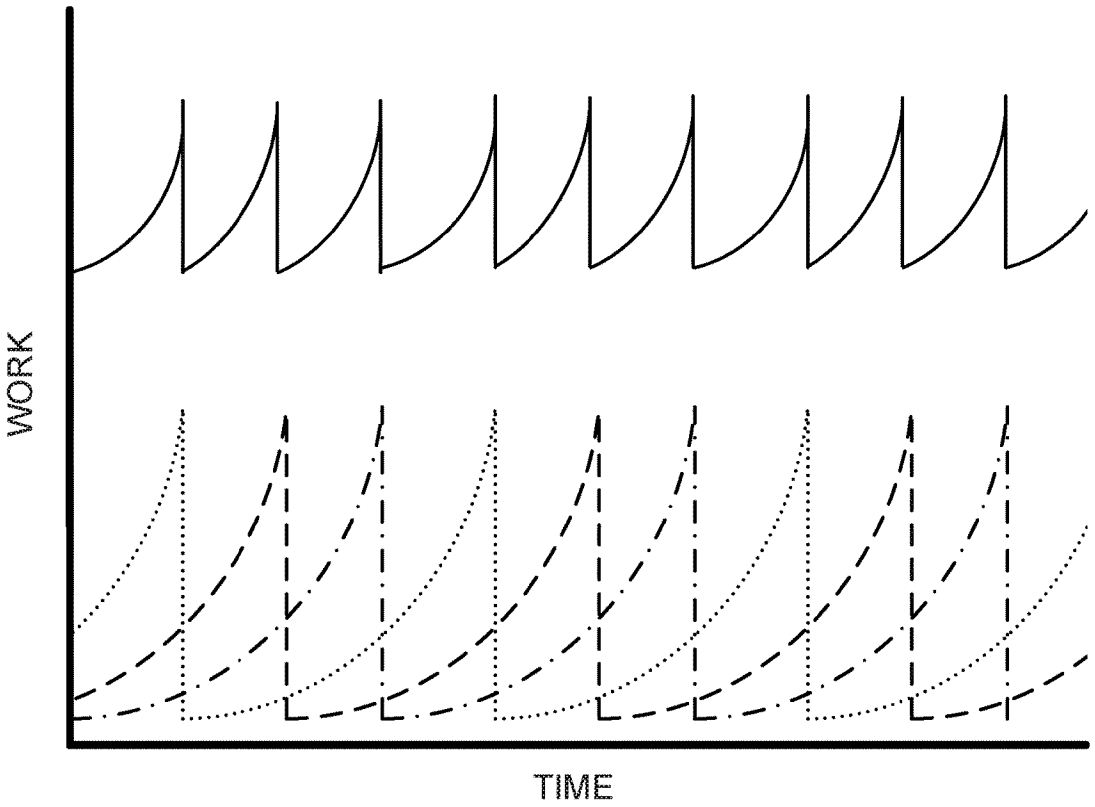
FIG. 24 is a plot having a common time scale, wherein the lower three curves depict the work that each compressor assembly performs in compressing gas, which work curves are offset from each other or staggered, and the upper curve depicts the total work performed by the hydraulic system in operating the compressor assemblies.

FIG. 24 is a plot having a common time scale, wherein the lower three curves depict the work that each compressor assembly performs in compressing gas. The work curves are offset from each other or staggered. The upper curve depicts the total work performed by the hydraulic system in operating the compressor assemblies. Although not shown in the illustrated plot, in some arrangements, the work requirement for each compressor assembly can drop completely to zero. In contrast, due to the operational offset among multiple compressor assemblies, the work requirement may never drop to zero, in some arrangements.

Figure 25:
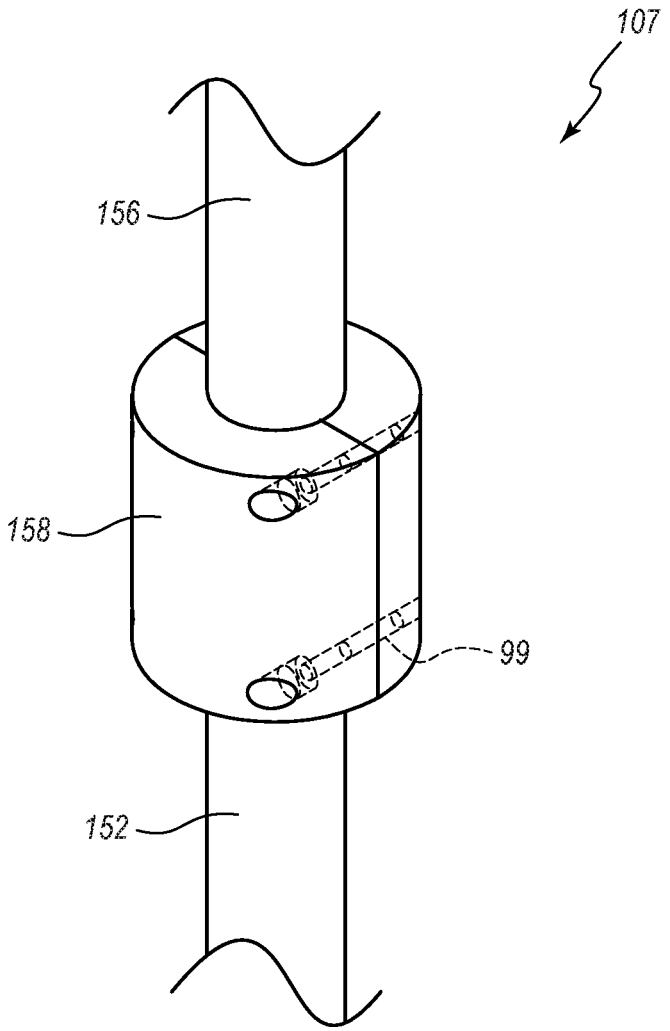
FIG. 25 is a perspective view of a portion of a separable hydraulic ram that is maintained in an operational state via a coupling sleeve.

FIG. 25 is a perspective view of a portion of a separable hydraulic ram 107 that is maintained in an operational orientation via a coupling sleeve 158. In particular, the ram 107 of FIG. 1A is shown, with both the upper and lower shafts 156, 152, respectively, and the coupling sleeve 158.

Figure 26:
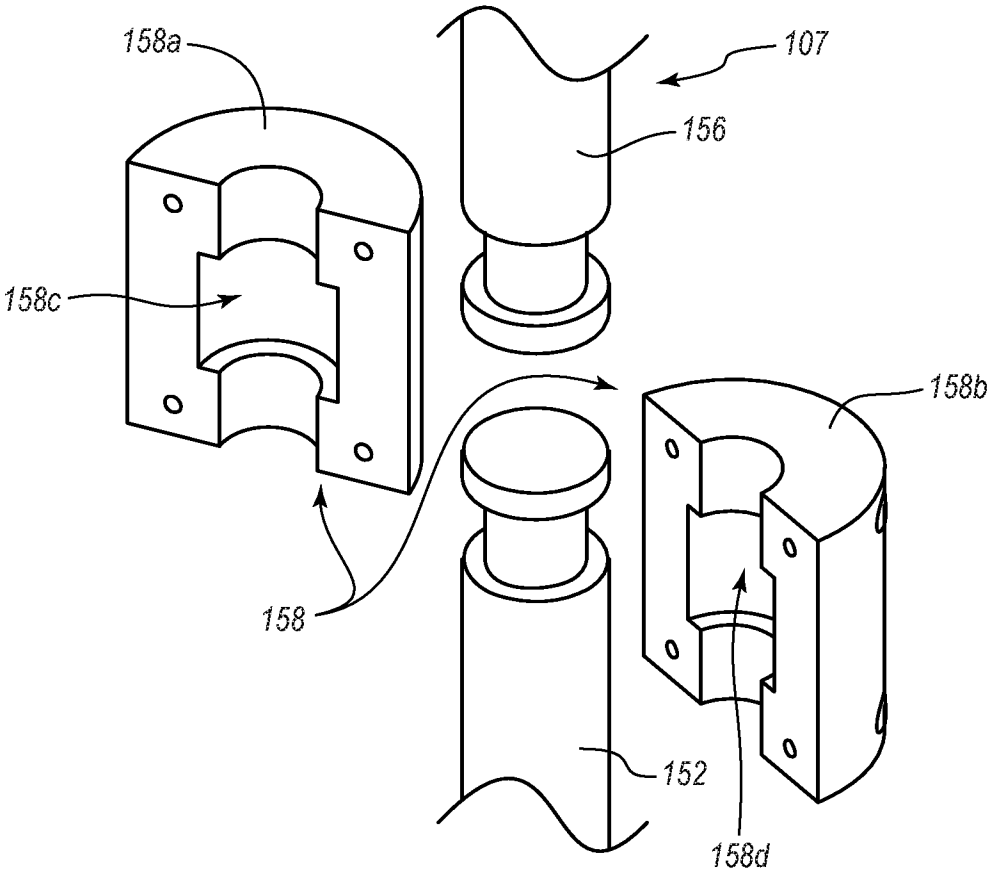
FIG. 26 is an exploded perspective view showing the coupling sleeve removed from the separable hydraulic ram.

FIG. 26 is an exploded perspective view showing the coupling sleeve 158, which is a two-part sleeve in the illustrated embodiment, removed from the separable hydraulic ram 107. Each portion of the sleeve 158*a*, 158*b* defines a cavity 158*c*, 158*d* that is sized to receive the ends of the upper and lower shafts 156, 152. As shown in FIG. 25, the portions 158*a*, 158*b* can be held together via one or more fasteners 99. In some embodiments, an axis of the fasteners 99 may be substantially perpendicular to a longitudinal axis of the shafts 152, 156.

The separable hydraulic ram 107 can facilitate disassembly of a compressor (e.g., the compressors 101, 301). For example, with reference to FIG. 1B, by removing the sleeve 158, as well as the fasteners 142 and or spacers 148 at either side of the upper hydraulic head 145, the compression assembly 137 can be removed (e.g., for servicing, such as to replace a seal, or replacement) without disrupting the hydraulic driver portion 130 of the compressor assembly 101.

Figure 27:
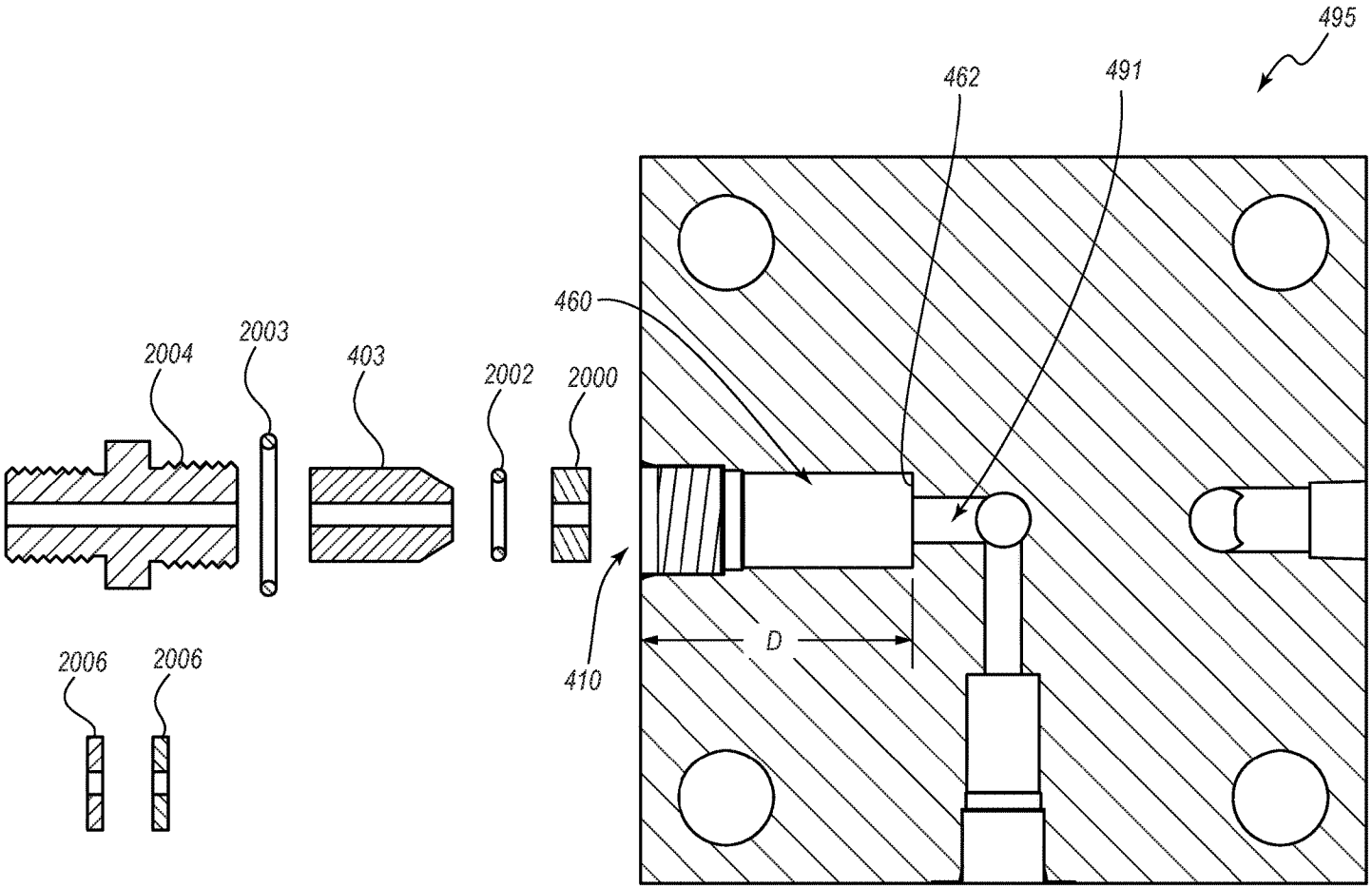
FIG. 27 is an exploded cross-sectional view of a portion of the cooling head assembly of FIG. 5A, which includes additional components that are not shown in FIG. 5A.

FIG. 27 is a cross-sectional view of the second-stage base head 495 discussed above and multiple components that are configured to be coupled therewith. In particular, FIG. 27 illustrates various components that are configured to be coupled with the entrance port 410. The components include a valve seat 2000, an O-ring 2002, the check valve 403, an O-ring 2003, and a fitting 2004 of any suitable variety. In some instances, one or more shims 2006 (which may be brass or any other suitable material) may optionally be used for spacing.

The base head 495 can be a relatively expensive part that desirably need not be replaced frequently. However, even when the valve seat 460, including the valve shelf 462, is bored to a depth D within acceptable tolerances, there can still be some variability in the resulting depth to which the check valve 403 is tightened within the valve seat 460.

In the absence of the valve seat 2000, the end of the check valve 403, which in some embodiments may be relatively narrow, contacts the shelf 462. In such instances, the check valve 403 is desirably secured within the valve seat 460 by the fitting 2004 to tightly press the O-ring 2002 against the shelf 462 to establish a fluid-tight seal thereby. However, it can be difficult to do so without embedding the narrow tip into the material of the head 495. Forming an impression of the valve tip in the shelf 462 damages the head 495 and can result in leaking. Moreover, if the valve 403 is not tightened sufficiently, gas can leak. Achieving a proper balance is rendered even more difficult by the desire to form a fluid-tight seal between the fitting 2004 and the outer portion of the port 410 via the O-ring 2003. In effect the fitting 2004 is responsible for forming two seals as it is tightened into place—it is responsible for the seal formed by the O-rings 2002 and 2004. This can be particularly difficult to achieve without damaging the head 495 or not pressing sufficiently hard on the valve 403. In addition to applying excess force to the valve 403, cyclical loading of the valve 403 may also result in deformation of the shelf 462.

The valve seat 2000 can aid in forming these seals while preserving the head 495 from damage. The valve seat 2000 can be hardened so as to withstand pressure from the valve tip. For example, in some embodiment, the valve seat 2000 comprises hardened stainless steel (e.g., Ph-17-4 stainless steel). Moreover, the valve seat 2000 can define a greater surface area for pressing against the shelf 462 than is provided by the narrow tip of the valve 403. Even if the valve 403 leaves an impression in a proximal surface of the valve seat 2000, this is unlikely to damage the shelf 462. Accordingly, in some instances, the valve seat 2000 may be employed sacrificially to preserve the head 495. In some embodiments, a thickness of the valve seat 2000 can be selected, predetermined, or adjusted to compensate for a depth that might not otherwise be achievable via the shims 2006, or that might be difficult to achieve via the shims 2006.

Figure 28:
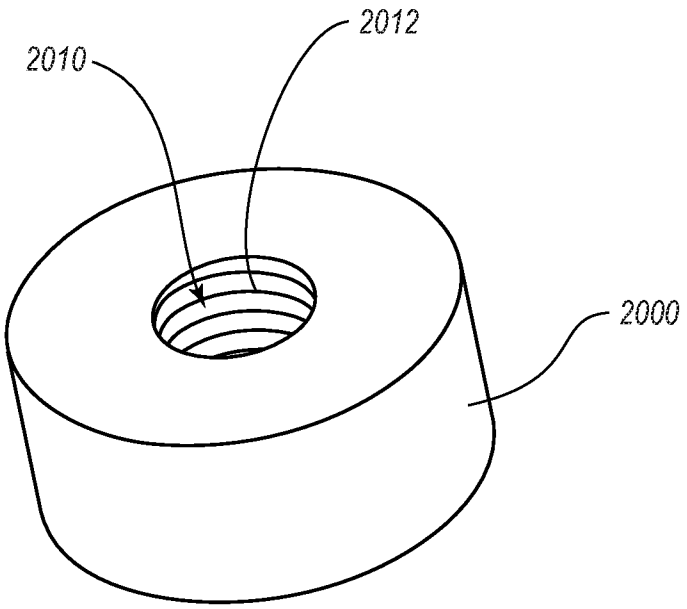
FIG. 28 is a perspective view of an embodiment of a valve seat.

As shown in FIG. 28, in some embodiments, the valve seat 2000 defines a port 2010 through which gas can flow. The port 2010 can include threading 2012. In some embodiments, the threading can be used to remove the port 2010 from the valve seat 460. For example, if the valve seat 2000 is compressed into the valve seat 460, a tool can be threaded into the port 2010 to permit application of sufficient retraction force.

Figure 29:
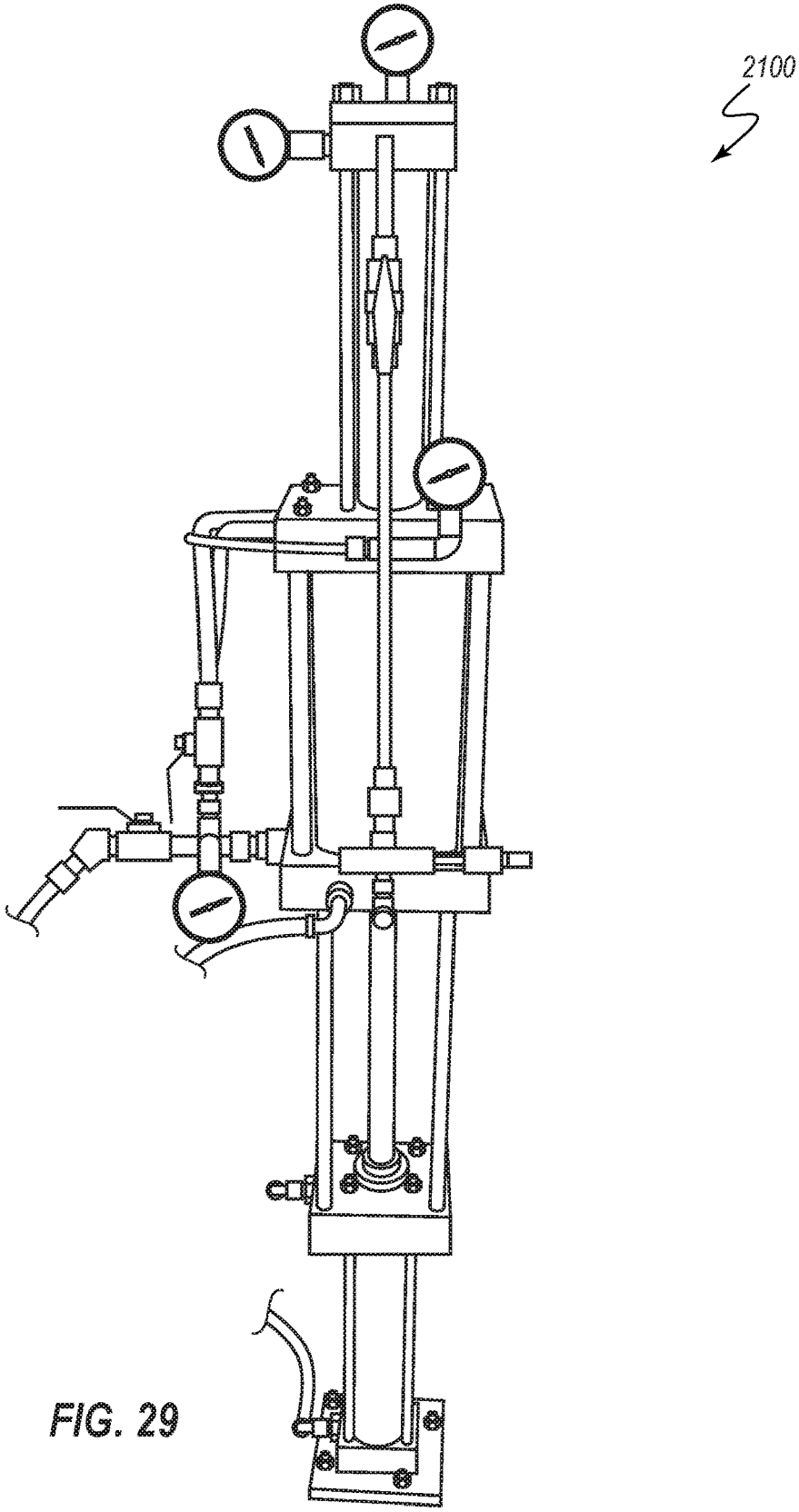
FIG. 29 is a perspective view of another embodiment of a natural gas compression system.

FIG. 29 is a perspective view of another illustrative embodiment of a gas compression system 2100 that can resemble other systems disclosed herein. Features of the illustrative embodiment are readily recognizable from the discussion of those similar embodiments and their accompanying drawings. FIG. 29 provides perspective views of the compression cylinders, heads, etc.

A few of the features and concepts that are present in one or more of the foregoing embodiments are discussed further hereafter. Although specific reference is no longer made to a specific drawing or set of drawings in the following discussion, it will be apparent which of the embodiments previously described with respect to the drawings correspond with a given concept or feature.

In certain embodiments, the high pressure in a fill hose can be relieved back into a compressor. For example, in some arrangements, prior to removing a fill hose (e.g., the fill hose is the hose or other suitable conduit that transfers gas from the compressor to a vehicle or to a storage tank), pressure inside the hose generally must be reduced to a value that is less than a threshold amount (e.g., 125 psi). In order to accomplish this task, a compressor can use a computer- or controller-controlled valve located on the gas supply line (e.g., the gas supply line is the hose or other suitable conduit that transfers gas from the gas main to the compressor) to shut off the flow of gas to the compressor. In some embodiments, the compressor may cycle at least one more time after the valve has been closed, thus reducing the total mass and pressure of gas in the compressor. After this has been accomplished, a computer—or controller—controlled valve, or system of such controlled valves, will shut off the compressor outlet to the fill hose and will open the fill hose to the first stage of the compressor. This can allow the high pressure gas located in the hose to be dissipated throughout an entire volume of at least a portion of the compressor (e.g., an open space in a first stage chamber and/or pre-staging chamber), resulting in a pressure that is below the threshold value (e.g., less than 125 psi) in the fill hose, thus permitting safe disconnection of the fill hose.

The volume of the fill hose can be considered in relation to the available volume in the compression chambers to ensure that the equalized pressure is less than the threshold value. Systems that permit depressurizing in this manner can be advantageous, as they can eliminate the need for a separate pressure vessel. That is, certain known depressurizing circuits utilize a separate pressure vessel to equalize the pressure. The absence of such a separate vessel from a system can reduce the cost and/or size of the system. In still other instances, the excess pressure may be bled back into the supply line, which can be dangerous.

Certain embodiments can use a variable flow hydraulic pump for natural gas compression. A work load for compressing a gas can follow an exponential curve, beginning with very little work required at the start of the compression stroke and ending with the maximum required work at the end of the compression stroke. In certain instances, in order to maximize the rate of compression and create a constant power requirement from the motor, the flow rate of driving fluid may be inversely proportional to the compression curve, with high flow/low pressure at the beginning of the compression stroke and low flow/high pressure at the end of the compression stroke. In various embodiments, this can be accomplished using a variable volume hydraulic pump and/or by using multiple pumps connected to a single motor.

Moreover, in some embodiments, a single fluid can be used to drive the hydraulic cylinder, which drives the compression cylinders, and further can be used in the cooling system to remove thermal energy from the compressor. This can eliminate an extra motor, pump, thermally conductive fluid, reservoir, liquid-to-air heat exchanger, and filter that might otherwise be used in systems having separate hydraulic and cooling systems. This can greatly reduce the cost, time, and/or ease of assembly and/or use of the compressor system, the system's overall size, and/or the amount of fluid contained within the system (which can also reduce cost).

As previously mentioned, in some embodiments, a gas compression system can include a variable flow hydraulic pump. In some instances, a variable flow hydraulic pump can be used to match the work requirement of compressing a gas. In certain of such embodiments that include a hydraulic pump, the return line from the hydraulic cylinder portion of a compressor can be diverted through the cooling system prior to returning to the reservoir.

As was also previously mentioned, in some embodiments, a gas compression system can include multiple hydraulic pumps. For example, multiple hydraulic pumps can be connected to a single electric motor. Each pump can have a different pressure and flow rate. In a two-pump system, the pump having a lower flow rate and higher pressure may always drive the hydraulic cylinder, whereas the pump having the higher flow rate and lower pressure may have its flow diverted through the cooling system towards the end of the compression stroke. This flow is typically just diverted directly back to the fluid reservoir, thus wasting the energy used to drive the pump.

In certain embodiments, natural gas can be cooled after one or more of the compression stages by running the conduit through which the gas is transported (e.g., stainless steel tubing) through a liquid-filled chamber. Removing thermal energy during compression of the natural gas and between the stages can increase the efficiency of a compression system. During compression, thermal energy is removed by utilizing a compression cylinder that is contained within another cylinder between which a liquid coolant is flowing. Between stages, thermal energy is removed by routing the tubing or hose transferring the gas through a assembly with liquid coolant flowing through it (the tubing or hose can be straight or coiled). This results in liquid coolant flowing directly over the hose or tubing that is transferring the gas, which also results in thermal energy being removed from the gas.

In certain embodiments, a chamber that is on the opposite side of a piston relative to a first-stage chamber can be filled with gas during compression of the first-stage gas charge. In certain of such embodiments, a gas inlet can be located between the first and second stages. The compressor thus may permit supply gas into the system throughout the compression cycle (e.g., gas is pulled into the first-stage chamber when the piston expands the first-stage chamber, and additional gas is pulled into the chamber that is at the opposite side of the first-stage chamber when the first-stage chamber is compressed).

In some embodiments, the oppositely-positioned chamber can be used for pre-staging a charge of gas. For example, the gas may be compressed and can be introduced from the pre-staging chamber into the first-stage chamber. In some embodiments, permitting gas into the oppositely-positioned chamber can allow for a larger volume chamber into which fill hose pressure can be dissipated.

Some pre-staging embodiments can use a one-way valve (e.g., a reed valve) mounted in the piston. For example, a valve located in the first stage piston allows the gas to flow from the pre-staging chamber into the first-stage chamber with minimal restrictions.

In some embodiments, a ratio of the first and second stages can be selected or predetermined in order to equalize power used during first and second stage compressions. For example, the diameter of a compression stage chamber can be determined by the amount of work done in each chamber to permit an electric motor to perform the same amount of work in each stroke direction. In some arrangements, only the diameter of the chamber is considered, such as in some arrangements in which the stroke length for the first and second stages is the same. In some instances, if the desired diameters are not available, the first stage may be allowed to do more work.

Certain embodiments include removable hardened seats for the check valves. For certain heads, check valves are retained by a fitting between which are brass shims to maintain correct distance, situations often arise in which too much or too little pressure is applied to retain the check valve. This results in leaking past the check valve. In order to prevent this, hardened and removable valve seats are made to exact size to prevent the check valves from embedding into the bottom of the bore while still maintaining enough pressure to prevent leaking. Although hardened so as to be less susceptible to damage, the valve seats can also be sacrificial, in that they can readily be replaced if they do get damaged.

In certain embodiments, the compression cylinders can be mounted vertically. Mounting the cylinders vertically can allow a system, or components thereof, to have reduced rigidity due to elimination of a bending moment that would otherwise be caused by gravitational force. Vertical mounting can allow for the removal of metal-on-metal bearings that attempt to keep the piston and shaft concentric to the cylinder bore, as the bearing surface is not needed to support the weight of the piston and shaft, the piston seals, and the wear bands.

Vertical mounting can also allow the piston seals to be evenly loaded. For example, if compression cylinders are mounted horizontally, the weight of the piston and piston shaft can be completely supported by the piston seals, in some instances, thus resulting in excessive and premature wear. This phenomenon can be eliminated by mounting the system vertically.

In some embodiments, the space between stage one and stage two can be vented back to the gas inlet. Seals can be prone to failure and/or leakage. In the event of such a compromise of a seal, escaping gas is vented (e.g., to a safe place). In certain embodiments, when gas bypasses the piston seals, it ends up in the volume contained between the compressor stages. By connecting the volume contained between stages of the compressor to the inlet or supply gas line of the compressor, all gas that bypass the seals will be recycled through the compressor.

In certain embodiments, a compression system and/or one or more compressors that are part of that system can have a modular design. For example, in some embodiments, a compressor can be readily disassembled for servicing. In other or further embodiments, one or more compressors can be easily added to or removed from a system. In some embodiments, addition of multiple compressors to a system can reduce fluctuations of supply energy requirements by appropriate phasing of multiple compression heads with a single power source.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

References to approximations are made throughout this specification, such as by use of the terms "about" or "approximately." For each such reference, it is to be understood that, in some embodiments, the value, feature, or characteristic may be specified without approximation. For example, where qualifiers such as "about," "substantially," and "generally" are used, these terms include within their scope the qualified words in the absence of their qualifiers. For example, where the term "substantially the same" is recited with respect to a feature, it is understood that in further embodiments, the feature can be precisely the same.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims.

Recitation in the claims of the term "first" with respect to a feature or element does not necessarily imply the existence of a second or additional such feature or element. Elements specifically recited in means-plus-function format, if any, are intended to be construed in accordance with 35 U.S.C. § 112¶6. Embodiments of the invention in which an exclusive property or privilege is claimed are defined as follows.

The invention claimed is:

1. A natural gas compressor assembly comprising:

a pre-staging chamber configured to be coupled to a supply line to receive natural gas directly and only from the supply line;

a first-stage chamber configured to be coupled to the supply line to receive natural gas from the supply line and coupled with the pre-staging chamber to selectively receive natural gas compressed by a first amount from the pre-staging chamber such that the natural gas compressed in the pre-staging chamber is received by the first-stage chamber separately from the gas received by the supply line;

a second-stage chamber configured to receive natural gas directly and only from the first-stage chamber after the natural gas has been compressed by a second amount in the first-stage chamber;

a drive shaft; and a plurality of pistons coupled to the drive shaft, wherein the plurality of pistons are configured to alter sizes of each of the pre-staging, first-stage, and second-stage chambers as the drive shaft reciprocates in a first direction and in a second direction;

wherein the pre-staging chamber and the second-stage chamber decrease in size and the first-stage chamber increases in size as the drive shaft moves in the first direction; and wherein the pre-staging chamber and the second-stage chamber increase in size and the first-stage chamber decreases in size as the drive shaft moves in the second direction.

2. The assembly of claim 1, wherein the plurality of pistons comprises a first piston and a second piston, wherein a stroke length of the drive shaft in the first direction is the same as a stroke length of the drive shaft in the second direction, wherein the first piston is connected to the drive shaft and moves in tandem therewith to alter a size of the first-stage chamber, wherein the second piston is connected to the drive shaft and moves in tandem therewith to alter a size of the second-stage chamber, and wherein a maximum volume of the first-stage chamber is greater than a maximum volume of the second-stage chamber.

3. The assembly of claim 2, wherein a ratio of the maximum volume of the first-stage chamber to the maximum volume of the second-stage chamber is such that the same amount of work is performed in moving the drive shaft through a full stroke length in the first direction as is performed in moving the drive shaft through a full stroke length in the second direction.

4. The assembly of claim 1, wherein, the pre-staging chamber is physically between the first-stage chamber and the second-stage chamber.

5. The assembly of claim 1, wherein the plurality of pistons comprises a first piston and a second piston, wherein the first piston and the second piston are attached to the drive shaft; wherein the first piston and the second piston remain at a constant distance from each other; wherein the pre-staging chamber is defined at one end by the first piston and at an opposing end by the second piston.

6. The assembly of claim 1, wherein the pre-staging chamber and the first-stage chamber are separated from each other by one of the plurality of pistons that comprises a one-way valve, wherein the one-way valve is configured to selectively permit compressed gas from the pre-staging chamber to flow into the first-stage chamber, and wherein the one-way valve is configured to prevent gas from flowing from the first-stage chamber into the pre-staging chamber.

7. The assembly of claim 6, wherein the one-way valve comprises a reed valve.

8. The assembly of claim 1, wherein the assembly comprises a controlled valve that is configured to selectively permit gas to flow from the pre-staging chamber to the first-stage chamber when the a pressure of the gas in the pre-staging chamber is greater than a pressure of the gas in the first-stage chamber and when the valve has been actuated to an open state.

9. The assembly of claim 8, wherein the valve is configured to be in an open state when the drive shaft moves in the first direction and is configured to be in a closed state when the drive shaft moves in the second direction.

10. The assembly of claim 8, wherein the valve is controlled by an electronic controller.

11. The assembly of claim 1, wherein the first amount by which natural gas is compressed in the first-stage chamber is less than the second amount by which natural gas is compressed in the second-stage chamber.

12. The assembly of claim 1, wherein at one or more stages of operation of the assembly, a sleeve defines at least a portion of each of the pre-stage chamber and the first-stage chamber.

13. The assembly of claim 12, wherein the assembly is configured to draw natural gas from the supply line into the sleeve when the drive shaft moves in each of the first and second directions.

14. A natural gas compressor assembly comprising:

a pre-staging chamber configured to be coupled to a supply line to receive natural gas directly and only from the supply line;

a first-stage chamber configured to be coupled to the supply line to receive natural gas from the supply line and coupled with the pre-staging chamber to receive natural gas compressed by a first amount from the pre-staging chamber such that the natural gas compressed in the pre-staging chamber is received by the first-stage chamber separately from the gas received by the supply line;

a second-stage chamber configured to receive natural gas directly and only from the first-stage chamber after the natural gas has been compressed by a second amount in the first-stage chamber;

a drive shaft; and a plurality of pistons coupled to the drive shaft, wherein the plurality of pistons are configured to alter sizes of each of the pre-staging, first-stage, and second-stage chambers as the drive shaft reciprocates in a first direction and in a second direction;

a valve configured to selectively permit gas to flow from the pre-staging chamber to the first-stage chamber;

wherein the pre-staging chamber and the second-stage chamber decrease in size and the first-stage chamber increases in size as the drive shaft moves in the first direction; and wherein the pre-staging chamber and the second-stage chamber increase in size and the first-stage chamber decreases in size as the drive shaft moves in the second direction.

15. The assembly of claim 14, wherein, when the pre-staging chamber is physically between the first-stage chamber and the second-stage chamber.

16. The assembly of claim 14, wherein the pre-staging chamber and the first-stage chamber are separated from each other by a first piston of the plurality of pistons;

wherein the valve is a one-way valve in the first piston, and wherein the one-way valve is configured to prevent gas from flowing from the first-stage chamber into the pre-staging chamber.

17. The assembly of claim 16, wherein the one-way valve comprises a reed valve.

18. The assembly of claim 14, wherein the valve is a controlled valve that is configured to selectively permit gas to flow from the pre-staging chamber to the first-stage chamber when the a pressure of the gas in the pre-staging chamber is greater than a pressure of the gas in the first-stage chamber and when the valve has been actuated to an open state.

19. The assembly of claim 18, wherein the controlled valve is controlled by an electronic controller, and wherein the controlled valve is configured to be in an open state when the drive shaft moves in the first direction and is configured to be in a closed state when the drive shaft moves in the second direction.

20. The assembly of claim 14, wherein the first amount by which natural gas is compressed in the first-stage chamber is less than the second amount by which natural gas is compressed in the second-stage chamber.

21. A natural gas compressor assembly comprising:

a pre-staging chamber configured to be coupled to a supply line to receive natural gas directly and only from the supply line;

a first-stage chamber configured to be coupled to the supply line to receive natural gas from the supply line and coupled with the pre-staging chamber to receive natural gas compressed by a first amount from the pre-staging chamber such that the natural gas compressed in the pre-staging chamber is received by the first-stage chamber separately from the gas received by the supply line;

a second-stage chamber configured to receive natural gas directly and only from the first-stage chamber after the natural gas has been compressed by a second amount in the first-stage chamber;

a drive shaft; and a plurality of pistons coupled to the drive shaft, wherein the plurality of pistons are configured to alter sizes of each of the pre-staging, first-stage, and second-stage chambers as the drive shaft reciprocates in a first direction and in a second direction;

a valve configured to selectively permit gas to flow from the pre-staging chamber to the first-stage chamber;

wherein the pre-staging chamber and the second-stage chamber decrease in size and the first-stage chamber increases in size as the drive shaft moves in the first direction;

wherein the pre-staging chamber and the second-stage chamber increase in size and the first-stage chamber decreases in size as the drive shaft moves in the second direction; and wherein a ratio of the maximum volume of the first-stage chamber to the maximum volume of the second-stage chamber is such that the same amount of work is performed in moving the drive shaft through a full stroke length in the first direction as is performed in moving the drive shaft through a full stroke length in the second direction.

22. The assembly of claim 21, wherein the first amount by which natural gas is compressed in the first-stage chamber is less than the second amount by which natural gas is compressed in the second-stage chamber.

* * * * *